US010519594B2

(12) United States Patent
Kelly et al.

(10) Patent No.: US 10,519,594 B2
(45) Date of Patent: Dec. 31, 2019

(54) SUPERCRITICAL FLUID MATERIAL SCOURING

(71) Applicant: NIKE, Inc., Beaverton, OR (US)

(72) Inventors: Matt W. Kelly, Portland, OR (US); Gerardo A. Montero, Raleigh, NC (US); Anand P. Kanchagar, Beaverton, OR (US); Pankaj Rugnath Panchmatia, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 649 days.

(21) Appl. No.: 15/048,655

(22) Filed: Feb. 19, 2016

(65) Prior Publication Data

US 2016/0244909 A1 Aug. 25, 2016

Related U.S. Application Data

(60) Provisional application No. 62/119,015, filed on Feb. 20, 2015, provisional application No. 62/119,010,
(Continued)

(51) Int. Cl.
*B24C 1/00* (2006.01)
*D06M 11/76* (2006.01)
(Continued)

(52) U.S. Cl.
CPC ..... *D06M 11/76* (2013.01); *D06B 19/00* (2013.01); *D06L 1/00* (2013.01); *D06P 5/2055* (2013.01)

(58) Field of Classification Search
CPC ..... B24C 1/00; D06P 1/94; D06M 23/105
(Continued)

(56) References Cited

U.S. PATENT DOCUMENTS 5,298,032 A 3/1994 Schlenker
5,340,614 A * 8/1994 Perman ..... A61K 9/1647 427/2.24
(Continued)

FOREIGN PATENT DOCUMENTS

CN 1693580 A 11/2005
CN 101812809 A 8/2010
(Continued)

OTHER PUBLICATIONS

International Search Report and Written Opinion dated Jun. 1, 2016 in International Patent Application No. PCT/US2016/018668, 12 pages.
International Preliminary Report on Patentability dated Aug. 31, 2017 in International Patent Application No. PCT/US2016/018668, 8 pages.
Non-Final Office Action dated Nov. 17, 2017 in U.S. Appl. No. 15/048,639, 7 pages.
Non-Final Office Action dated Nov. 30, 2017 in U.S. Appl. No. 15/048,634, 8 pages.
(Continued)

*Primary Examiner* — Robert A Rose
(74) *Attorney, Agent, or Firm* — Shook, Hardy & Bacon, LLP

(57) ABSTRACT

Supercritical fluid ("SCF") is used to scour a target material to leave scour elements, such as oligomers and oils from the target material. Carbon dioxide ("$CO_2$") is introduced into a pressure vessel also containing the target material to be scoured. The $CO_2$ is raised in temperature and pressure to a SCF state. The $CO_2$ is recirculated within the pressure vessel to scour the target material. An exchange of the $CO_2$ is occurs allowing for the scoured elements to be removed from the $CO_2$ and therefore from within the pressure vessel. Operation variables such as temperature, pressure, time, internal flow rate, and $CO_2$ exchange are adjusted to achieve a scouring of the target material.

17 Claims, 24 Drawing Sheets

Related U.S. Application Data filed on Feb. 20, 2015, provisional application No. 62/135,680, filed on Mar. 19, 2015, provisional application No. 62/296,983, filed on Feb. 18, 2016.

(51) Int. Cl.
*D06P 5/20* (2006.01)
*D06L 1/00* (2017.01)
*D06B 19/00* (2006.01)

(58) Field of Classification Search
USPC ..... 451/37, 38, 39, 40, 75, 53
See application file for complete search history.

(56) References Cited

U.S. PATENT DOCUMENTS

| | | | | |
|---|---|---|---|---|
| 5,508,060 | A * | 4/1996 | Perman | A61K 9/1647 427/2.14 |
| 5,798,438 | A | 8/1998 | Sawan et al. | |
| 5,938,794 | A * | 8/1999 | Eggers | D06B 5/16 8/475 |
| 5,958,085 | A | 9/1999 | Eggers | |
| 6,048,369 | A | 4/2000 | Smith et al. | |
| 6,183,521 | B1 | 2/2001 | Lin et al. | |
| 6,261,326 | B1 | 7/2001 | Hendrix et al. | |
| 6,615,620 | B2 | 9/2003 | Hendrix et al. | |
| 7,938,865 | B2 | 5/2011 | Fernandez Cid et al. | |
| 2007/0264175 | A1 | 11/2007 | Iversen et al. | |
| 2011/0138547 | A1 | 6/2011 | Fernandez Cid et al. | |
| 2012/0047665 | A1 | 3/2012 | Yager | |
| 2014/0305170 | A1 | 10/2014 | Fetner | |

FOREIGN PATENT DOCUMENTS

| | | | |
|---|---|---|---|
| CN | 101812810 | A | 8/2010 |
| CN | 102877329 | A | 1/2013 |
| CN | 102787459 | B | 1/2014 |
| CN | 102776739 | B | 4/2014 |
| CN | 103726351 | A | 4/2014 |
| CN | 103741523 | A | 4/2014 |
| CN | 203546404 | U | 4/2014 |
| CN | 104342869 | A | 2/2015 |
| DE | 3906724 | A1 | 9/1990 |
| DE | 4333221 | A1 | 4/1995 |
| WO | 9314255 | A1 | 7/1993 |
| WO | 9418264 | A1 | 8/1994 |
| WO | 9963146 | A1 | 12/1999 |
| WO | 0233163 | A1 | 4/2002 |

OTHER PUBLICATIONS

U.S. Appl. No. 15/048,639, filed Feb. 19, 2016, Kelly Matt W, 71 pages.
U.S. Appl. No. 15/048,634, filed Feb. 19, 2016, Kelly Matt W et al, 115 pages.
International Search Report and Written Opinion dated Jun. 1, 2016 in International Patent Application No. PCT/US2016/018671, 12 pages.
International Search Report and Written Opinion dated Jun. 3, 2016 in International Patent Application No. PCT/US2016/018673, 11 pages.
Office Action dated Sep. 25, 2018 in European Patent Application No. 16710359.7, 3 pages.
Notice of Allowance dated Nov. 8, 2018 in U.S. Appl. No. 15/048,639, 8 pages.
Final Office Action in related U.S. Appl. No. 15/048,634 dated May 15, 2018, 9 pages.
Final Office Action in related U.S. Appl. No. 15/048,639 dated May 16, 2018, 7 pages.
European Office Action and Examination report in application No. 16 708 862.4-1107 dated Jun. 1, 2018, 3 pages.
European Office Action and Examination report in application No. 16 710 359.7-1107 dated Jun. 1, 2018, 4 pages.
European Office Action and Examination report in application No. 16 709 859.9-1107 dated Jun. 1, 2018, 3 pages.
Communication pursuant to Article 94(3) dated May 16, 2019 in European Patent Application No. 16708862.4, 3 pages.
Communication pursuant to Article 94(3) dated May 16, 2019 in European Patent Application No. 16709859.9, 3 pages.
Communication pursuant to Article 94(3) dated Jun. 7, 2019 in European Patent Application No. 16710359.7, 3 pages.
Notice of Allowance dated Apr. 25, 2019 in Korean Patent Application No. 10-2017-7026570, 1 page.
Communication pursuant to Article 94(3) dated Dec. 7, 2018 in European Patent Application No. 16709859.9, 3 pages.
Communication pursuant to Article 94(3) dated Dec. 7, 2018 in European Patent Application No. 16708862.4, 3 pages.
Communication pursuant to Article 94(3) dated Feb. 1, 2019 in European Patent Application No. 16710359.7, 3 pages.
Non-Final Office Action dated Jan. 8, 2019 in U.S. Appl. No. 15/048,634, 10 pages.
Non-Final Office Action dated Mar. 21, 2019 in U.S. Appl. No. 15/048,639, 7 pages.

* cited by examiner

| | Pressurization | | | | | Dyeing | | | | | Depressurization | | | | |
|---|---|---|---|---|---|---|---|---|---|---|---|---|---|---|---|
| | Temperature (Celsius) | Pressure (Bar) | Internal Pump Flow Rate ($m^3$/hr) | External Pump | Time (Min) | Temperature (Celsius) | Pressure (Bar) | Internal Pump Flow Rate ($m^3$/hr) | External Pump | Time (Min) | Temperature (Celsius) | Pressure (Bar) | Internal Pump Flow Rate ($m^3$/hr) | External Pump | Time (Min) |
| 1 | Start: 80-90<br>End:120 | Start: ~188<br>End: 250 | 90-130 | On/Off | variable | 120 | 250 | 230-240 | On/Off | 120 | 120 | 150 | 230-240 | On/Off | variable |
| 2 | Start: 80-90<br>End:120 | Start: ~188<br>End: 250 | 90-130 | On/Off | variable | 120 | 250 | 230-240 | On/Off | 120 | 120 | 100 | 230-240 | On/Off | variable |
| 3 | Start: 80-90<br>End:120 | Start: ~188<br>End: 250 | 90-130 | On/Off | variable | 120 | 250 | 230-240 | On/Off | 120 | 120 | 150 | 90-130 | On/Off | variable |
| 4 | Start: 80-90<br>End:120 | Start: ~188<br>End: 250 | 90-130 | On/Off | variable | 120 | 250 | 230-240 | On/Off | 120 | 120 | 100 | 90-130 | On/Off | variable |
| 5 | Start: 80-90<br>End:120 | Start: ~188<br>End: 250 | 90-130 | On/Off | variable | 120 | 250 | 175-200 | On/Off | 120 | 120 | 150 | 90-130 | On/Off | variable |
| 6 | Start: 80-90<br>End:120 | Start: ~188<br>End: 250 | 90-130 | On/Off | variable | 120 | 250 | 175-200 | On/Off | 120 | 120 | 100 | 90-130 | On/Off | variable |
| 7 | Start: 80-90<br>End:115 | Start: ~188<br>End: 250 | 90-130 | On/Off | variable | 115 | 250 | 230-240 | On/Off | 120 | 115 | 150 | 90-130 | On/Off | variable |
| 8 | Start: 80-90<br>End:115 | Start: ~188<br>End: 250 | 90-130 | On/Off | variable | 115 | 250 | 230-240 | On/Off | 120 | 115 | 100 | 90-130 | On/Off | variable |
| 9 | Start: 80-90<br>End:115 | Start: ~188<br>End: 250 | 90-130 | On/Off | variable | 115 | 250 | 175-200 | On/Off | 120 | 115 | 150 | 90-130 | On/Off | variable |
| 10 | Start: 80-90<br>End:115 | Start: ~188<br>End: 250 | 90-130 | On/Off | variable | 115 | 250 | 175-200 | On/Off | 120 | 115 | 100 | 90-130 | On/Off | variable |
| 11 | Start: 80-90<br>End:115 | Start: ~188<br>End: 250 | 90-130 | On/Off | variable | 115 | 250 | 175-240 | On/Off | 120 | 115 | 100-150 | 90-130 | On/Off | variable |
| 12 | Start: 80-90<br>End:110 | Start: ~188<br>End: 250 | 90-130 | On/Off | variable | 110 | 250 | 175-240 | On/Off | 120 | 110 | 100-150 | 90-130 | On/Off | variable |
| 13 | Start: 80-90<br>End:110-120 | Start: ~188<br>End: 250 | 90-130 | On/Off | variable | 110-120 | 250 | 175-240 | On/Off | 120 | 110-120 | 100-150 | 90-130 | On/Off | variable |
| 14 | Start: 80-90<br>Maintain: 100 for 10 min<br>End: 110-120 | Start: ~188<br>End: 250 | 90-130 | Off during the 10 min Temp Maintain | variable | 110-120 | 250 | 175-240 | Off | 120 | 110-120 | 100-150 | 90-130 | On/Off | variable |
| 15 | Start: 80-90<br>First Maintain: 100 for 5 min<br>Second Maintain: 110 for 5 min<br>End: 110-120 | Start: ~188<br>End: 250 | 90-130 | Off during each of the 5 min Temp Maintains | variable | 110-120 | 250 | 175-240 | Off | 120 | 110-120 | 100-150 | 90-130 | On/Off | variable |
| 16 | Start: 80-90<br>First Maintain: 100 for 10 min<br>Second Maintain: 110 for 10 min<br>End: 110-120 | Start: ~188<br>End: 250 | 90-130 | Off from the start of the first Temp Maintain until the start of the second Temp Maintain | variable | 110-120 | 250 | 175-240 | Off | 120 | 110-120 | 100-150 | 90-130 | On/Off | variable |
| 17 | Start: 80-90<br>First Maintain: 100 for 5-10 min<br>Optional Second Maintain: 110 for 5-10 min<br>End: 110-120 | Start: ~188<br>End: 250 | 90-130 | Off during each of the Temp Maintains | variable | 110-120 | 250 | 175-240 | Off | 90 | 110-120 | 100-150 | 90-130 | On/Off | variable |
| 18 | Start: 80-90<br>First Maintain: 100 for 5-10 min<br>Optional Second Maintain: 110 for 5-10 min<br>End: 110-120 | Start: ~188<br>End: 250 | 90-130 | Off during each of the Temp Maintains | variable | 110-120 | 250 | 175-240 | Off | 60 | 110-120 | 100-150 | 90-130 | On/Off | variable |
| 19 | Start: 80-90<br>Optional First Maintain: 100 for 5-10 min<br>Optional Second Maintain: 110 for 5-10 min<br>End: 110-120 | Start: ~188<br>End: 250 | 90-130 | Off during each of the Temp Maintains | variable | 110-120 | 250 | 175-240 | Off | 60-120 | 110-120 | 100-150 | 90-240 | On/Off | variable |

FIG. 27

80=230-240
70=175-200
40=90-130

SUPERCRITICAL FLUID MATERIAL SCOURING

CROSS-REFERENCE TO RELATED APPLICATIONS

This application claims the benefit of U.S. Provisional Applications: 1) U.S. Provisional Patent Application 62/119,015, entitled Dyeing of Spooled Material with a Supercritical Fluid, filed on Feb. 20, 2015, 2) U.S. Provisional Patent Application 62/119,010 entitled Equilibrium Dyeing of Rolled Material with a Supercritical Fluid, filed on Feb. 20, 2015, 3) U.S. Provisional Patent Application 62/135,680, entitled Supercritical Fluid Treatment Process Variable Manipulation, filed on Mar. 19, 2015, and 4) U.S. Provisional Patent Application 62/296,983, entitled Supercritical Fluid Material Scouring, filed on Feb. 18, 2016. The entireties of the aforementioned applications are incorporated by reference herein.

TECHNICAL FIELD

Scouring and cleaning of materials, such as fabric and or a yarn, with a supercritical fluid.

BACKGROUND

Traditional scouring of materials relies on a large quantity of water, which can be detrimental to the fresh water supply and also result in undesired chemicals entering into the wastewater stream. The scouring process may include unrolling a material and washing the material in a pH solution, such as an alkaline solution, to remove oligomers and oils that can detrimentally impact future processing of the material. Following a traditional water-based scour, the material may be dried and rewound for later processing. These steps all consume time and resources. Further, the material may be stored for indefinite lengths of time before a subsequent finishing operation occurs to the material. During this waiting time, foreign materials may be deposited on the material nullifying some of the previously-performed scouring.

BRIEF SUMMARY

Methods are directed to scouring a target material with a material in a supercritical fluid carbon dioxide environment. Variables of the process are manipulated in different sequences to achieve a more efficient cleaning of the target material. The variables include, time, pressure, heat, internal flow rate, and $CO_2$ transfer within a pressure vessel. In an aspect, temperature and flow rate are maintained above threshold values as pressure is decreased from an operating pressure to a transition pressure while an external pump exchanges and filters the $CO_2$. The sequencing of variable manipulation allows for an efficient scouring process that can also convert into a substantially continuous dyeing process in some aspects.

BRIEF DESCRIPTION OF THE DRAWINGS

The present invention is described in detail herein with reference to the attached drawing figures, wherein:

FIG. 27 depicts a table of exemplary operating conditions for supercritical dyeing, in accordance with aspects hereof.

DETAILED DESCRIPTION

Figure 1:
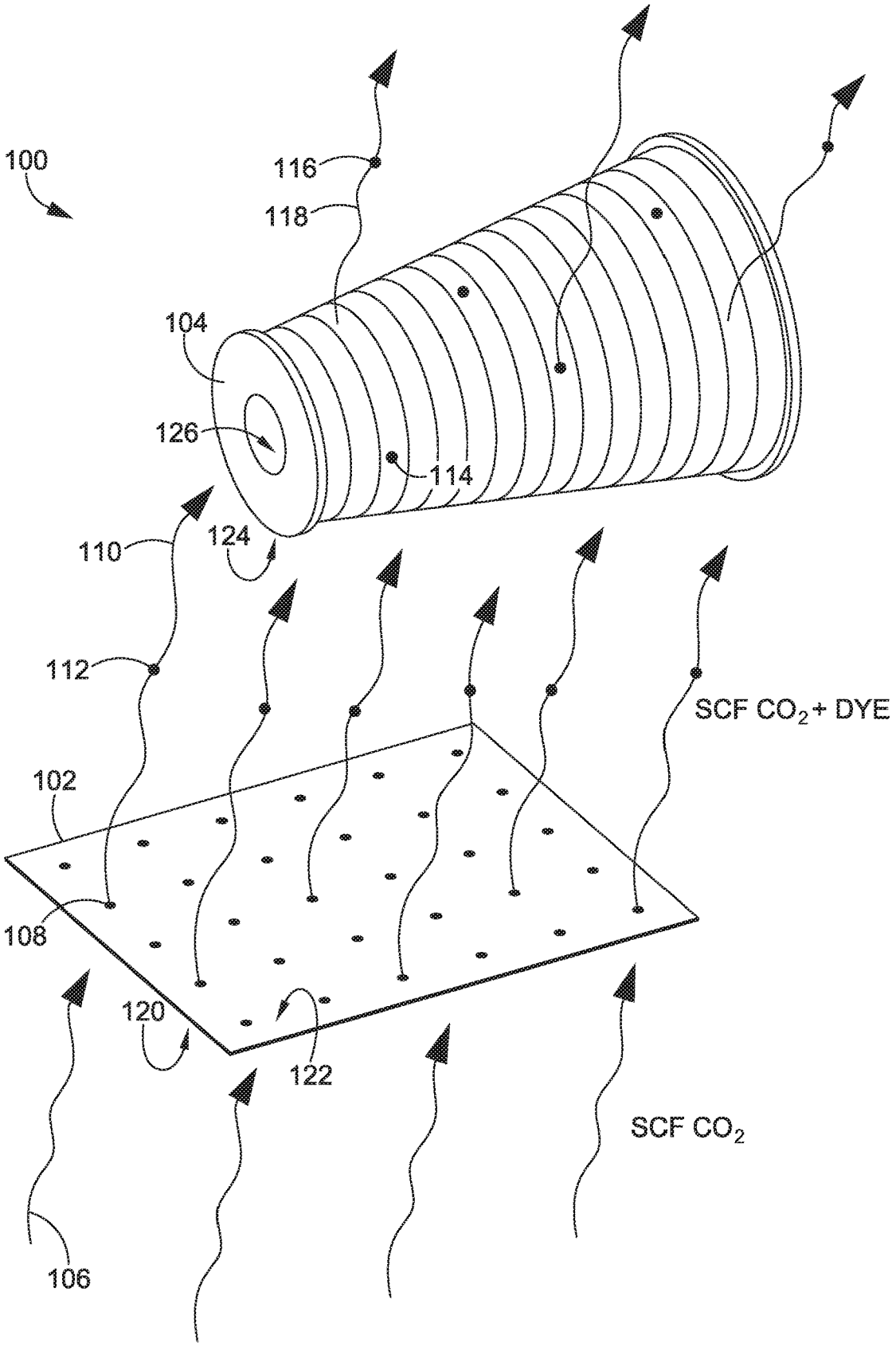
FIG. 1 is an exemplary illustration depicting the transfer of dye to a spooled material from a second material by way of a supercritical fluid, in accordance with an aspect hereof.

Methods are directed to scouring a target material in a supercritical fluid ("SCF") carbon dioxide ("$CO_2$") environment. Variables of the process are manipulated in different sequences to achieve an efficient scouring of the target material. The variables include, time, pressure, heat, internal flow rate within a pressure vessel, and exchange/filtering of the working substance (e.g., $CO_2$).

Aspects include method of scouring a target material. The method includes positioning a target material in a pressure vessel and introducing carbon dioxide within the pressure vessel. The method further includes increasing an internal temperature of the pressure vessel to an operating temperature and increasing an internal $CO_2$ flow rate to a non-zero rate. The method also includes increasing a pressure within the pressure vessel to an operating pressure such that the $CO_2$ is at a SCF state when at the operating temperature and the operating pressure. Using SCF $CO_2$, the scoured elements are then removed from the target material. The pressure is then reduced from the operating pressure to a transition pressure while maintaining the temperature above a threshold temperature.

In another exemplary aspect, a method of scouring and finishing a target material with SCF is contemplated. The method includes positioning a target material in a pressure vessel and initiating a pressurization cycle of a scouring process in the pressure vessel. The method continues with initiating a scouring cycle of the scouring process in the pressure vessel. The scouring cycle may have a distinct rinsing cycle or an integrated rinsing cycle, in some aspects. The method also includes initiating a depressurization cycle of the scouring process in the pressure vessel. The method continues with introducing a finishing material into the pressure vessel and initiating a pressurization cycle of a dyeing process in the pressure vessel. The method also includes initiating a dyeing cycle of the dyeing process in the pressure vessel and initiating a depressurization cycle of the dyeing process in the pressure vessel.

The following disclosure provides details on dyeing/finishing of the target material as well as scouring the target material. Concepts taught in relation to dyeing/finishing are contemplated as being applicable, in some aspects, to the methods of scouring a target material with a SCF.

Materials, such as textiles (i.e. fabric, cloth) and/or spooled materials (e.g., yarn, thread, filament, cord, string, ribbon, and other continuous length materials), may be treated with a material finish to achieve a desired result, such as water resistance, abrasion resistance, breathability, and/or appearance (e.g., coloration). For example, the materials may be dyed to achieve a desired look. Dye is a substance used to add or change a color of a material, such as a textile, in an exemplary aspect. In an additional aspect, dye is a material finish, such as a durable water repellent finish (i.e., hydrophobic), fire resistant finish, anti-microbial finish, hydrophilic finish, and the like. In further aspects, dye is not a fabric finish other than a colorant and in other aspects dye is a fabric finish other than a colorant, when specifically indicated as such. Therefore, as used herein, a dye or the processes of dyeing is not limited to color or the process of coloring. Instead dye or dyeing includes a material finish or the process of finishing the target material. Dye materials, which are also referred to as dyestuff, may be particles of coloration that are natural or synthetic in formation. Traditionally, dye, together with a number of processing chemistries, are applied to a material through an aqueous solution, which may have varied acidic or basic (e.g., pH) conditions to enhance and/or achieve the dyeing process. However, this traditional dye process consumes large quantities of water and potentially discharges chemicals from the dyeing process in to the wastewater stream.

Figure 9:
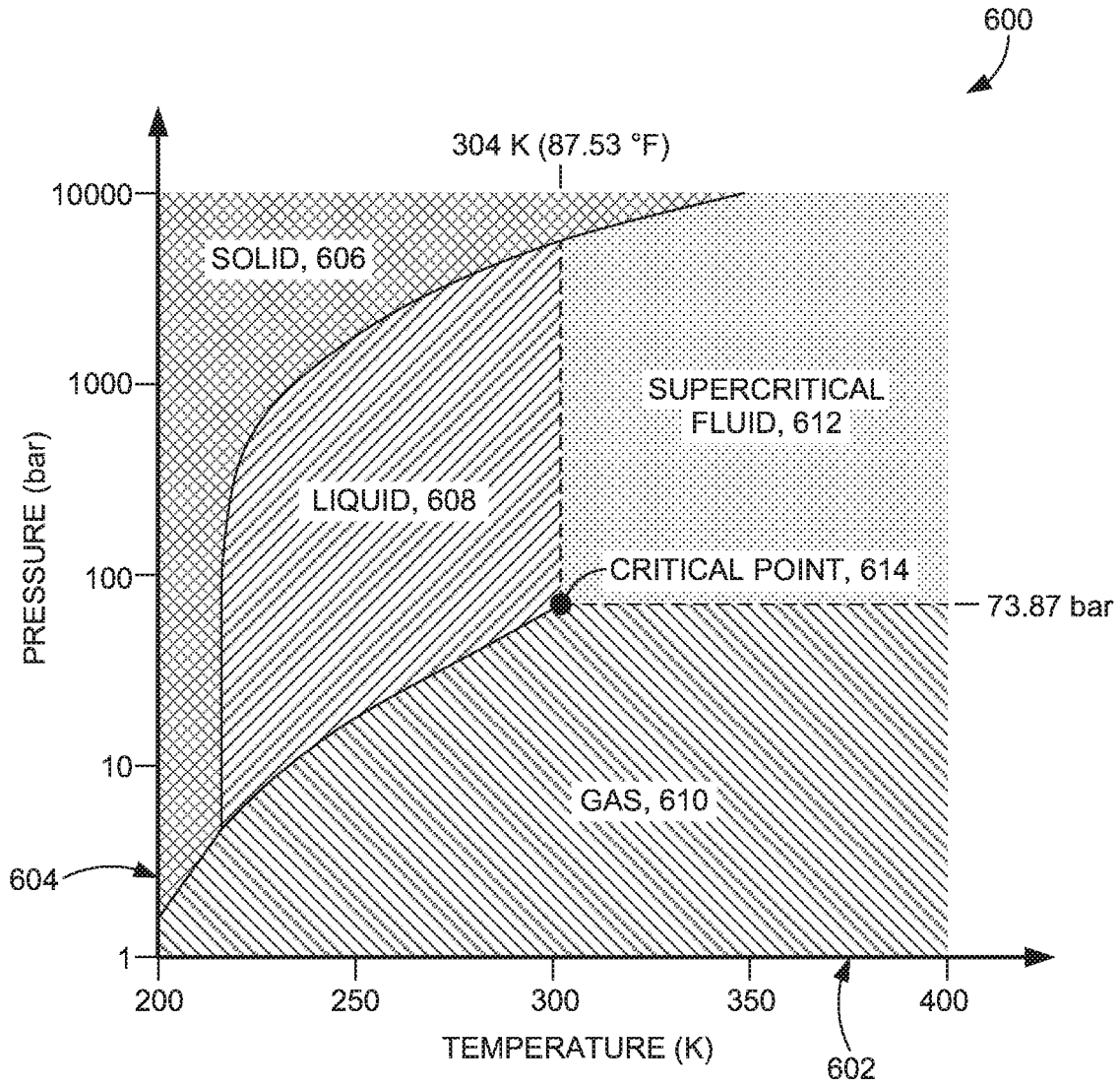
FIG. 9 depicts a temperature and pressure phase diagram for carbon dioxide, in accordance with an aspect hereof.

Supercritical fluid ("SCF") carbon dioxide ("$CO_2$") is a fluid state of $CO_2$ that exhibits characteristics of both a gas and a liquid. SCF $CO_2$ has liquid-like densities and gas-like low viscosities and diffusion properties. The liquid-like densities of SCF allows for SCF $CO_2$ to dissolve dye material and chemistries for eventual dyeing of a material. The gas-like viscosity and diffusion properties can allow for a faster dyeing time and faster dispersion of dye material than in a traditional water-based process, for example. FIG. 9 provides a $CO_2$ pressure 604 and temperature 602 diagram that highlights the various phases of $CO_2$, such as a solid phase 606, a liquid phase 608, a gas phase 610, and a SCF phase 612. As illustrated, $CO_2$ has a critical point 614 at about 304 degrees Kelvin (i.e. 87.53 degrees Fahrenheit, 30.85 Celsius) and 73.87 bar (i.e. 72.9 atm). Generally, at temperatures and pressures above the critical point 614, $CO_2$ is in a SCF phase.

While examples herein refer specifically to SCF $CO_2$, it is contemplated that additional or alternative compositions may be used at or near a supercritical fluid phase. Therefore, while specific reference will be made to $CO_2$ as a composition herein, it is contemplated that aspects hereof are applicable with alternative compositions and appropriate critical point values for achieving a SCF phase.

The use of SCF $CO_2$ in a dyeing process may be achieved using commercially available machines, such as a machine offered by DyeCoo Textile Systems BV of the Netherlands ("DyeCoo"). A process implemented in a traditional system includes placing an undyed material that is intended to be dyed into a vessel capable of being pressurized and heated to achieve a SCF $CO_2$. A powdered dyestuff that is not integrally associated with a textile (e.g., loose powder) is maintained in a holding container. The dyestuff holding container is placed in the vessel with the undyed material such that the dyestuff is not contacting the undyed material prior to pressurizing the vessel. For example, the holding container physically separates the dyestuff from the undyed material. The vessel is pressurized and thermal energy is applied to bring $CO_2$ to a SCF (or near SCF) state, which causes the dyestuff to solubilize in the SCF $CO_2$. In a traditional system, the dyestuff is transported from the holding container to the undyed material by the SCF $CO_2$. The dyestuff is then diffused through the undyed material causing a dyeing of the undyed material until the SCF $CO_2$ phase is ceased.

Aspects herein relate to a concept of dye equilibrium as a manner of controlling a dye profile that results on a material. For example, if a first material has a dye profile that may be described as a red coloration and a second material has a dye profile that may be described by an absence of coloration (e.g., bleached or white), the concept of equilibrium dyeing with SCF $CO_2$ results in an attempted equalization between the two dye profiles such that at least some of the dyestuff forming the first dye profile is transferred from the first material to the second material. An application of this process includes using a sacrificial material having dyestuff contained thereon and/or therein (e.g., a dyed first material) that is used as a carrier for applying a specific dyestuff to a second material that is intended to be dyed by the dyestuff of the sacrificial material. For example, a first material and a second material may each have different resulting dye profiles from each other after a SCF $CO_2$ process is applied while also having a different dye profile from their respective initial dye profiles (e.g., first dye profile and second dye profile). This lack of true equilibrium may be desired. For example, if the first material is the sacrificial material that is merely intended to be a dye carrier, the process may be carried out until the second material achieves a desired dye profile, regardless of the resulting dye profile for the first material, in an exemplary aspect.

Another example of a dyeing process using SCF $CO_2$ may be referred to as an additive dyeing process. An example to aid in illustrating the additive dyeing process includes the first material having a dye profile that exhibits red coloration and the second material having a second dye profile that exhibits blue coloration. The SCF $CO_2$ is effective to result in dye profiles on the first material and the second material (and/or a third material) that exhibit purple coloration (e.g., red+blue=purple).

As before, it is contemplated that the first and second materials may achieve a common dye profile when the equilibrium dye process is allowed to mature. In additional aspects, it is contemplated that the first material and the second material result in different dye profiles from each other, but the resulting dye profiles are also different from the initial dye profile for each respective material. Further, it is contemplated that the first material may be a sacrificial dye transfer material while the second material is the material for which a target dye profile is desired. Therefore, the SCF $CO_2$ dye process may be performed until the second material achieves the desired dye profile regardless of the resulting dye profile of the first material. Further yet, it is contemplated that a first sacrificial material dye carrier having a first dye profile (e.g., red) and a second sacrificial dye carrier having a second dye profile (e.g., blue) may be placed into the system to cause a desired dye profile (e.g., purple) on a third material, in an exemplary aspect. As can be appreciated, any combination and number of materials, dye profiles, and other contemplated variables (e.g., time, SCF $CO_2$ volume, temperature, pressure, material composition, and material type) may be altered to achieve results contemplated herein.

Aspects herein contemplate dyeing (e.g., treating with material finishes) of one or more materials using SCF $CO_2$. The concept of two or more materials used in conjunction with each other is contemplated in aspects hereof. Further, the use of one or more materials having integral dyestuff that are not intended for traditional post-processing utilization (e.g., apparel manufacturing, shoe manufacturing, carpeting, upholstery), which may be referred to as sacrificial material or as dye carriers, are contemplated as being introduced in the system. Further, it is contemplated that any dye profile may be used. Any combination of dye profiles may be used in conjunction with one another to achieve any desired dye profile in one or more materials. Additional features and process variable for disclosed methods and systems will be provided herein.

Achieving a desired dye profile on a material may be influenced by a number of factors. For example, if there are 50 kg of a first material (e.g., spooled or rolled material) and 100 kg of a second material, the resulting dye profile per weight of the first material may be expressed as ⅓ the original color/intensity/saturation of the first dye profile when the second material original dye profile is absent of dye. Alternatively, with the same proportions of material but the original second dye profile having a comparable saturation/intensity as the first dye profile, but with a different coloration, the first dye profile may be expressed as $\frac{1}{3}X+\frac{1}{3}Y$ where X is the original first dye profile and Y is the original second dye profile (i.e. weight of the first material/weight of all materials). From the second material perspective using the two previous examples, the resulting dye profiles may be $(\frac{2}{3}X)/2$ for the first example and $(\frac{2}{3}X+\frac{2}{3}Y)/2$ (i.e. [weight of the first material/weight of all materials] *[weight of the first material/weight of the second material]). The previous examples are for illustration purposes only as it is contemplated that a number of additional factors are also relevant, such as yardage per kilogram, material composition, dye process length, temperature, pressure, time, material porosity, material density, winding tension of the material, and other variables that may be represented by an empirical value(s). However, the preceding is intended to provide an understanding of the intended equilibrium dyeing process to supplement the aspects provided herein. As such, the provided examples and values are not limiting but merely exemplary in nature.

Referring now to FIG. 1, an exemplary illustration depicting the transfer of dye 100 from a second material 102 to a spooled material 104 by way of a SCF $CO_2$, in accordance with aspects hereof. A material introduced to the dyeing process with SCF $CO_2$ may be any material, such as compositions (e.g., cotton, wool, silk, polyester, and/or nylon), substrates (e.g., fabrics and/or yarns), products (e.g., footwear and/or garments), and the like. In an exemplary aspect, the second material 102 is a polyester material having a first dye profile comprised of dye material 108. A dye profile is a dye characteristic or material finish characteristic, which may be defined by a color, intensity, shade, dyestuff type(s), and/or chemical composition. It is contemplated that a material for which there is no substantial dyestuff (e.g., no unnaturally occurring coloration from a dyeing method or other material finishes applied thereon) also has a dye profile that describes the absence of dye. Therefore, regardless of the coloration, finish, or dye associated with a material, all materials have a dye profile. Stated differently, all materials, irrespective of color/material finish processes performed (or not performed), has a dye profile. For example, all materials have a starting coloration regardless of if a dye process has been performed on the material.

The second material 102 has a first surface 120, a second surface 122, and a plurality of dye material 108. The dye material 108, which may be a composition/mixture of dyestuffs, is depicted as granular elements for discussion purposes; however, in actuality the dye material 108 may not be individually identifiable at the macro level from the underlying substrate of a material. Also, as will be discussed hereinafter, it is contemplated that the dyestuff may be integral with the material. Integral dyestuff is dyestuff that is chemically or physically bonded with the material. Integral dyestuff is compared to non-integral dyestuff, which is dyestuff that is not chemically or physically coupled with a material. An example of a non-integral dyestuff includes dry powdered dyestuff sprinkled and brushed on the surface of a material such that the dyestuff is removed with minimal mechanical effort.

At FIG. 1, the SCF $CO_2$ 106 is graphically illustrated as arrows for discussion purposes only. In actuality, the SCF $CO_2$ is not separately identifiable at a macro level even though it is depicted as such in FIG. 1. Further yet, a dye material 112 and 116 is depicted as being transferred by SCF $CO_2$ 110 and 118 respectively, but as indicated, this illustration is for discussion purposes and not a scaled representation of actuality.

With respect to FIG. 1, the SCF $CO_2$ 106 is introduced to the second material 102. The initial introduction of SCF $CO_2$ 106 is without dye material associated (e.g., without dyestuff dissolved therein). The SCF $CO_2$ 106 passes through the second material 102 from the first side 120 to the second side 122, in an exemplary aspect. As the SCF $CO_2$ 106 passes through the second material 102, dye material 108 (e.g., dyestuff) for the second material 102 becomes associated (e.g., dissolved) with the SCF $CO_2$, which is depicted as the dye material 112 in connection with SCF $CO_2$ 110. The second material 102 is depicted as having a first dye profile, which may be caused by the dye material 108 of the second material 102. Alternatively, it is contemplated that the initial introduction (or at any time) of SCF $CO_2$ may transport dyestuff from a source (e.g., holding container) to the second material 102 to augment the dye profile of the second material while also augmenting the dye profile of the spooled material 104 with the dyestuff of the source and the second material 102, in an exemplary aspect.

The spooled material may be a continuous yarn-like material that is effective for use in weaving, knitting, braiding, crocheting, sewing, embroidering, and the like. Non-limiting examples of spooled material include yarn, thread, rope, ribbon, filament, and cord. It is contemplated that the spooled material may be wound about a spool (e.g., conical or cylindrical) or the spooled material may be wound about itself without a secondary support structure helping form the resulting wound shape. The spooled material may be organic or synthetic in nature. The spooled material may be a plurality of individual collections of material or a singular collection of material.

In FIG. 1, the spooled material 104 has a first surface 124 and a second surface 126. The spooled material also is depicted as having a second dye profile with dye material 114. The dye material 114 may be dyestuff transferred by the SCF $CO_2$ having passed through the second material 102 and/or it is dyestuff associated with the spooled material 104 in a previous operation, in an exemplary aspect.

As such, FIG. 1 depicts a SCF $CO_2$ dyeing operation in which SCF $CO_2$ passes through the second material 102 from the first side 120 to the second side 122 while transferring (e.g., such as dissolving dyestuff in the SCF $CO_2$) dyestuff from the second material, as depicted by dye material 112 being transported by the SCF $CO_2$ 110. The spooled material 104 receives the SCF $CO_2$ (e.g., 110) on the first side 124. The SCF $CO_2$ passes through the spooled material 104 while allowing dye material (e.g., 114) to dye the spooled material 104. The dye material dyeing the spooled material 104 may be dye material from the second material 102, in an exemplary aspect. It is further contemplated that the dye material dyeing the spooled material 104 may be dye material from additional material layers or sources. Further, the SCF $CO_2$ may pass through the spooled material 104 (e.g., SCF $CO_2$ 118) while transferring dye material (e.g., 116) therewith. This dye material 116 may be deposited with another material layer and/or the second material 102 layer. As can be appreciated, this may be a cycle in which equilibrium of dye material is achieved on the different material layers as the SCF $CO_2$ repeatedly passes through the material layers. Eventually, it is contemplated the dye material 108, 112, 114, and 116 may be indistinguishable and/or result in an indistinguishable dye profile among the different materials, in an exemplary aspect. Stated differently, as each of the various dyestuff has a different solubility within the SCF, the flow of the SCF through the various materials picks up and deposits the dyestuff creating a homogeneous blend of the dyestuff at a macro level (e.g., to the human eye). This cycle may continue until the SCF is removed from the cycle process, such as at a state change of the $CO_2$ from a SCF state.

FIG. 1 is exemplary in nature and is intended to serve as an illustration of the process without being depicted at scale. Therefore, it is understood that in actuality the dyestuff (i.e., dye material), the materials, and the SCF $CO_2$ may instead be seemingly indistinguishable to a common observer at a macro scale without special equipment, in an exemplary aspect.

Figure 2:
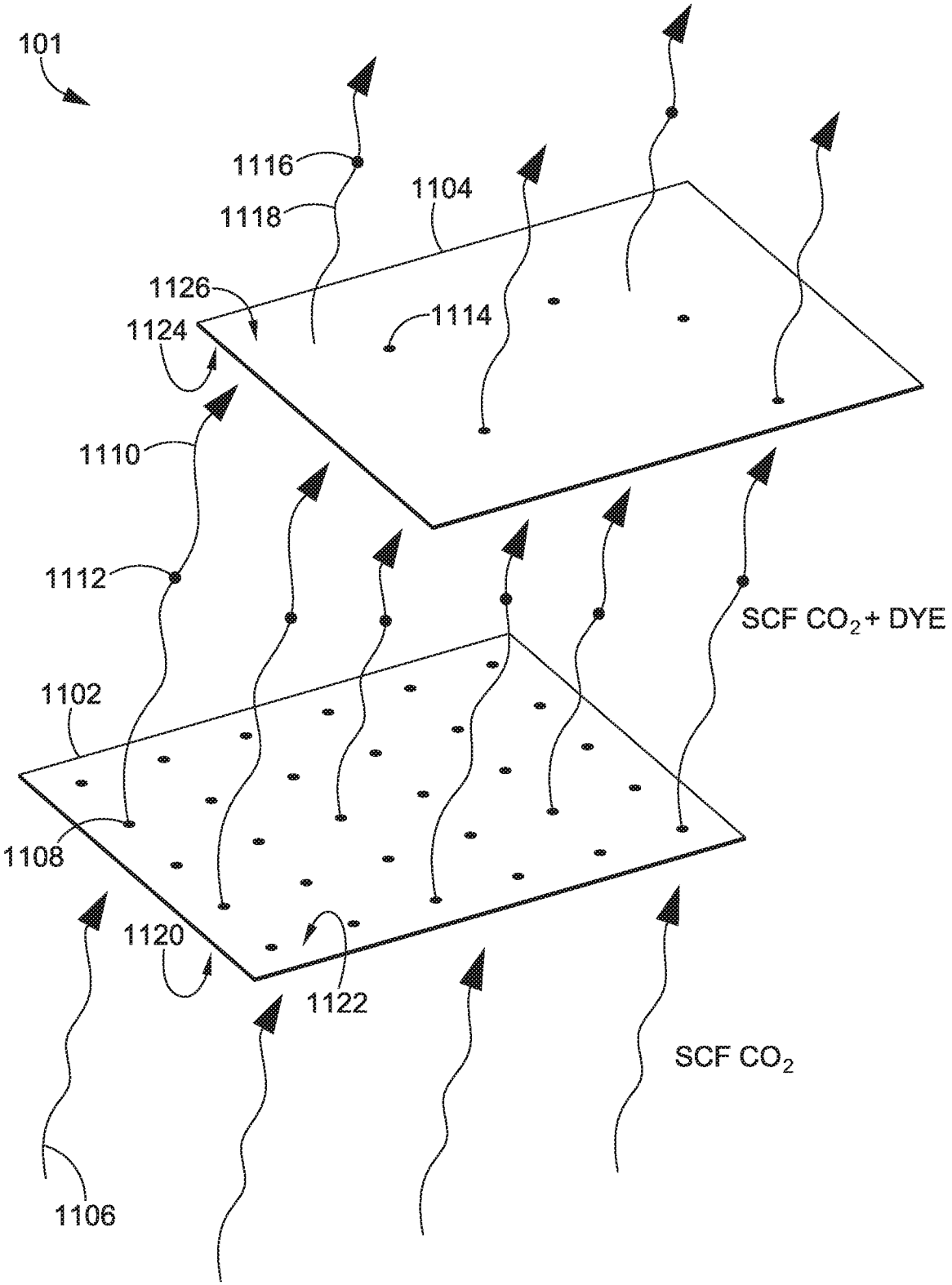
FIG. 2 is an exemplary illustration depicting the transfer of dye from a first material to a second material by way of a supercritical fluid, in accordance with an aspect hereof.

Referring now to FIG. 2, an exemplary illustration depicting the transfer of dye 101 from a first material 1102 to a second material 1104 by way of a SCF $CO_2$, in accordance with aspects hereof. A material introduced to the equilibrium dyeing with SCF $CO_2$ may be any material, such as compositions (e.g., cotton, wool, silk, polyester, and/or nylon), substrates (e.g., fabrics and/or yarns), products (e/.g., footwear and/or garments), and the like. In an exemplary aspect, the first material 1102 is a polyester material having a first dye profile comprised of dye material 1108. The first material 1102 has a first surface 1120, a second surface 1122, and a plurality of dye material 1108. The dye material 1108, which may be a composition/mixture of dyestuffs, is depicted as granular elements for discussion purposes; however, in actuality the dye material 1108 may not be individually identifiable at the macro level from the underlying substrate of a material. Also, as will be discussed hereinafter, it is contemplated that the dyestuff is integral with the material. An integral dyestuff is dyestuff that is chemically or physically bonded with the material. Integral dyestuff is compared to non-integral dyestuff, which is dyestuff that is not chemically or physically coupled with a material. An example of a non-integral dyestuff includes dry powdered dyestuff sprinkled and brushed on the surface of a material such that the dyestuff is removed with minimal mechanical effort.

At FIG. 2, the SCF $CO_2$ 1106 is graphically illustrated as arrows for discussion purposes only. In actuality, the SCF $CO_2$ is not separately identifiable at a macro level as depicted in FIG. 2. Further yet, a dye material 1112 and 1116 is depicted as being transferred by SCF $CO_2$ 1110 and 1116 respectively, but as indicated, this illustration is for discussion purposes and not a scaled representation of actuality.

With respect to FIG. 2, the SCF $CO_2$ 1106 is introduced to the first material 1102. The initial introduction of SCF $CO_2$ 1106 is without dye material associated (e.g., without dyestuff dissolved therein). The SCF $CO_2$ 1106 passes through the first material 1102 from the first side 1120 to the second side 1122, in an exemplary aspect. As the SCF $CO_2$ 1106 passes through the first material 1102, dye material 1108 (e.g., dyestuff) for the first material 1102 becomes associated (e.g., dissolved) with the SCF $CO_2$, which is depicted as the dye material 1112 in connection with SCF $CO_2$ 1110. The first material 1102 is depicted as having a first dye profile, which may be caused by the dye material 1108 of the first material 1102. Alternatively, it is contemplated that the initial introduction (or at any time) of SCF $CO_2$ may transport dyestuff from a source (e.g., holding container) to the first material 1102 to augment the dye profile of the first material while also augmenting the dye profile of the second material 1104 with the dyestuff of the source and the first material 1102, in an exemplary aspect.

The second material 1104 has a first surface 1124 and a second surface 1126. The second material also is depicted as having a second dye profile with dye material 1114. The dye material 1114 may be dyestuff transferred by the SCF $CO_2$ having passed through the first material 1102 and/or it is dyestuff associated with the second material 1104 in a previous operation, in an exemplary aspect.

As such, FIG. 2 depicts a SCF $CO_2$ dyeing operation in which SCF $CO_2$ passes through the first material 1102 from the first side 1120 to the second side 1122 while transferring (e.g., such as dissolving dyestuff in the SCF $CO_2$) dyestuff from the first material, as depicted by dye material 1112 being transported by the SCF $CO_2$ 1110. The second material 1104 receives the SCF $CO_2$ (e.g., 1110) on the first side 1124. The SCF $CO_2$ passes through the second material 1104 while allowing dye material (e.g., 1114) to dye the second material 1104. The dye material dyeing the second material 1104 may be dye material from the first material 1102, in an exemplary aspect. It is further contemplated that the dye material dyeing the second material 1104 may be dye material from additional material layers or sources. Further, the SCF $CO_2$ may pass through the second material 1104 (e.g., SCF $CO_2$ 1118) while transferring dye material (e.g., 1116) therewith. This dye material 1116 may be deposited with another material layer and/or the first material 1102 layer. As can be appreciated, this may be a cycle in which equilibrium of dye material is achieved on the different material layers as the SCF $CO_2$ repeatedly passes through the material layers. Eventually, it is contemplated the dye material 1108, 1112, 1114, and 1116 may be indistinguishable and/or result in an indistinguishable dye profile among the different materials, in an exemplary aspect. Stated differently, as each of the various dyestuff has a different solubility within the SCF, the flow of the SCF through the various materials picks up and deposits the dyestuff creating a homogeneous blend of the dyestuff at a macro level (e.g., to the human eye). This cycle may continue until the SCF is removed from the cycle process, such as at a state change of the $CO_2$ from a SCF state.

FIG. 2 is exemplary in nature and is intended to serve as an illustration of the process without being depicted at scale. Therefore, it is understood that in actuality the dyestuff (i.e., dye material), the materials, and the SCF $CO_2$ may instead be seemingly indistinguishable to a common observer at a macro scale without special equipment, in an exemplary aspect.

Further, as will be provided herein, aspects contemplate a dyestuff integral to a material. A dyestuff is integral to a material when it is physically or chemically bonded with the material, in an example. In another example, dyestuff is integral to the material when the dyestuff is homogenized on the material. The homogenization of dyestuff is in contrast to a material on which dyestuff is applied in a non-uniform manner, such as if a dyestuff is merely sprinkled or otherwise loosely applied to the material. An example of integral dyestuff with a material is when dyestuff is embedded and maintained within the fibers of a material, such as when dyestuff perfuses a material.

The term "perfuse," as used herein, is to coat, permeate, and/or diffuse surface finishes, such as dyestuff over and/or throughout a material. The perfusing of a material with dyestuff occurs in a pressure vessel, such as an autoclave, as is known in the art. Further, the SCF and dyestuff dissolved in the SCF may be circulated within the pressure vessel with a circulation pump, as is also known in the art. The circulation of SCF within the pressure vessel by a pump causes the SCF to pass through and around a material within the pressure vessel to cause dissolved dyestuff to perfuse the material. Stated differently, when a target material is perfused with SCF $CO_2$ having dyestuff (e.g., finish material) dissolved therein, the dyestuff is deposited on one or more portions of the target material. For example, a polyester material, when exposed to the conditions suitable for forming SCF $CO_2$, may "open" up allowing for portions of the dyestuff to remain embedded with the polyester fibers forming the polyester material. Therefore, adjusting the heat, pressure, circulation flow, and time affects the SCF, the dyestuff, and the target material. The variables all taken in combination, when the SCF $CO_2$ perfuses the target material, a deposit of dyestuff throughout the material may occur.

Figure 3:
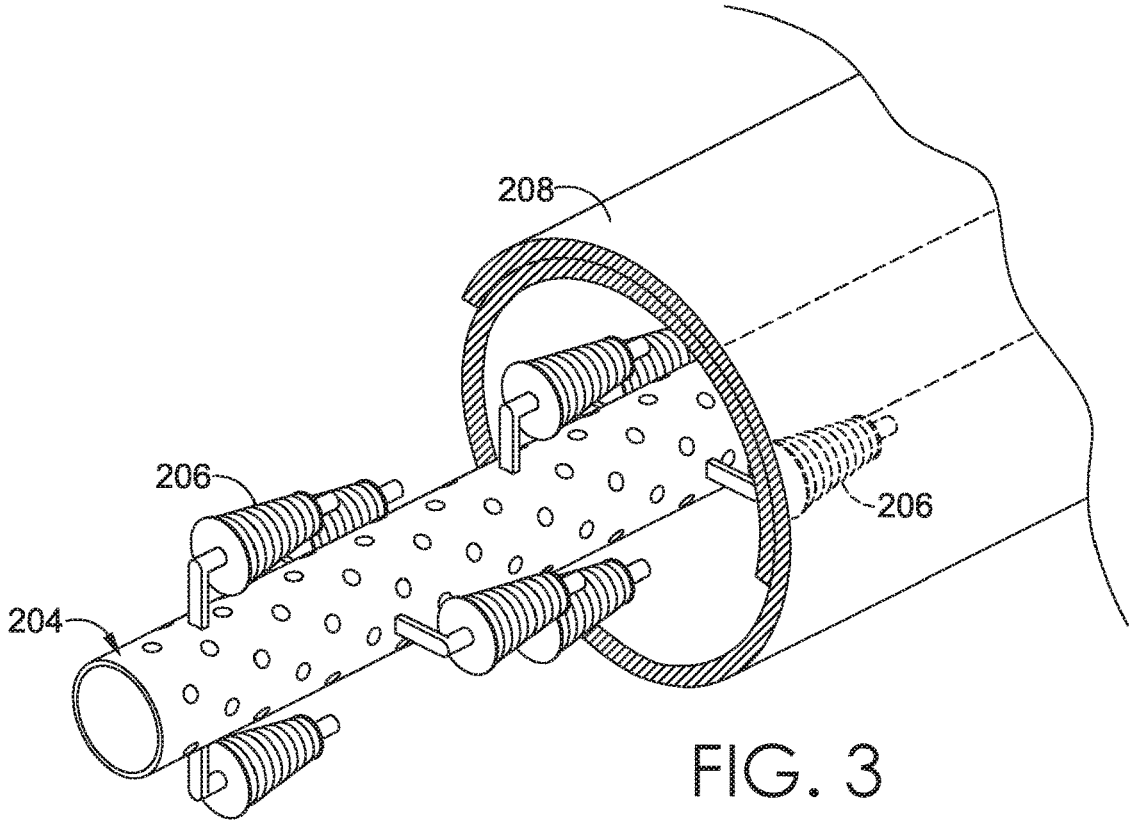
FIG. 3 depicts exemplary materials in a contacting arrangement for the perfusing of one of more materials finishes, in accordance with an aspect hereof.

FIG. 3 depicts a material holding element 204, supporting a plurality of spooled materials 206 and a second material 208, in accordance with aspects hereof. The plurality of spooled materials 206, in this example has a first dye profile. The first dye profile may be a profile that is lacking coloration or other surface finishes other than the natural state of the material, in an exemplary aspect. The plurality of spooled materials 206 may be a target material, a material intended for use in a commercial good, such as apparel or footwear. The second material 208 may be a sacrificial material having integral dyestuff. For example, the second material 208 may be a previously dyed (or otherwise treated) material.

In the example depicted in FIG. 3, which is in contrast to FIG. 4 to be discussed hereinafter, the second material 208 is in physical contact with the spooled material 206. In this example, a surface of the second material 208 is contacting a surface of the spooled material 206. The physical contact or close proximity provided by the contact, in an exemplary aspect, provides for an efficient transfer of dyestuff from the second material 208 to the spooled material 206 in the presence of SCF. Further, physical contact of the materials exposed to a SCF for dyeing purposes allows for, in an exemplary aspect, efficient use of space in a pressure vessel so that dimensions (e.g., roll length of a material) of a material may be maximized.

As depicted in FIG. 3 for exemplary purposes, the second material 208 is significantly smaller in volume than the spooled material 206. In this example, the spooled material 206 is the target material; therefore, a maximization of volume for target material may be desired. As some pressure vessels have limited volume, a portion of that limited volume consumed by a sacrificial material limits the volume useable by a target material. As such, in an exemplary aspect, a sacrificial (or plurality of sacrificial materials) are of a smaller volume (e.g., yardage) than a target material when positioned in a common pressure vessel. Further, while an exemplary material holding element 204 is depicted, it is contemplated that alternative configurations of a holding element may be implemented.

Figure 4:
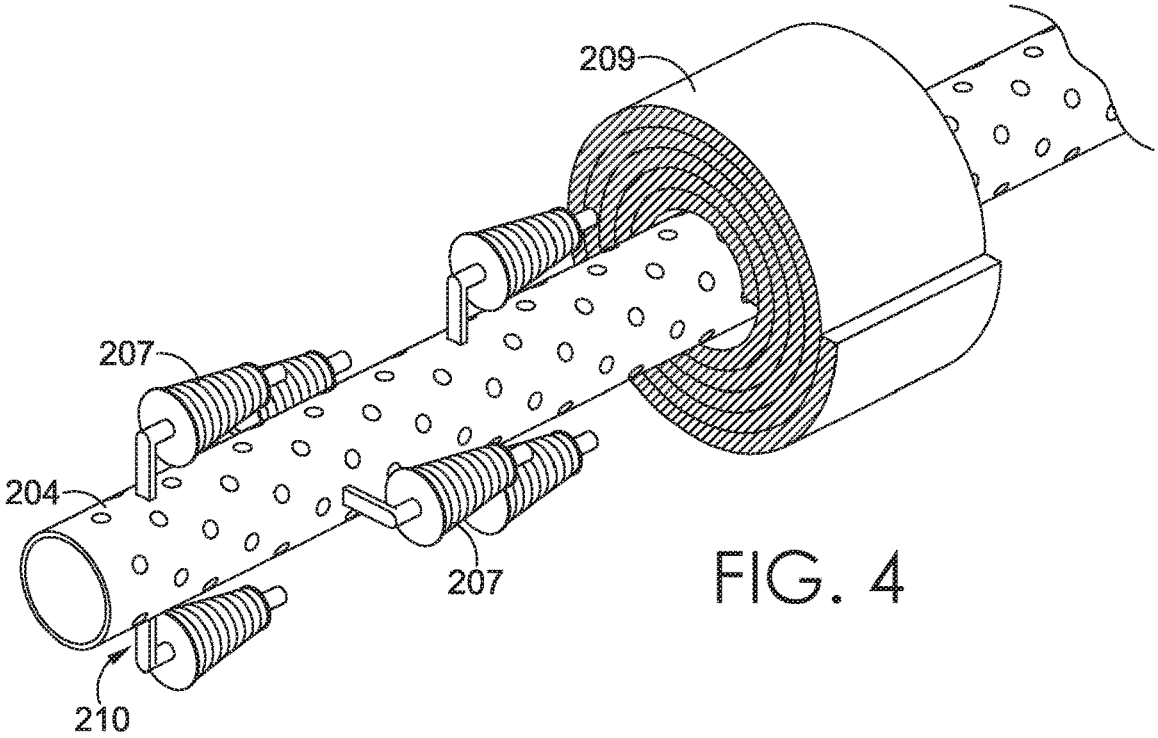
FIG. 4 depicts exemplary materials in a non-contacting arrangement for the perfusing of one of more materials finishes, in accordance with an aspect hereof.

FIG. 4 depicts a material holding element, also supporting a spooled material 207 and a second material 209, in accordance with aspects hereof. While the spooled material 207 and the second material 209 are depicted on a common holding element, it is contemplated that physically separate holding elements may be used in alternative exemplary aspects. The spooled material 207 has a first dye profile and the second material 209 has a second dye profile. In particular, at least one of the spooled material 207 or the second material 209 has an integral dyestuff. To the contrary of FIG. 3 in which close proximity or physical contact is depicted with the multiple materials, the materials of FIG. 4 are not in direct contact with one another. The lack of physical contact, in an exemplary aspect, allows for the efficient substitution and manipulation of at least one material without significant physical manipulation of the other material(s). For example, if the second material 209 has a dye profile having a first coloration is processed with the spooled material 207 such that at least some of the dyestuff of the second material perfuses the spooled material 207 in a SCF dyeing process, the second material 209 may be removed and substituted with a third material having a different dye profile (e.g., a material treatment such as DWR) that is preferred to be perfused to the spooled material 207 subsequent to the dyestuff of the second material 209. Stated differently, the physical relationship depicted and generally discussed with FIG. 4 may be efficient in manufacturing and processing as individual manipulation of the materials may be accomplished.

While the spooled material 207 and the second material 209 are depicted on a common material holding element 204, it is contemplated that the spooled material 207 is on a first holding element and the second material 209 is on a second holding element that is different from the first holding element, in an exemplary aspect.

While only two materials are depicted in FIGS. 3 and 4, it is understood that any number of materials may be simultaneously exposed to a SCF (or near SCF). For example, it is contemplated that two or more sacrificial materials having integral dyestuff are placed within a common pressure vessel with a target material intended to be perfused with the dyestuff of the sacrificial materials. Further, it is contemplated that a quantity of the materials is not limited to those proportions depicted in FIG. 3 or 4. For example, it is contemplated that a target material may be of much greater volume than a sacrificial material. Further, it is contemplated that a volume of sacrificial material may be adjusted to accomplish a desired dye profile of the target material(s). For example, depending on the dye profile of the sacrificial material (e.g., concentration, coloration, etc.) and the desired dye profile for target material in addition to the volume of the target material, the amount of sacrificial material may be adjusted to achieve a desired SCF dyeing result. Similarly, it is contemplated that the dye profile of the second material (or first material) is adjusted based on a desired dye profile and/or a volume of material included in the dyeing process.

Figure 5:
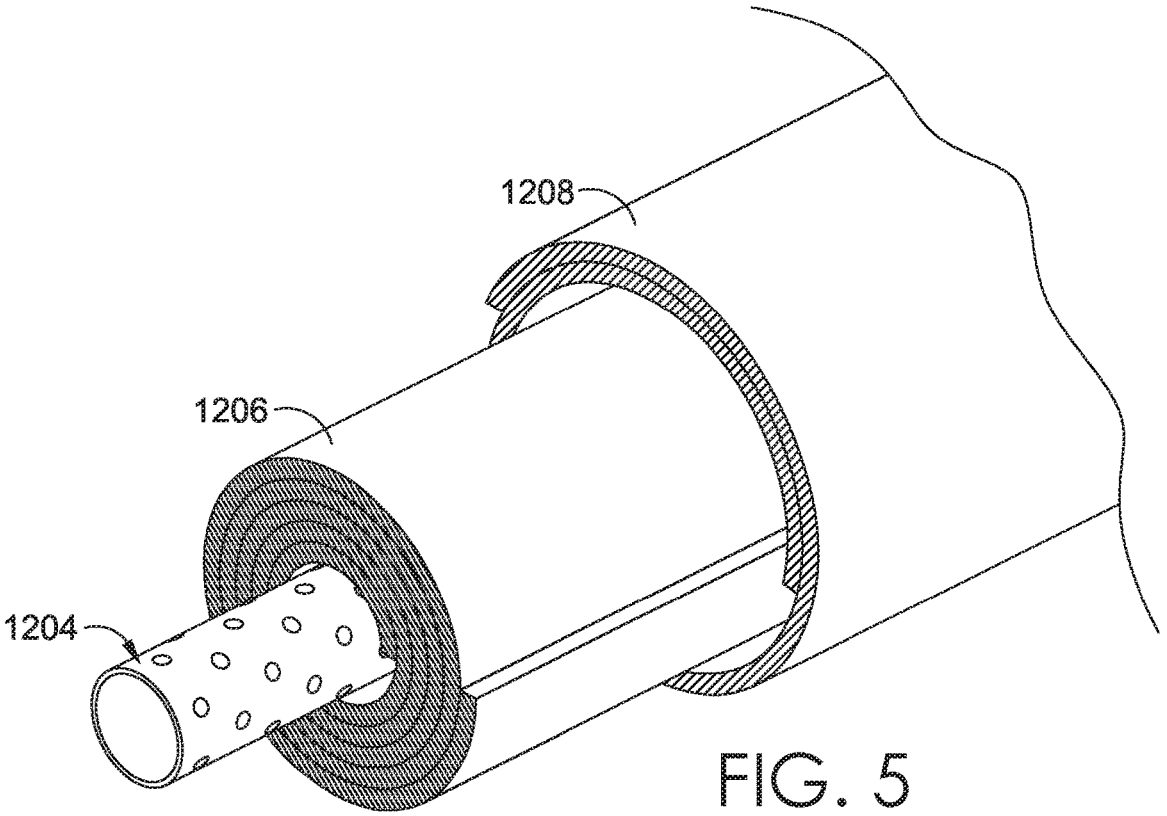
FIG. 5 depicts exemplary materials in a contacting arrangement, in accordance with an aspect hereof.

FIG. 5 depicts a material holding element, such as a beam 1204, supporting a first material 1206 and a second material 1208, in accordance with aspects hereof. The first material 1206, in this example has a first dye profile. The first dye profile may be a profile that is lacking coloration other than the natural state of the material, in an exemplary aspect. The first material 1206 may be a target material, a material intended for use in a commercial good, such as apparel or footwear. The second material 1208 may be a sacrificial material having integral dyestuff. For example, the second material 1208 may be a previously dyed (or other treatment) material.

In the example depicted in FIG. 5, which is in contrast to FIG. 6 to be discussed hereinafter, the second material 1208 is in physical contact with the first material 1206. In this example, a surface of the second material 1208 is contacting a surface of the first material 1206. The physical contact or close proximity provided by the contact, in an exemplary aspect, provides for an efficient transfer of dyestuff from the second material 1208 to the first material 1206 in the presence of SCF. Further, physical contact of the materials exposed to a SCF for dyeing purposes allows for, in an exemplary aspect, efficient use of space in a pressure vessel so that dimensions (e.g., roll length of a material) of a material may be maximized.

As depicted in FIG. 5 for exemplary purposes, the second material 1208 is significantly smaller in volume than the first material 1206. In this example, the first material 1206 is the target material; therefore, a maximization of volume for target material may be desired. As some pressure vessels have limited volume, a portion of that limited volume consumed by a sacrificial material limits the volume useable by a target material. As such, in an exemplary aspect, a sacrificial (or plurality of sacrificial materials) are of a smaller volume (e.g., yardage) than a target material when positioned in a common pressure vessel. While the second material 1208 is depicted on an outward location of the beam 1204 relative to the first material 1206, it is contemplated that the sacrificial material may be positioned more inwardly on the beam 1204 relative to a target material. Further, while an exemplary beam 1204 is depicted, it is contemplated that alternative configurations of a holding element may be implemented.

Figure 6:
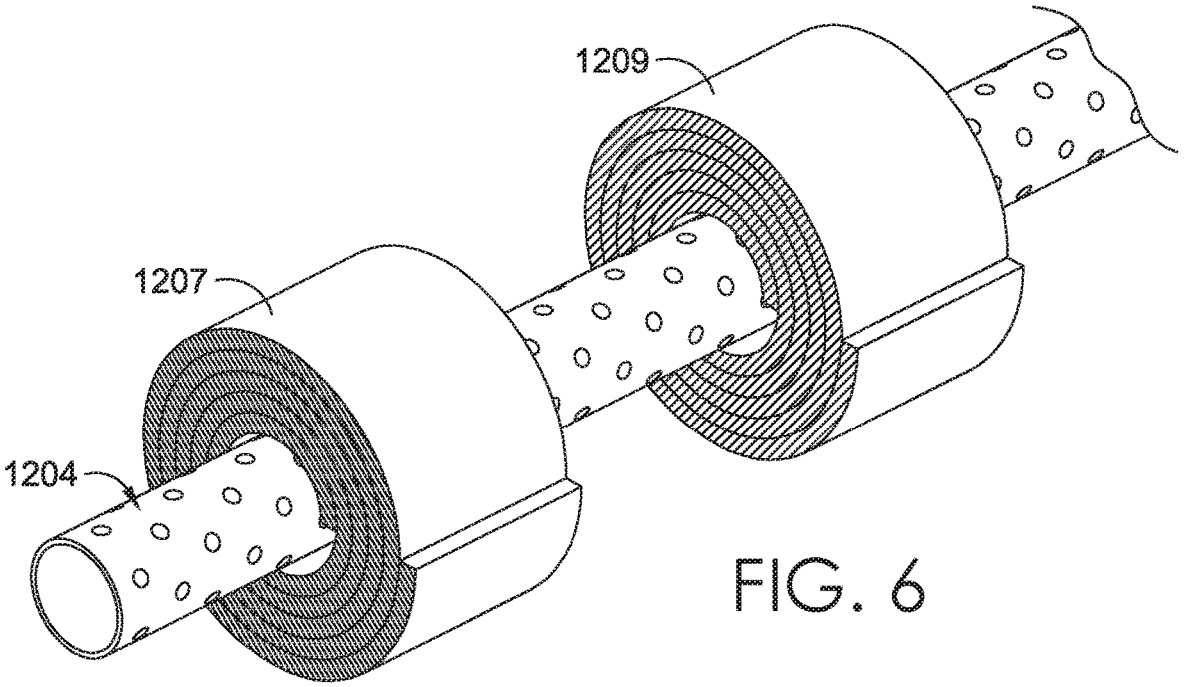
FIG. 6 depicts exemplary materials in a non-contacting arrangement, in accordance with an aspect hereof.

FIG. 6 depicts a material holding element, such as the beam 1204, also supporting a first material 1207 and a second material 1209, in accordance with aspects hereof. While the first material 1207 and the second material 1209 are depicted on a common holding element, it is contemplated that different holding elements may be used in alternative exemplary aspects. The first material 1207 has a first dye profile and the second material 1209 has a second dye profile. In particular, at least one of the first material 1207 or the second material 1209 has an integral dyestuff. To the contrary of FIG. 5 in which close proximity or physical contact is depicted with the multiple materials, the materials of FIG. 6 are not in direct contact with one another. The lack of physical contact, in an exemplary aspect, allows for the efficient substitution and manipulation of at least one material without significant physical manipulation of the other material(s). For example, if the second material 1209 has a dye profile having a first coloration is processed with the first material 1207 such that at least some of the dyestuff of the second material perfuses the first material 1207 in a SCF dyeing process, the second material 1209 may be removed and substituted with a third material having a different dye profile (e.g., a material treatment such as DWR) that is preferred to be perfused to the first material 1207 subsequent to the dyestuff of the second material 1209. Stated differently, the physical relationship depicted and generally discussed with FIG. 6 may be efficient in manufacturing and processing as individual manipulation of the materials may be accomplished, in an exemplary aspect.

While the first material 1207 and the second material 1209 are depicted as having a similar volume of material, it is contemplated that the first material 1207 may have a substantially greater volume of material than the second material 1209, which may serve as a sacrificial material in an exemplary aspect. Further, while the first material 1207 and the second material 1209 are depicted on a common holding element, it is contemplated that the first material 1207 is on a first holding element and the second material 1209 is on a second holding element that is different from the first holding element, in an exemplary aspect.

While only two materials are depicted in FIGS. 5 and 6, it is understood that any number of materials may be simultaneously exposed to a SCF (or near SCF). For example, it is contemplated that two or more sacrificial materials having integral dyestuff are placed within a common pressure vessel with a target material intended to be perfused with the dyestuff of the sacrificial materials. Further, it is contemplated that a quantity of the materials is not limited to those proportions depicted in FIG. 5 or 6. For example, it is contemplated that a target material may be of much greater volume than a sacrificial material. Further, it is contemplated that a volume of sacrificial material may be adjusted to accomplish a desired dye profile of the target material(s). For example, depending on the dye profile of the sacrificial material (e.g., concentration, coloration, etc.) and the desired dye profile for target material in addition to the volume of the target material, the amount of sacrificial material may be adjusted to achieve a desired SCF dyeing result. Similarly, it is contemplated that the dye profile of the second material (or first material) is adjusted based on a desired dye profile and/or a volume of material included in the dyeing process.

Figure 7:
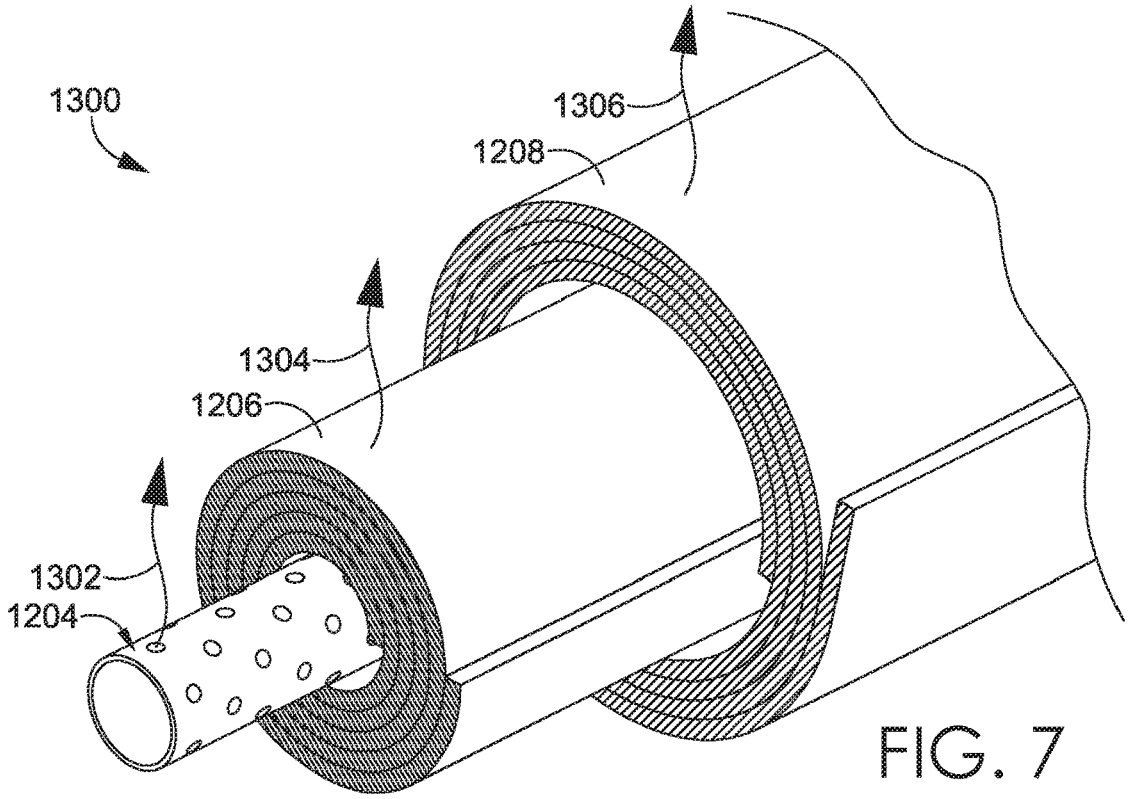
FIG. 7 depicts a series winding of two materials around a beam, in accordance with an aspect hereof.
Figure 8:
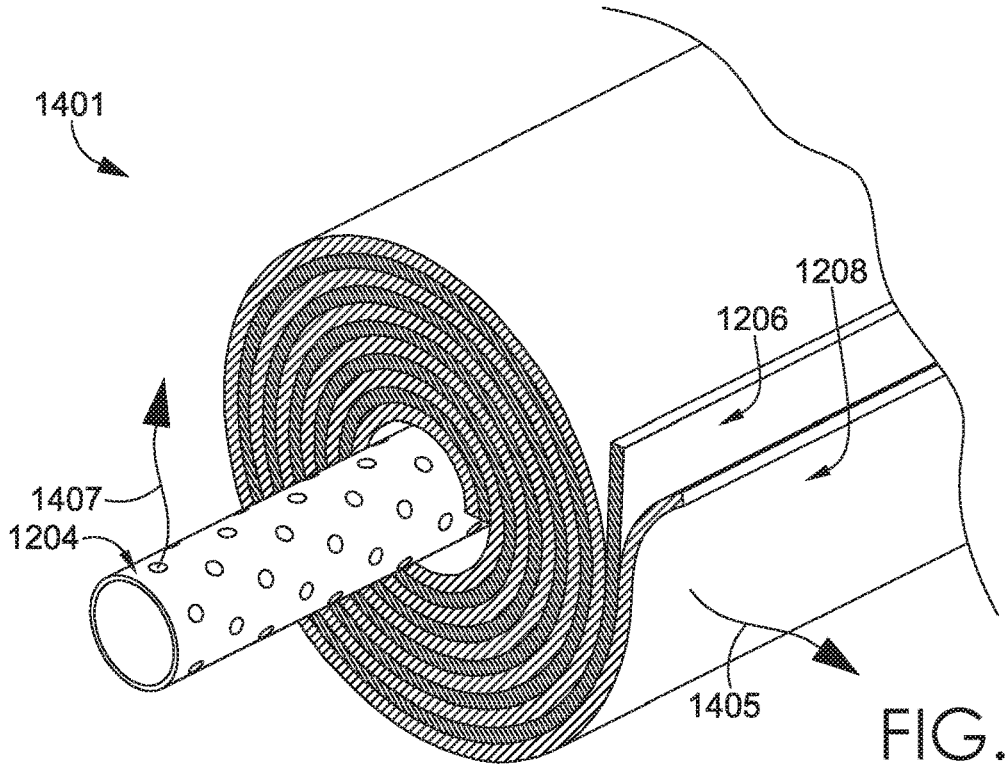
FIG. 8 depicts contemporaneously wound materials around a beam, in accordance with an aspect hereof.

As has been illustrated in FIGS. 5 and 6 and will be illustrated in FIGS. 7 and 8, various engagements of the first material and the second material about the holding device are contemplated. As previously provided, the first material 1206 and/or the second material 1208 may be any material fabric that is knit, woven, or otherwise constructed. They may be formed from any material organic or synthetic. They may have any dye profile, in an exemplary aspect. The dye profile may comprise any dye type formed from any dyestuff. In an exemplary aspect, the first material 1206 and the second material 1208 are a polyester woven material.

The SCF $CO_2$ allows the polyester to be dyed with a modified dispersed dyestuff. This occurs because the SCF $CO_2$ and/or the conditions causing the SCF state of $CO_2$ result in the polyester fibers of the materials to swell, which allows the dyestuff to diffuse and penetrate the pore and capillary structures of the polyester fibers. It is contemplated that reactive dye may similarly be used when one or more of the materials is cellulosic in composition. In an exemplary aspect, the first material 1206 and the second material 1208 are formed from a common material type such that dyestuff is effective for dyeing both materials. In an alternative aspect, such as when one of the materials is sacrificial in nature as a dye carrier, the dyestuff may have a lower affinity for the sacrificial material than the target material, which could increase the speed of SCF $CO_2$ dyeing. An example may include the first material being cellulosic in nature and the second material being a polyester material and the dyestuff associated with the first material being a dispersed dye type such that the dyestuff has a greater affinity for the polyester material (in this example) over the first material. In this example, a reduced dyeing time may be experienced to achieve a desired dye profile of the second material.

Figure 10:
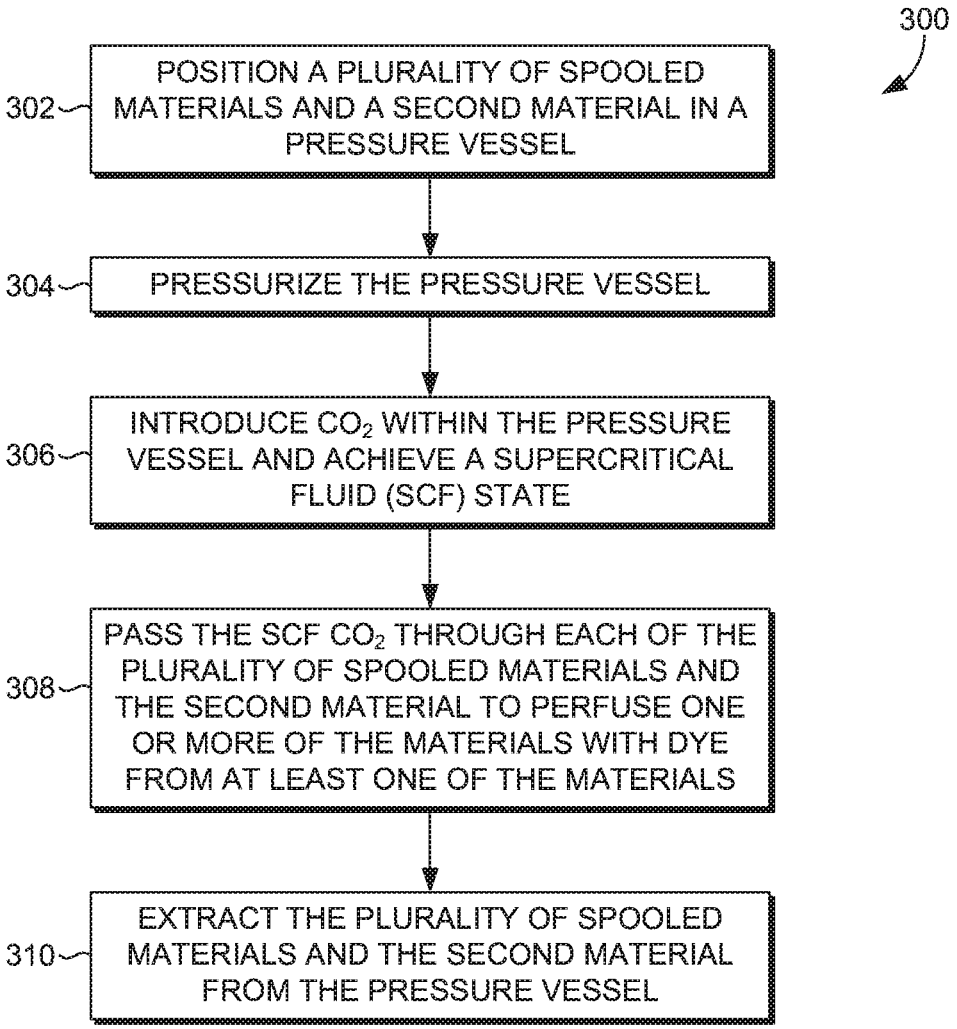
FIG. 10 depicts a flow chart representing an exemplary method of applying a dye to a spooled material using supercritical fluid, in accordance with an aspect hereof.

FIG. 10 depicts a flow chart 300 of an exemplary method of dyeing a spooled material, such as those depicted in FIGS. 1, 3, and 4, in accordance with aspects hereof. At a block 302, a plurality of spooled materials and a second material are positioned in a pressure vessel. In an exemplary aspect, the spooled material may be maintained on a securing apparatus that allows for a plurality of spooled materials to be positioned in the pressure vessel at a common time. Additionally, it is contemplated that the securing apparatus is effective to position the spooled materials in an appropriate position relative to the internal walls of the pressure vessel as well as the relative to other spooled materials. In an exemplary aspect, avoiding contact with the internal walls of the pressure vessel by a material to be perfused with a material finish allows for the material to be perfused with the material finish. As previously discussed, the spooled materials may be wound about a beam prior to being positioned in the vessel. The materials may be positioned within the vessel by moving the materials as a common grouping into the pressure vessel. Also, it is contemplated that the material may be maintained on the securing apparatus in a variety of manners (e.g., in a vertical, in a stacked, in a horizontal, and/or in an offset manner). Further, it is contemplated that the materials may be maintained on different securing devices and positioned in a common pressure vessel.

At a block 304, the pressure vessel may be pressurized. In an exemplary aspect, the materials are loaded into the pressure vessel and then the pressure vessel is sealed and pressurized. In order to maintain inserted $CO_2$ in the SCF phase, the pressure, in an exemplary aspect, is raised above the critical point (e.g., 73.87 bar).

Regardless of how the pressure vessel is brought to pressure, at a block 306, SCF $CO_2$ is introduced into the pressure vessel. This SCF $CO_2$ may be introduced by transitioning $CO_2$ maintained in the pressure vessel from a first state (i.e., liquid, gas, or solid) into a SCF state. As know, the state change may be accomplished by achieving a pressure and/or temperature sufficient for a SCF phase change. It is contemplated that one or more heating elements are engaged to raise the internal temperature of the pressure vessel to a sufficient temperature (e.g., 304 K, 30.85 C). One or more heating elements may also heat the $CO_2$ as (or before) it is introduced into the pressure vessel, in an exemplary aspect.

At a block 308, the SCF $CO_2$ is passed through each of the plurality of spooled materials and the second material. While the SCF $CO_2$ passes through the materials, which may have different dye profiles, dyestuffs is transferred between the materials and perfuse the material(s). In an exemplary aspect, the dyestuff is dissolved in the SCF $CO_2$ such that the SCF $CO_2$ serves as a solvent and carrier for the dyestuff. Further, because of the temperature and pressure of the SCF $CO_2$, the materials may alter (e.g., expand, open, swell), temporarily, to be more receptive to dyeing by the dyestuff.

It is contemplated that the passing of SCF $CO_2$ is a cycle in which the SCF $CO_2$ is passed through the materials multiple times, such as in a closed system with a circulation pump, in an exemplary aspect. It is this circulation that may help achieve the dyeing. In an aspect, the SCF is circulated through the materials for a period of time (e.g., 60 minutes, 90 minutes, 120 minutes, 180, minutes, 240 minutes) and then the SCF $CO_2$ is allowed to change state (e.g., to a liquid $CO_2$) by dropping temperature and/or pressure. After changing state of the $CO_2$ from SCF state, the dyestuff is no longer soluble in the non-SCF $CO_2$, in an exemplary aspect. For example, dyestuff may be soluble in SCF $CO_2$, but when the $CO_2$ transitions to liquid $CO_2$, the dyestuff is no longer soluble in the liquid $CO_2$.

At a block 310, the plurality of spooled materials and the second material are extracted from the pressure vessel. In an exemplary aspect, the pressure within the pressure vessel is reduced to near atmospheric pressure and the $CO_2$ is recaptured from the pressure vessel for potential reuse in subsequent dyeing operations. In an example, a securing apparatus securing the materials may be moved out of the vessel after a desired dye profile is achieved for one or more of the materials.

While specific steps are discussed and depicted in FIG. 10, it is contemplated that one or more additional or alternative steps may be introduced to achieve aspects hereof. Further, it is contemplated that one or more of the listed steps may be omitted altogether to achieve aspects provided herein.

Figure 11:
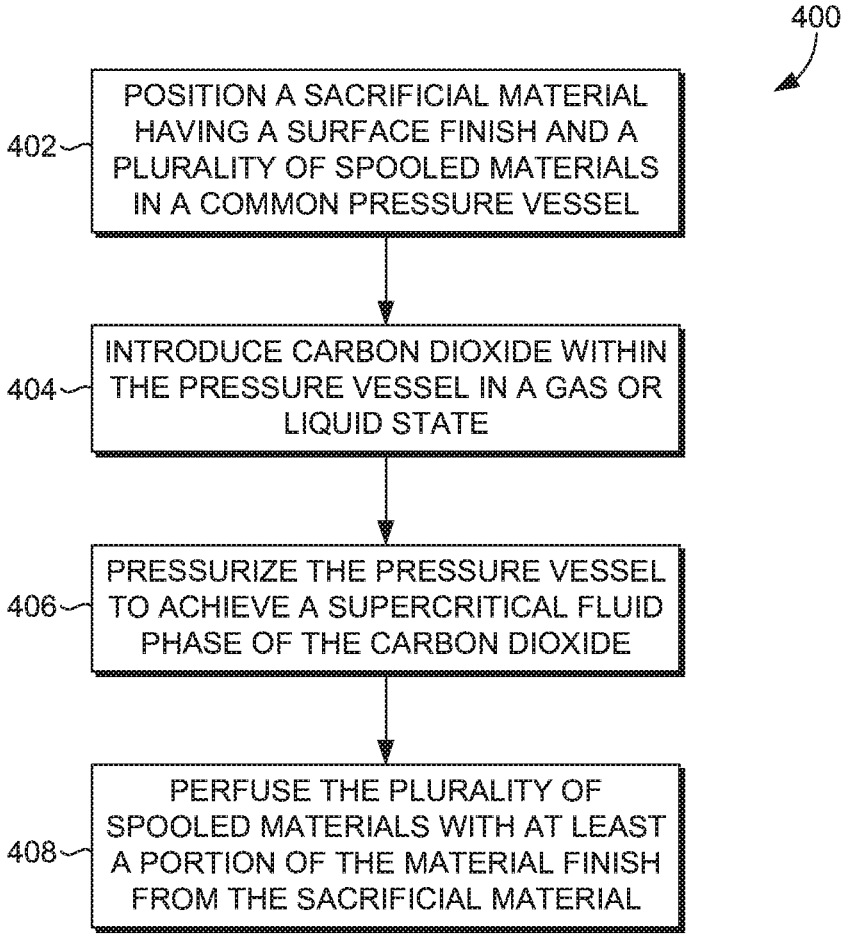
FIG. 11 depicts a flow chart representing an exemplary method of applying a material finish to a spooled material using supercritical fluid, in accordance with an aspect hereof.

FIG. 11 depicts a flow diagram 400 depicting an exemplary method of applying a material finish to a spooled material with a sacrificial material, in accordance with aspects herein. At a block 402, a sacrificial material having a surface finish and a plurality of spooled materials are positioned in a common pressure vessel. As previously discussed, the positioning may be manual or automated. The positioning may also be accomplished by used of moving a common securing apparatus to which the sacrificial material and/or one or more of the plurality of spooled materials are secured for positioning. It is contemplated that the sacrificial material is in contact with or physically separated from the spooled material when being positioned in the pressure vessel.

As previously discussed, it is contemplated that the material finish of the sacrificial material may be a colorant (e.g., dyestuff), a hydrophilic finish, a hydrophobic finish, and/or an anti-microbial finish. As will be illustrated in FIG. 12 hereinafter, it is contemplated that multiple sacrificial materials may be positioned within the pressure vessel at a common time with the plurality of spooled materials. Alternatively, it is contemplated that a sacrificial material may include more than one material finish intended to be applied to the plurality of spooled materials. For example, both a colorant and a hydrophilic finish may be maintained by the sacrificial material and applied to the spooled materials through the perfusing of SCF, in an exemplary aspect.

At a block 404, carbon dioxide is introduced into the pressure vessel. The $CO_2$ may be in a liquid or gas state when it is introduced. Further, it is contemplated that the pressure vessel is enclosed at the time of the $CO_2$ introduction to maintain the $CO_2$ within the pressure vessel. The pressure vessel may be at atmospheric pressure when the $CO_2$ is introduced. Alternatively, the pressure vessel may be above or below atmospheric pressure when the $CO_2$ is introduced.

At a block 406, the pressure vessel is pressurized allowing the introduced $CO_2$ to achieve a SCF (or near) state. Additionally, it is contemplated that thermal energy is applied to (or within) the pressure vessel to aid in achieving the SCF state of the $CO_2$. As discussed hereinabove, the state diagram of FIG. 9 depicts a trend between temperature and pressure to achieve a SCF state. In an aspect, the pressure vessel is pressurized to at least 73.87 bar. This pressurization may be accomplished by injection of atmospheric air and/or $CO_2$ until the internal pressure of the pressure vessel reaches the desired pressure, such as at least the critical point pressure of $CO_2$.

At a block 408, the plurality of spooled materials are perfused with at least a portion of the material finish from the sacrificial material. The material finish is transferred to the plurality of spooled materials by way of the SCF $CO_2$. As discussed previously, the SCF $CO_2$ serves as a transportation mechanism for the material finish from the sacrificial material to the plurality of spooled materials. This may be assisted by circulating, such as by a circulation pump, the SCF within the pressure vessel so that it perfuses both the sacrificial material and the plurality of spooled materials. It is contemplated that the material finish may dissolve, at least partially, within the SCF allowing for their release from being bound with the sacrificial material to being deposited on/within the plurality of spooled materials. To ensure consistent application of the material finish to the plurality of spooled materials, the material finish may be integral to the sacrificial material, which ensures the intended amount of material finish is introduced within the pressure vessel. The transfer of the material finish may continue until a sufficient amount of the material finish perfuses the spooled materials.

While specific reference in FIG. 11 is made to one or more steps, it is contemplated that one or more additional or alternative steps may be implemented while achieving aspects provided herein. As such, blocks may be added or omitted while still staying within the scope hereof.

Figure 12:
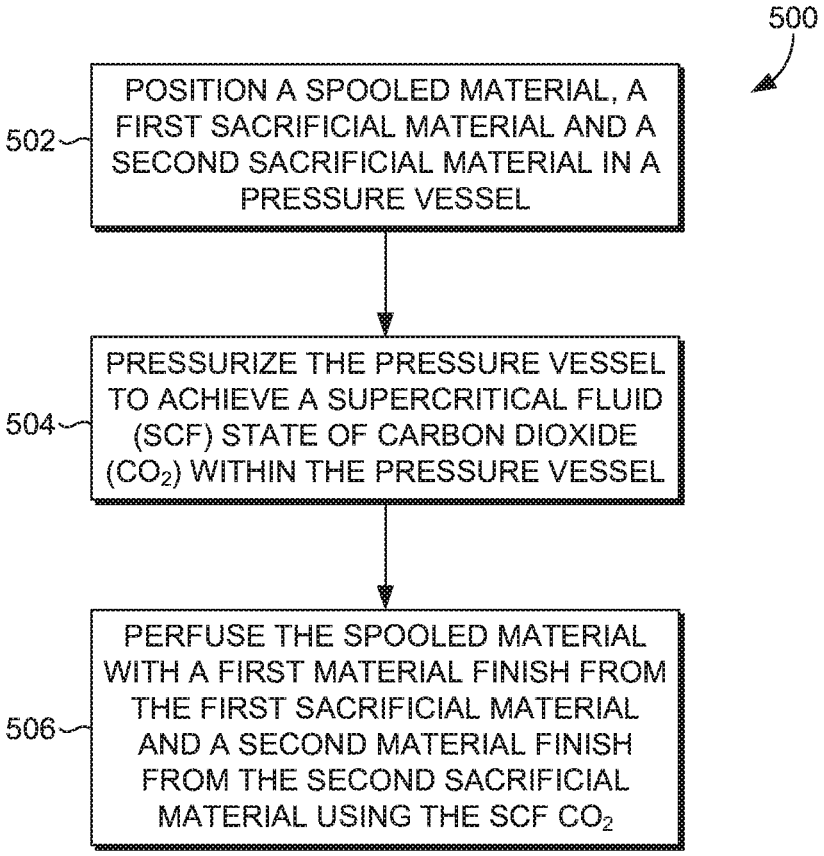
FIG. 12 depicts a flow chart representing an exemplary method of applying a first material finish and a second material finish to a spooled material using supercritical fluid, in accordance with an aspect hereof.

FIG. 12 depicts a flow diagram 500 illustrating a method of applying at least two material finishes to a spooled material from a first and a second sacrificial material, in accordance with aspects herein. A block 502 depicts a step of positioning a spooled material, a first sacrificial material and a second sacrificial material in a common pressure vessel. The first sacrificial material having a first material finish and the second sacrificial material having a second material finish. For example, as provided above, it is contemplated that the first material finish is a first dye profile and the second material finish is a second dye profile, that when perfused with the spooled material, results in a third dye profile. The previous example applies here as well where the first dye profile is a red colorant and the second dye profile is a blue colorant such that when both the red and blue colorants perfuse the spooled material, the spooled material assumes a purple coloration. In an alternative example, the first material finish may be an anti-bacterial finish and the second material finish may be a hydrophobic material finish, such that the spooled material acquires both material finishes in a common application process, which reduces finishing time. While specific material finishes are provided in combination, it is recognized that any combination may be exposed to the SCF at a common time for application to the spooled material.

While a first and a second sacrificial material are discussed, any number of sacrificial materials may be provided. Further, it is contemplated that a quantity of the first sacrificial material and a quantity of the second sacrificial material are different depending on a desired amount of each material finish desired to be applied to the spooled material. Further, it is contemplated that the sacrificial materials will also maintain a portion of the material finish from the other materials within the pressure vessel. Therefore, it is contemplated the volume of all materials, include sacrificial, are considered when determining a quantity of surface finish to be inserted in the pressure vessel.

At a block 504, the pressure vessel is pressurized such that $CO_2$ within the pressure vessel achieves a SCF state therein. The SCF is then effective to administer the material finish of the first sacrificial material and the second material finish of the second material to the spooled material, as depicted in a block 506.

While specific reference in FIG. 12 is made to one or more steps, it is contemplated that one or more additional or alternative steps may be implemented while achieving aspects provided herein. As such, blocks may be added or omitted while still staying within the scope hereof.

FIG. 7 depicts a first exemplary winding 1300 of multiple materials having surface contact with one another on a beam 1204 for equilibrium dyeing, in accordance with aspects hereof. The winding 1300 is comprised of the beam 1204, the first material 1206, and the second material 1208. The first material 1206 and the second material 1208 are cross-sectioned to illustrate the relative location to the beam 1204. In this winding, the entirety of the first material 1206 is wound around the beam 1204 prior to the second material 1208 being wound around the first material 1206. Stated differently, SCF $CO_2$ 1302 passes through substantially the wound thickness of the first material 1206 before passing through the second material 1208 as SCF $CO_2$+dye 1304. The SCF $CO_2$ is then expelled from the second material 1208 as SCF $CO_2$+dye 1306, which may then be recirculated through one or more additional or other materials (e.g., first material 1206). Therefore, a cycle is formed in which the SCF $CO_2$+dye perfuse the materials within the pressure vessel until the temperature or pressure are changed such that the SCF changes state, at which time, the dyestuff will become integral with the material with which it was in contact at the time of the SCF state change, in an exemplary aspect.

In this illustrated example, the last turn of the first material 1206 exposes a surface that is in direct contact with a surface of the first turn of the second material 1208. Stated differently, the depicted series rolling of winding 1300 allows for a limited, but available, direct contact between the first material 1206 and the second material 1208. This direct contact can be distinguished over alternative aspects in which a dye carrier or the dyestuff is physically separate from the material to be dyed. As such, the direct contact between the materials to be dyed and having the dyestuff may reduce dyeing time and reduce potential cleaning and maintenance times, in an exemplary aspect.

FIG. 8 depicts a second exemplary winding 1401 of multiple materials on a beam 1204 for SCF dyeing, in accordance with aspects hereof. The winding 1401 is comprised of the beam 1204, the first material 1206, and the second material 1208. The first material 1206 and the second material 1208 are cross-sectioned to illustrate the relative location to the beam 1204. In this winding, the first material 1206 is contemporaneously wound around the beam 1204 with the second material 1208. Stated differently, SCF $CO_2$ 1407 passes through alternating layers of the first material 1206 and the second material 1208 allowing for multiple direct contact between the materials as multiple turns of each material are contact the other material as they wind about the beam 1204. In this example, the SCF $CO_2$ 1407 transfers dye between the materials achieving transfer of dyestuff in potentially a shorter cycle because of the consistent distance from dyestuff source and target (e.g., 1 material thickness distance). SCF $CO_2$+dye 1405 may expel from the materials (e.g., second material 1208) for recirculation through the materials and further propagation of the equilibrium of dyestuff.

While only two materials are depicted in FIGS. 7 and 8, it is contemplated that any number of materials may be wound relative to one another in any manner, in additional exemplary aspects. Further, it is contemplated that a combination of physical arrangement may be implemented with respect to the materials. For example, it is contemplated that two or more sacrificial materials may be arranged as depicted in FIG. 7 or 8 while a target material is not in contact with the sacrificial material. Stated differently, it is contemplated that one or more materials may be in physical contact with one another while one or more materials may be physically separate from one another in a common pressure vessel for a common SCF dyeing process, in accordance with aspects hereof.

Figure 13:
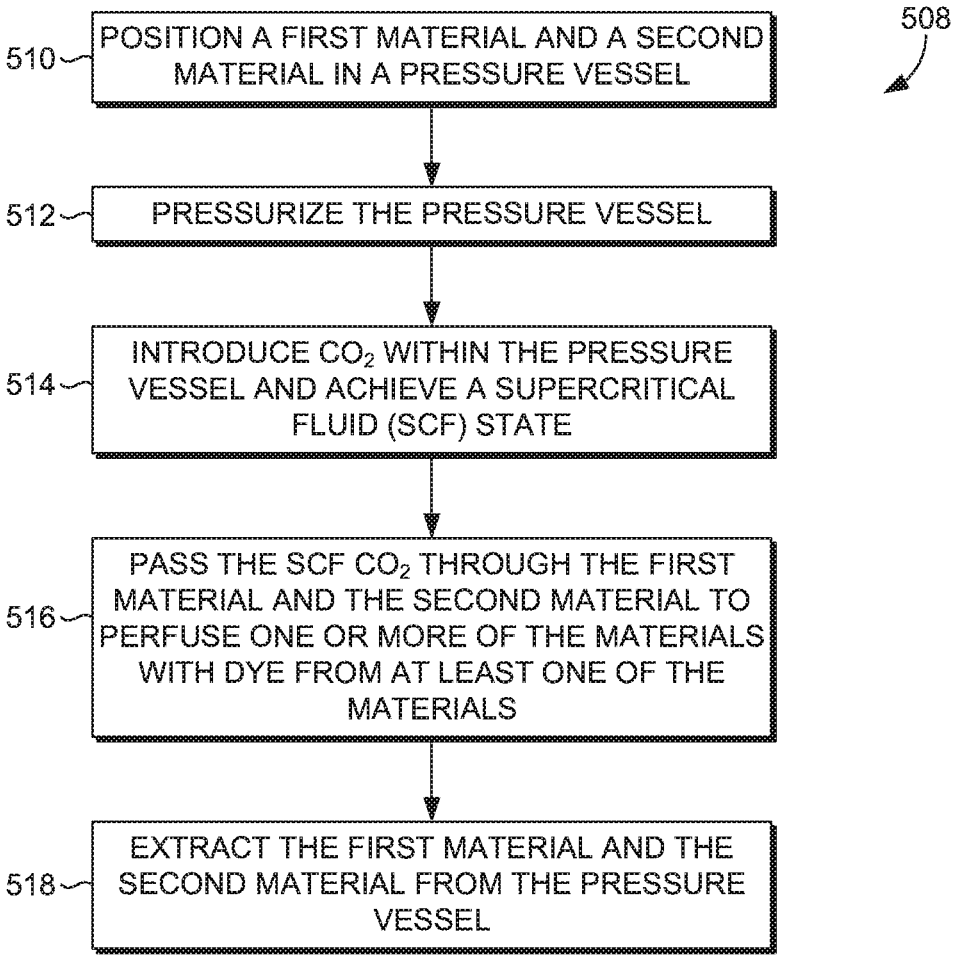
FIG. 13 depicts a flow chart illustrating a method for dyeing material with a supercritical fluid, in accordance with an aspect hereof.

FIG. 13 depicts a flow chart 508 of an exemplary method of equilibrium dyeing a material, in accordance with aspects hereof. At a block 510, a first material and a second material are positioned in a pressure vessel. As previously discussed, the materials may be wound about a beam prior to being positioned in the vessel. The materials may be positioned by moving the materials as rolled together into the pressure vessel. Also, it is contemplated that the material may be wound about a beam in a variety of manners (e.g., in series, in parallel). Further, it is contemplated that the materials may be maintained on different holding devices and positioned in a common pressure vessel.

At a block 512, the pressure vessel may be pressurized. In an exemplary aspect, the materials are loaded into the pressure vessel and then the pressure vessel is sealed and pressurized. In order to maintain inserted $CO_2$ in the SCF phase, the pressure, in an exemplary aspect, is raised above the critical point (e.g., 73.87 bar).

Regardless of how the pressure vessel is brought to pressure, at a block 514, $CO_2$ is introduced (or recirculated) into the pressure vessel. This $CO_2$ may be introduced by transitioning $CO_2$ maintained in the pressure vessel from a first state (i.e., liquid, gas, or solid) into a SCF state. As know, the state change may be accomplished by achieving a pressure and/or temperature sufficient for a SCF phase change. It is contemplated that one or more heating elements are engaged to raise the internal temperature of the pressure vessel to a sufficient temperature (e.g., 304 K, 30.85 C). One or more heating elements may also (or alternatively) heat the $CO_2$ as (or before) it is introduced into the pressure vessel, in an exemplary aspect. The introduction of $CO_2$ may occur during pressurization, prior to pressurization, and/or subsequent to pressurization.

At a block 516, the SCF $CO_2$ is passed through the first material and the second material. In an exemplary aspect, the SCF $CO_2$ is pumped into a beam about which one or more of the materials are wound. The SCF $CO_2$ is expelled from the beam into the materials. While the SCF $CO_2$ passes through the materials, which may have different dye profiles, dyestuffs is transferred between the materials and perfuse the material(s). In an exemplary aspect, the dyestuff is dissolved in the SCF $CO_2$ such that the SCF $CO_2$ serves as a solvent and carrier for the dyestuff. Further, because of the temperature and pressure of the SCF $CO_2$, the materials may alter (e.g., expand, open, swell), temporarily, to be more receptive to dyeing by the dyestuff.

It is contemplated that the passing of SCF $CO_2$ is a cycle in which the SCF $CO_2$ is passed through the materials multiple times, such as in a closed system with a circulation pump, in an exemplary aspect. It is this circulation that may help achieve the dyeing. In an aspect, the SCF is circulated through the materials for a period of time (e.g., 60 minutes, 90 minutes, 120 minutes, 180, minutes, 240 minutes) and then the SCF $CO_2$ is allowed to change state (e.g., to a liquid $CO_2$) by dropping temperature and/or pressure. After changing state of the $CO_2$ from SCF state, the dyestuff is no longer soluble in the non-SCF $CO_2$, in an exemplary aspect. For example, dyestuff may be soluble in SCF $CO_2$, but when the $CO_2$ transitions to liquid or gas $CO_2$, the dyestuff may no longer be soluble in the liquid or gas $CO_2$. It is further contemplated that the $CO_2$ is circulated internally (e.g., passed through a material holder or a beam) and/or the $CO_2$ is circulated as a recapture process to reduce lost $CO_2$ during phase changes (e.g., depressurization).

At a block 518, the first material and the second material are extracted from the pressure vessel. In an exemplary aspect, the pressure within the pressure vessel is reduced to near atmospheric pressure and the $CO_2$ is recaptured from the pressure vessel for potential reuse in subsequent dyeing operations. In an example, a beam having the materials wound thereon may be moved out of the vessel after a desired dye profile is achieved for one or more of the materials.

While specific steps are discussed and depicted in FIG. 13, it is contemplated that one or more additional or alternative steps may be introduced to achieve aspects hereof. Further, it is contemplated that one or more of the listed steps may be omitted altogether to achieve aspects provided herein.

Figure 14:
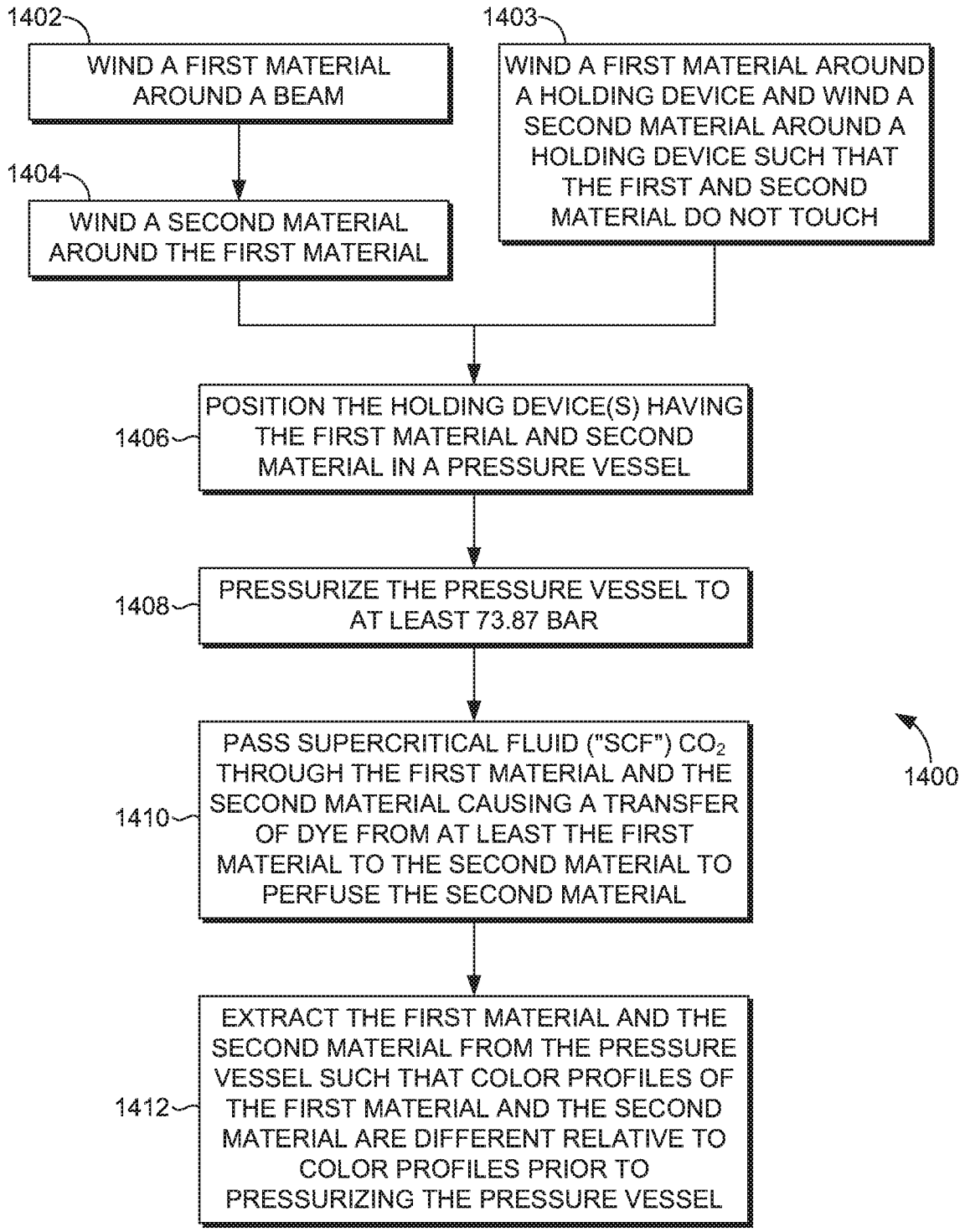
FIG. 14 depicts a flow chart illustrating another method for dyeing material with a supercritical fluid, in accordance with an aspect hereof.

FIG. 14 depicts a flow chart 1400 of a method for dyeing materials with SCF $CO_2$, in accordance with aspects hereof. The method has at least two different starting positions. A first approach, as indicated at block 1402, is a winding of a first material around a beam. At a block 1404, a second material is wound around the first material from the block 1402. The blocks 1402 and 1404 may result in a winding similar to that which is generally depicted in FIG. 7 or 8.

In the alternative, the second starting position of FIG. 14 is represented at a block 1403 with the winding of a first material about a holding device, such as a beam, and the winding of a second material about a holding device, which may be the same or different holding device on to which the first material was placed. In the step depicted at the block 1403, the first material and the second material are not in physical contact with each other. The step provided by the block 1403 may result in a material positioning that is generally depicted in FIG. 6.

In both the first and the second starting positions, the multiple materials are wound, in one manner or another, about one or more holding devices for positioning in a common pressure vessel, as depicted at a block 1406.

At a block 1408 the pressure vessel is pressurized to at least 73.87 bar. This pressurization may be accomplished by injection of atmospheric air and/or $CO_2$ until the internal pressure of the pressure vessel reaches the desired pressure, such as at least the critical point pressure of $CO_2$. For example, $CO_2$ is inserted into the pressure vessel with a pump until the appropriate pressure is achieved within the pressure vessel.

At a block 1410, SCF $CO_2$ is passed through the first material and the second material to cause a change in a dye profile for at least one of the first material or the second material. The dye transfer may be continued until the dyestuffs perfuse the materials(s) sufficiently to achieve a desired dye profile. An internal recirculating pump is contemplated as being effective to cycle the SCF $CO_2$ through the beam and wound materials multiple times to achieve the equilibrium dyeing, in an exemplary aspect. This internal recirculating pump may be adjusted to achieve a desired flow rate of the SCF $CO_2$. The flow rate provided by the internal recirculating pump may be affected by the amount of material, the density of material, the permeability of the material, and the like.

At a block 1412, the first material and the second material are extracted from the pressure vessel such that color profiles (e.g., dye profile) of the materials are different relative to the color profiles of the materials as existed at blocks 1402, 1403, or 1404. Stated differently, upon completion of the SCF $CO_2$ passing through the materials, the dye profiles of at least one of the materials changes to reflect that it has been dyed by SCF $CO_2$.

While specific reference in FIG. 14 is made to one or more steps, it is contemplated that one or more additional or alternative steps may be implemented while achieving aspects provided herein. As such, blocks may be added or omitted while still staying within the scope hereof.

Process

The process of using SCF $CO_2$ in a material dyeing or finishing application relies on manipulation of multiple variables. The variables include time, pressure, temperature, quantity of $CO_2$, and flow rate of the $CO_2$, rate of change for one or more variables over time (e.g., change in pressure per minute, change in temperature per minute), and exchange of $CO_2$. Further, there are multiple cycles in the process in which one or more of the variables may be manipulated to achieve a different result. Three of those cycles include a pressurizing cycle, a perfusing cycle (also referred to as a "dyeing cycle"), and a depressurizing cycle. In an exemplary scenario, $CO_2$ is introduced into a sealed pressure vessel with the temperature and the pressure increasing such that the $CO_2$ is elevated to at least the critical point of 304 K and 73.87 bar. In this traditional process, the second cycle of perfusing (e.g., dyeing) the material-to-be-finished occurs. A flow rate of a recirculating pump may be set and maintained and a time is established for the dyeing cycle. Finally, at the depressurization cycle in a traditional process, the flow rate may be stopped, the application of thermal energy ceases, and the pressure is reduced, all substantially simultaneously or at varied intervals to transition the $CO_2$ from SCF to gas. For example, the temperature may be maintained or at least maintained above a threshold level during the depressurization cycle while pressure is reduced. The temperature is maintained until, in an example, the density of the $CO_2$ changes to a point that no longer supports maintaining the dyestuff in solution with the $CO_2$. At which point, the temperature may also decrease. This delayed temperature decrease may increase collection of dyestuff by the target material that is more receptive to dyestuff perfusion at elevated temperatures. Therefore, maintaining the elevated temperature during the transition of the $CO_2$ density may reduce deposition of dyestuff onto the pressure vessel components as the target material remains a more attractive target for the dyestuff coming out of solution from the $CO_2$.

Improvements over a traditional process are able to be realized by adjusting the different variable. In particular, adjusting the sequence and timing of the variable changes during a cycle provides better results. For example, a traditional process may cause the material finish (e.g., dyestuff) to coat the inner surfaces of the pressure vessel. The coating of the pressure vessel is inefficient and undesired as it represents material finish that was not perfused through the intended material and requires subsequent cleaning to ensure the material finish is not perfused into a subsequent material for which it is not intended. Stopping the flow rate at the initiation of the third cycle causes the $CO_2$ and the material finishes dissolved therein to become stagnate within the pressure vessel. As $CO_2$ transitions from SCF to gas, the material finish in this stagnant environment may not find a suitable host to attach as the material finish comes out of solution with the $CO_2$ at the phase change. Therefore, the pressure vessel itself may become the target of the surface finish as opposed to the target material. Manipulation of the variables may allow for the material finish to favor adhering/bonding/coating the intended target material as opposed to the pressure vessel itself.

In the third cycle (e.g., depressurization cycle), it is contemplated that the flow rate is maintained or at least not ceased until the $CO_2$ changes from the SCF to gas state. For example, if the pressure within the pressure vessel is operating at 250 bar during the perfusing cycle, the $CO_2$ may stay in SCF state in the third cycle until the pressure is reduced below 73.87 bar. As a result, when the second cycle is completed, instead of stopping the flow of $CO_2$ or significantly reducing the flow rate of $CO_2$ within the pressure vessel, the flow rate is maintained through at least a portion of the third cycle. In an additional concept, the flow rate of the $CO_2$ is maintained until the pressure reduces below 73.87 bar. Additionally or alternatively, it is contemplated that the flow rate is maintained above a threshold until the $CO_2$ passes a defined density at which the dyestuff comes out of solution with the $CO_2$.

At least two different scenarios for the third cycle are contemplated. The first scenario is a sequence where the third cycle of the process initiates at the reduction in temperature of the $CO_2$. For example, the second cycle may be operating at 320 K, in an exemplary aspect, at the completion of the second cycle, the temperature is allowed to decline from the operating temperature of 320 K. While a traditionally process may also stop the flow of $CO_2$ within the pressure as the temperature begins to decline, it is contemplated that instead the flow rate is maintained, at some level, until at least the temperature falls below the critical temperature of $CO_2$, 304 K/30.85 C. In this example, the $CO_2$ may remain in the SCF until the temperature falls below 304 K/30.85; therefore, the flow rate is maintained to circulate the $CO_2$ and deposit material finishes therein around and/or through the target material. In this first scenario, the pressure may be maintained at the operating pressure (or above 73.87 bar) until the $CO_2$ changes from SCF to another state (e.g., liquid if above 73.87 bar). Alternatively, the pressure may also be allowed to drop at the commencement of the third cycle, but the flow is maintained until at least the $CO_2$ changes to a different state and/or a defined $CO_2$ density is achieved.

The second scenario, while similar to the first, relies on the third cycle being initiated by a decline in pressure. For example, if the operating pressure within the pressure vessel to perfuse the material is 250 bar, the third cycle is initiated when the pressure drops. While a traditional process may cease the flow rate of the $CO_2$ at this point, it is contemplated that instead the flow rate is maintained or not ceased simultaneously. Instead, at the third cycle, the $CO_2$ is subject to flow until the pressure drops below at least 73.87 bar to ensure circulation of the $CO_2$ having dissolved material finishes contained therein the entirety of time the $CO_2$ is at a SCF state. The temperature may also be dropped simultaneously with the pressure decline or it may be maintained until a certain pressure or $CO_2$ density is achieved. It is contemplated that some dyestuff (e.g., surface finishes) may come out of solution with the $CO_2$ prior to the $CO_2$ transitioning from the SCF state. Therefore, the transition pressure at which other variable are adjusted may instead be based on the density of the $CO_2$ (e.g., 500 $Kg/m^3$).

In an exemplary aspect, the third cycle initiates with the pressure dropping and the temperature dropping toward the $CO_2$ critical point, but the flow rate of the $CO_2$ is maintained, at least in part, until the $CO_2$ has transitioned from the SCF state. While specific temperatures and pressures are listed, it is contemplated that any temperature or pressure may be used. Further, instead of relying on the $CO_2$ achieving a particular temperature or pressure, a time may be used for when to reduce or cease the $CO_2$ flow rate, in an exemplary aspect.

Manipulation of the variable is not limited to the third cycle. It is contemplated that a higher equilibrium saturation of surface finish may be achieved by adjusting the variables in the first and second cycles. For example, the flow rate may begin before the $CO_2$ transitions from a first state (e.g., gas or liquid) to a SCF state. It is contemplated that as $CO_2$ transitions into a SCF state, the material finish that is to-be-dissolved in the SCF is exposed to a non-stagnate pool of $CO_2$ allowing an for an equilibrium of solution to occur sooner, in an exemplary aspect. Similarly, it is contemplated that the thermal energy is applied to the pressure vessel internal volume before the introduction of $CO_2$ and/or before the pressurization of the $CO_2$ begins. As the transfer of thermal energy may slow the process because of thermal mass of the pressure vessel, it is contemplated that the addition of the thermal energy occurs, in an exemplary aspect prior to the application of pressure. As such, it is contemplated that manipulation of variables during the pressurization cycle may allow the dyestuff to dissolve in the $CO_2$ at a faster rate. For example, the rate of pressure increase relative to temperature increase during the pressurization cycle may be manipulated through temperature hold periods, which can enhance the dyestuff dissolving in the $CO_2$, for example.

Additionally, the manipulation of variables may further affect the resulting dyeing process of the target material. For example, at certain cycles (e.g., dyeing cycle) an increase of flow rate may increase color levelness (e.g., uniformity of finish deposition on the target material) and at certain cycles (e.g., depressurization cycle) a decrease in flow rate can improve color fastness (e.g., bond strength of material finish with the target material). Further yet, the flow rate in certain cycles (e.g., pressurization cycle) may be varied to enhance solubility results of the dyestuff in the $CO_2$. Further yet, the permeability of the target material may affect variables, such as flow rate. For example, a higher permeability material (e.g., knit) may use a lower flow rate to achieve a sufficient degree of color levelness while also achieving a sufficient degree of color fastness relative to a lower permeability material (e.g., tightly woven). As such, the process variable may adjust based on the material characteristics as well as degree of dyeing results tolerated.

In further support of the general processes provided above, specific examples are provided hereinafter.

Figure 15:
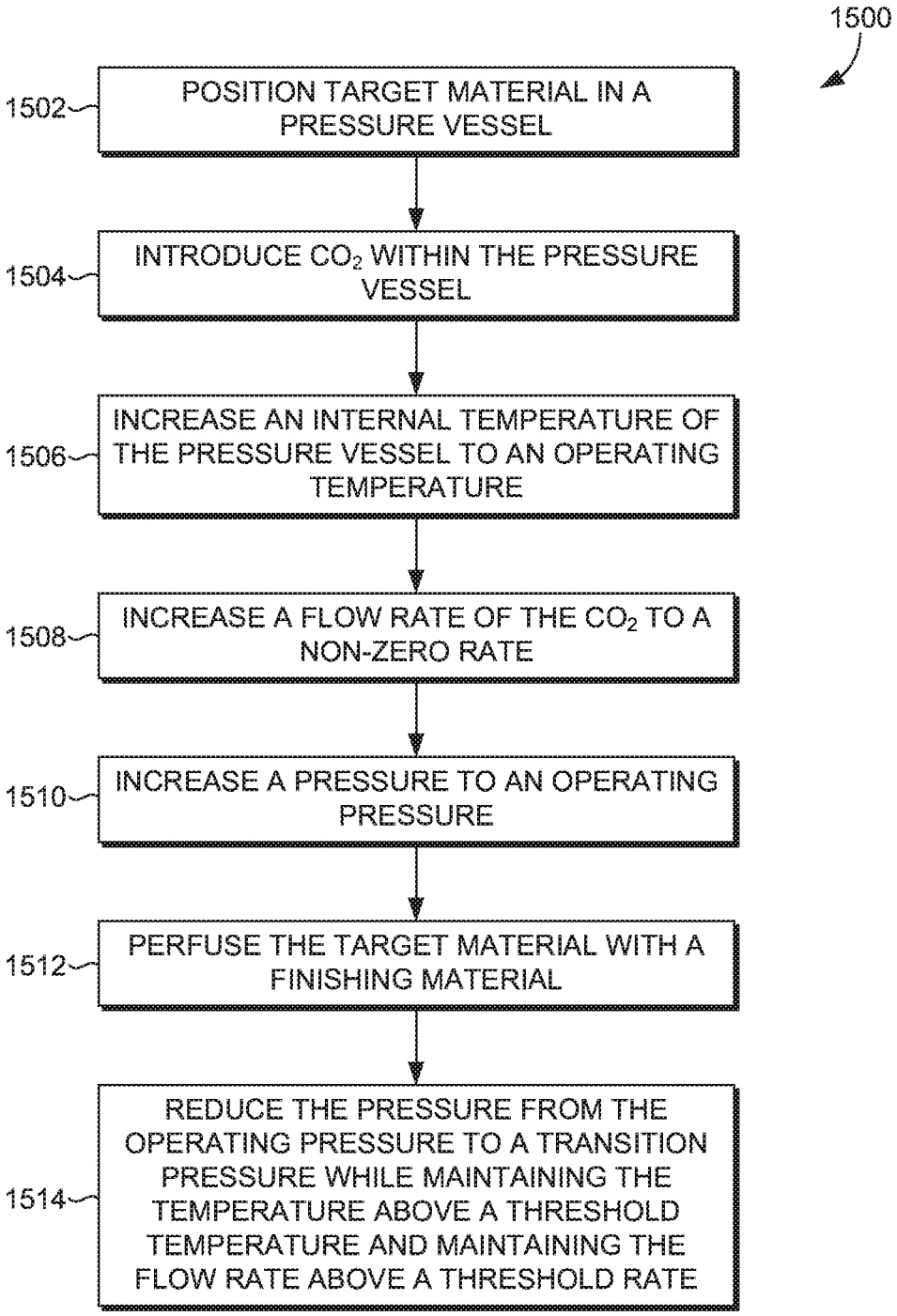
FIG. 15 depicts a flow chart representing an exemplary method of applying a finish material to a target material, in accordance with aspects hereof.

FIG. 15 depicts a flow chart 508 representing an exemplary method of applying a finish material to a target material, in accordance with aspects hereof. At a block 510, a target material, such as polyester, is positioned in a pressure vessel. The target material may be a rolled material and/or a spooled material in an exemplary aspect. The target material may have a weight between 100 and 200 Kg in an exemplary aspect. However, lesser or greater weights are contemplated.

At a block 512, $CO_2$ is introduced into the pressure vessel. As discussed herein, the $CO_2$ may be introduced in any state, such as a gaseous state to the enclosed pressure vessel. At a block 514, an internal temperature of the pressure vessel is increased to an operating temperature. For example, it is contemplated that the pressure vessel may have a pre-heated temperature, such as 80-90 Celsius in an exemplary aspect, from which the pressure vessel is further heated. The operating temperature may be within a range of 100-125 Celsius in an aspect. The operating temperature may be around 110 Celsius in an aspect. The operating temperature may depend on the target material composition (e.g., synthetic materials). As discussed herein, a temperature within a range of 100-125 Celsius allows for a polyester target material to open up pores for physically capturing a finishing material without melting the polyester, in an exemplary aspect. In an exemplary aspect, the temperature is at least a glass transition temperature of the target material. This temperature (e.g., 60-70 Celsius for polyester) allows hydrophobic polymers of a hydrophobic material to be opened to diffusion of dispersed finish materials. Further, the operating temperature should be sufficient for the $CO_2$ to achieve (or nearly achieve) a SCF state.

At a block 516, a pump mechanism is activated to increase a flow rate above a zero flow rate for internal circulation of $CO_2$. For example, prior to the $CO_2$ achieving SCF state, the pump is activated to circulate the $CO_2$ as it achieves a SCF state and begins dissolving a finishing material contained within the pressure vessel.

At a block 518, a pressure of the pressure vessel internal cavity is increased to an operating pressure. The operating pressure is sufficient to achieve a SCF state for the $CO_2$ when at the operating temperature. In an exemplary aspect, the operating pressure is below 300 bar. In an exemplary aspect, the operating pressure is in a range of 225-275 bar. In an exemplary aspect, the operating pressure is 250 bar.

At a block 1512, the target material is perfused with a finishing material. The finishing material is transported to the target material as the finishing material is dissolved in the SCF $CO_2$ and circulated by the pump controlling the flow rate of the $CO_2$. The perfusing of the target material allows for the infiltration and maintaining of the finishing material by the target material. The perfusing of the target material may continue for a predetermined time, such as 30, 45, 60, 75, 90, 120, 150, 180 minutes, in an exemplary aspect.

At a block 1514, the pressure is reduced from the operating pressure to a transition pressure while maintaining the temperature above a threshold temperature and also while maintaining the flow rate above a threshold rate. The transition pressure may be any pressure from atmospheric pressure up to the operating pressure. In an aspect, the transition pressure is in a range of 225-100 bar. In an aspect the transition pressure is 200 bar, 150 bar, or 100 bar. The threshold temperature may be determined based on the target material. For example, if the target material the threshold temperature may be 100 Celsius. The threshold flow rate is a non-zero rate. Stated differently, the $CO_2$ is circulated as the pressure reduces from the operating pressure to the threshold pressure. As discussed herein, efficiencies are achieved by maintaining the temperature and/or the flow rates above threshold levels while the pressure is decreasing from the operating pressure. For example, as the dissolved material finish in the $CO_2$ begins to precipitate from the $CO_2$ as the density of the $CO_2$ transitions from the operating values, the circulation and or maintained temperature allow for a great uptake of the material finish by the target material than if the flow rate and/or the temperature are decreased below the threshold levels prior to the precipitation phase, in an exemplary aspect.

FIGS. 18-22 depict general trends between pressure, temperature, and flow rate of $CO_2$ during cycles of a SCF $CO_2$ material finishing process, in accordance with aspects hereof. FIGS. 18-22 are comprised of three charted variables, temperature 1802, pressure 1804, and flow rate 1806. Further, along the X axis, four cycles are delineated, a pressurization cycle 1808, a dyeing/treatment cycle 1810, a depressurization cycle 1812, and a completion cycle 1814. As provided herein, it is contemplated that the temperature, pressure, and flow rate may be varied at the initiation, completion, and/or during any of the delineated cycles. Further, it is contemplated that the variables may be adjusted in reaction to another variable achieving a threshold, as will be discuss hereinafter in more detail. FIGS. 18-22 are provided for illustrative purposes and is not intended to be limiting in nature, but instead for exemplary purposes.

At the pressurization cycle 1808 $CO_2$ is filled into the pressure vessel. The pressure vessel may be preheated to a starting temperature, such as 50-90 Celsius in an exemplary aspect. However, it is contemplated that the vessel may not be preheated or it may be heated to a different starting temperature in exemplary aspects. The pressure within the vessel may start at atmospheric pressure in an exemplary aspect. The pressure in the pressurization cycle 1808 may be increased to a threshold pressure, such as 250 bar. However any pressure threshold above the critical point pressurization of $CO_2$ is contemplated. As will be discussed hereinafter, the pressurization threshold may be less than 310 bar to achieve process efficiency in time to pressurization and energy required to achieve such pressurization. Upon achieving a threshold pressure, the pressurization cycle 1808 may transition to the dyeing/treatment cycle 1810, in an exemplary aspect. It is further contemplated that the transition from pressurization cycle 1808 to dyeing/treatment cycle 1810 may occur after another variable, including a preset time, is achieved.

Figure 18:
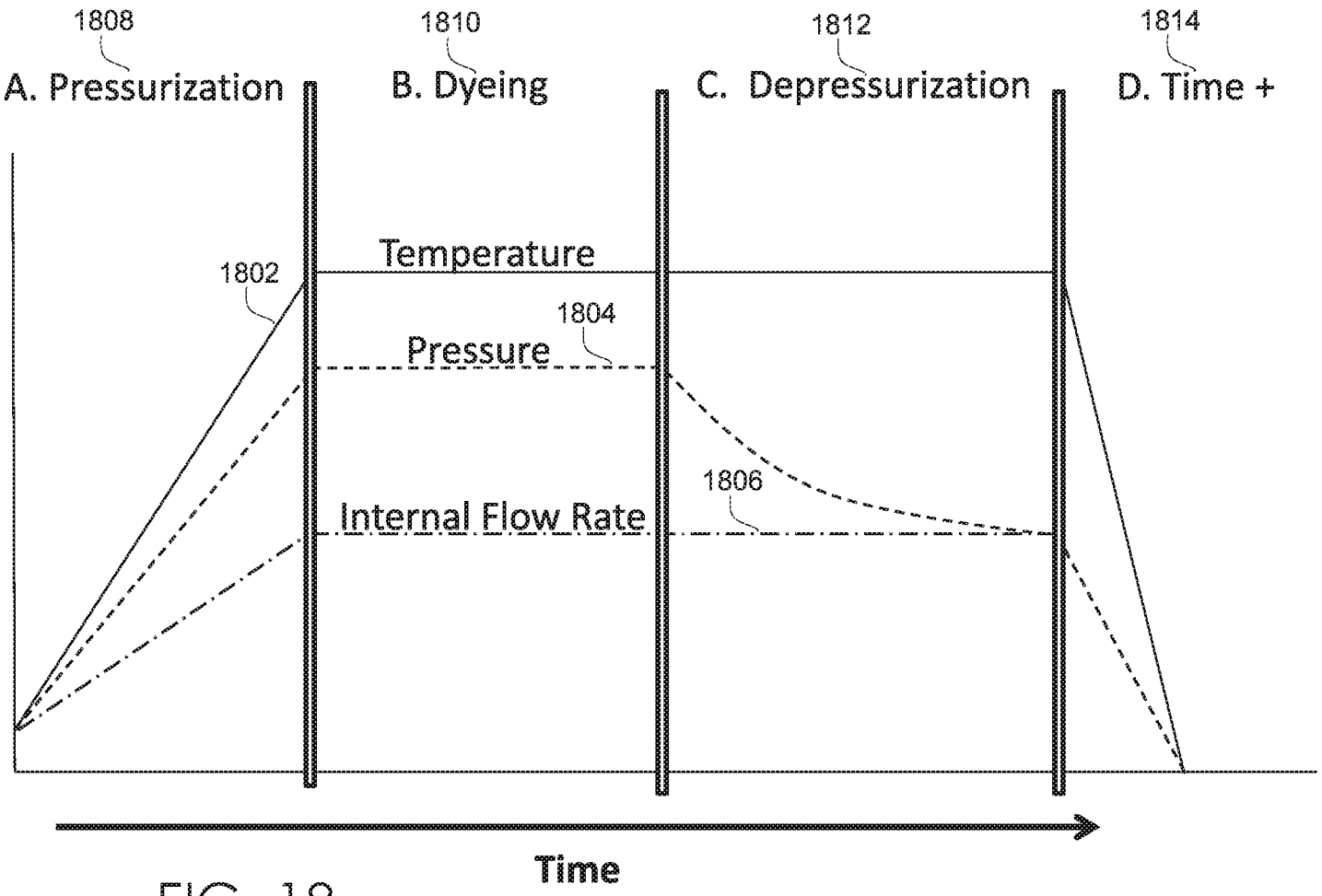
FIGS. 18-22 depict relative variables during cycles of supercritical dyeing, in accordance with aspects hereof.

Also depicted in FIG. 18 at the pressurization cycle 1808 is the flow rate 1806 is achieving a first rate. In an exemplary aspect, the first rate of the flow rate is a non-zero value such that a pump (or other mechanism) is operating to circulate the $CO_2$ when the $CO_2$ is in a state capable of being circulated. The flow rate 1806 at a non-zero value in the pressurization cycle 1808 is effective, in an exemplary aspect, to aid in the dissolution of finishing material (e.g., dyestuff) while limiting a caking of the finishing material that may occur with a stagnate $CO_2$ lacking a flow rate as the $CO_2$ transition from a gas state to a SCF state in the presence of the material finish. The flow rate 1806 is contemplated as increasing at or leading up to the dyeing/treatment cycle 1810; however, it is also contemplated that a similar or greater flow rate may be implemented in alternative aspects during the pressurization cycle 1808 relative to the dyeing/treatment cycle 1810. Further, it is also contemplated that the flow rate may be increased during the time of the pressurization cycle 1808. For example, prior to the $CO_2$ achieving a SCF state, the flow rate may be initiated at a first rate and as the $CO_2$ enters and passes into SCF state, the flow rate may be increased. The increase in the flow rate of this example may increase to a flow rate intended for the dyeing/treatment cycle 1810, in an exemplary aspect.

The slope of pressurization, temperature, and/or flow rate changes during one or more cycles is also variable. For example, it is contemplated that temperature is increased at a rate to achieve maximum time at the desired temperature for the dyeing/treatment cycle 1810 to allow the thermal mass of the material to be treated to equalize to benefit the perfusing and acceptance of the finishing material. For example, if the target material is polyester or other long-chain polymer, achieving a temperature above 100 Celsius may result in the pores of the polyester opening sufficient for the material finish to be perfused and maintained by the polyester. If an internal portion of the polyester material has yet to reach the 100 Celsius temperature as dissolved finishing material is being perfused through the polyester material, the adhesion of the finishing material may be hindered at portions of the polyester material, in an exemplary aspect. Similarly, it is contemplated that various rates of pressurization may be established. For example, as will be discussed in the depressurization cycle 1812, a 5 bar per minute rate may be used to achieve a desired precipitation of the finishing material from the $CO_2$, in an exemplary aspect. The pressurization rate may also be manipulated to achieve a specified pressurization cycle 1808 duration.

The dyeing/treatment cycle 1810 may equate to the second cycle in the above description of the $CO_2$ processing methodology. The duration of the dyeing/treatment cycle 1810 may be established based on a number of potential variables. For example, the duration may be established based on the type of target material, the characteristics of the material (e.g., permeability, density), the material finish to be applied (e.g., coloration, saturation of coloration, chemistry of finishing material, type of finishing material), flow rate of the $CO_2$, the temperature, the pressure, and the like.

As depicted in FIG. 18 for the dyeing/treatment cycle 1810, the pressure 1804, temperature 1802, and the flow rate 1806 are maintained constant in this exemplary aspect. However, it is contemplated that the pressure, temperature, and/or flow rate may be adjusted in the dyeing/treatment cycle 1810. For example, to achieve a varied $CO_2$ density having a different solubility of the finishing material (to be discussed hereinafter), the pressure may be adjusted to dissolve different chemistries at different points within the dyeing/treatment cycle 1810 and/or to cause the precipitation of various finishing material chemistries in specific sequences during the dyeing/treatment cycle 1810, in an exemplary aspect. The duration of the dyeing/treatment cycle 1810 may be controlled by a number of variables, such as a preset time (e.g., 30 minutes, 45 minutes, 60 minutes, 90 minutes, 120 minutes, 150 minutes, 180 minutes), in an exemplary aspect.

FIG. 18 depicts a transition from the dyeing/treatment cycle 1810 to the depressurization cycle 1812 having a decrease in the pressure 1804. The depressurization cycle 1812 may resemble the third cycle provided hereinabove. The change in pressure 1804 may be at a predetermined rate (e.g., slope). That rate may range from 1-10 bar per minute in exemplary aspects. In another exemplary aspect the pressure is decreased at about 5 bar per minute. Further, the pressure change may be based, in part, on the characteristics of the $CO_2$ as it transitions between different states or densities.

In the example depicted in FIG. 18, the temperature 1802 and the flow rate 1806 are maintained at the beginning of the depressurization cycle 1812 even while the pressure 1804 is reduced. However, it is contemplated that either of the temperature or the flow rate may be reduced and/or increased at the initiation of the depressurization cycle 1812. However, in an exemplary aspect, having the flow rate at a non-zero rate allows for the continued circulation of $CO_2$ as the finishing material precipitates out of the $CO_2$. This continued circulation during the precipitation phase of the finishing material provides several advantages in exemplary aspects. For example, the affinity of the finishing material in the precipitation phase out of the $CO_2$ may favor the target material more than the $CO_2$ allowing for a higher concentration of the finishing material to be maintained by the target material. The pressure vessel and components therein (e.g., carrier beam/holding member) are not desired to maintain and/or attract the finishing material at the conclusion of the process. Therefore, as opposed to stopping the flow rate prior to the finishing material precipitating out of the $CO_2$, which can cause a stagnate environment in which the precipitated finishing material is maintained to a surface (e.g., pressure vessel wall) as opposed to the target material, the continued flow of $CO_2$ provides the finishing material to be perfused through the target material in the precipitation phase of the depressurization cycle 1812.

In an exemplary aspect, once the pressure achieves a defined pressure (e.g., 200 bar) that also causes the finishing material to fully precipitate out of the $CO_2$, in an exemplary aspect, the temperature may then be reduced, as depicted in the cycle 1814. Further, it is contemplated that the flow rate 1806 may be changed at the initiation of the cycle 1814. Additionally, it is contemplated that the flow rate 1806 may be changed upon the pressure/temperature/density achieving a predefined level, in an exemplary aspect.

The depressurization cycle 1812 provides other combination of variables to achieve different results. For example, it is contemplated that the pressure if reduced to a predefined threshold for recapture of the $CO_2$ and then the pressure is reduced to atmosphere with a loss of $CO_2$ to the environment. This rapid depressurization may occur after the finishing material has precipitated out of the $CO_2$ and the $CO_2$ has transitioned to a gaseous or liquid state.

Figure 19:
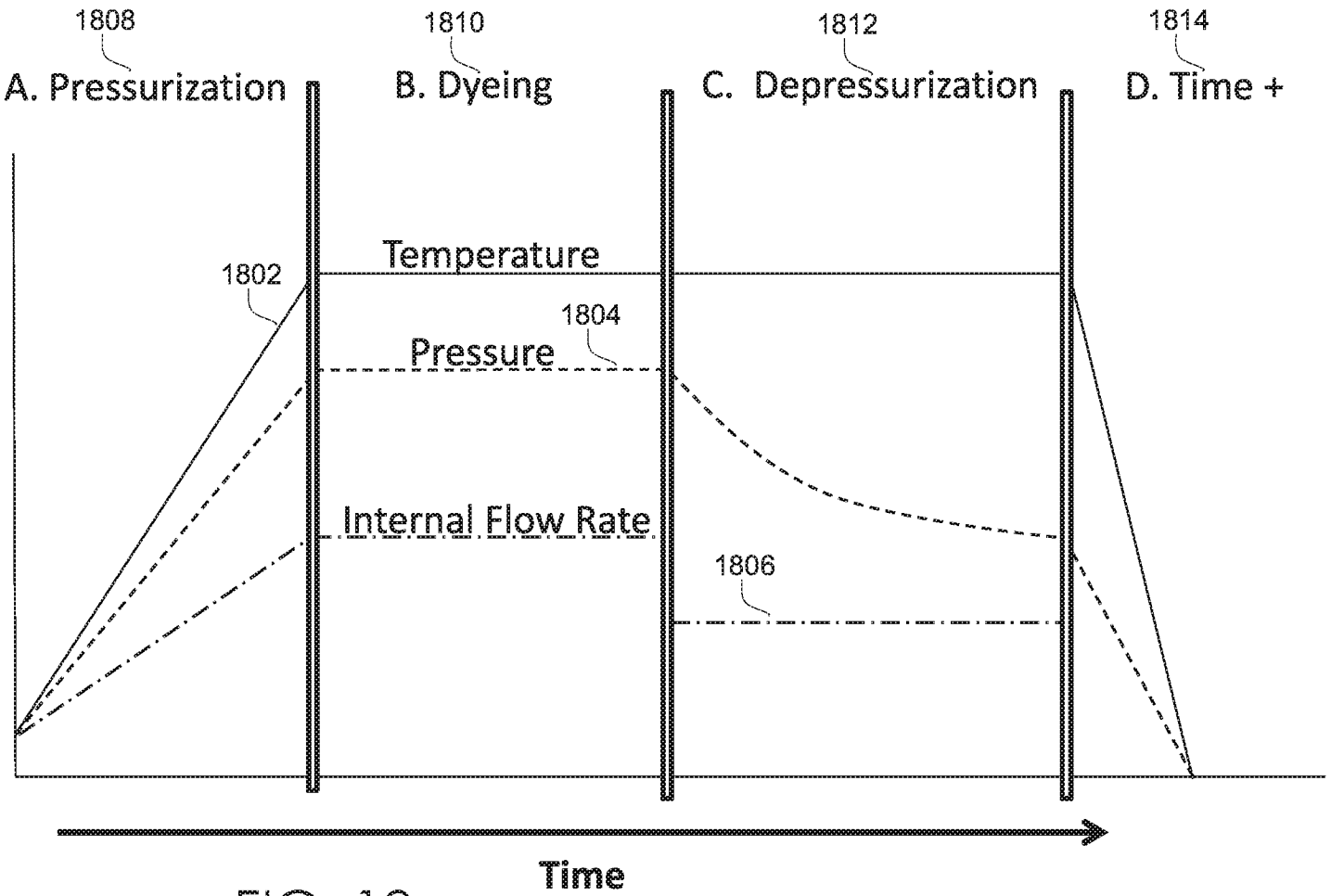

FIG. 19 illustrates a decrease of the internal flow rate 706 during the depressurization cycle 712 from the flow rate during the dyeing/treatment cycle 1810, in accordance with aspects hereof. This reduction of flow rate during the depressurization cycle 712 may be effective to increase affinity of the dyestuff with the target material for some dyestuff and/or target materials.

Figure 20:
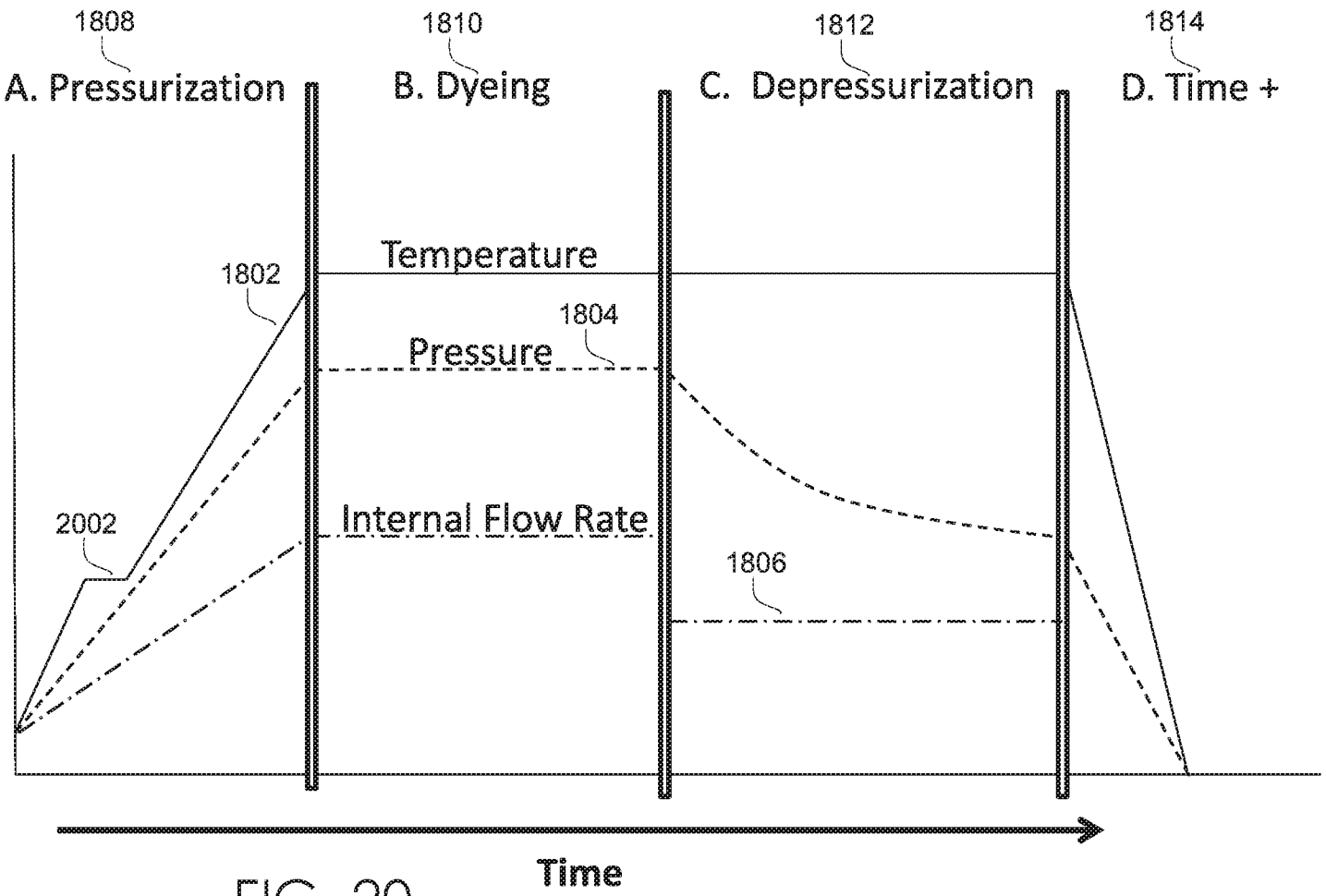

FIG. 20 illustrates a stepped 2002 temperature during the pressurization cycle 1808, in accordance with aspects hereof. The step 902 may maintain the $CO_2$ at a defined temperature for a defined time. For example, the temperature may be maintained at 100 Celsius for 5-15 minutes. In an exemplary aspect, the step 902 is 5 minutes, 10 minutes, or 15 minutes. The time and temperature associated with the step 902 may depend on the dyestuff and the density of $CO_2$ at which the dyestuff is soluble. For example, the step 902 may occur at a point relative to pressure increase to enhance the solubility of the dyestuff in the $CO_2$.

Figure 21:
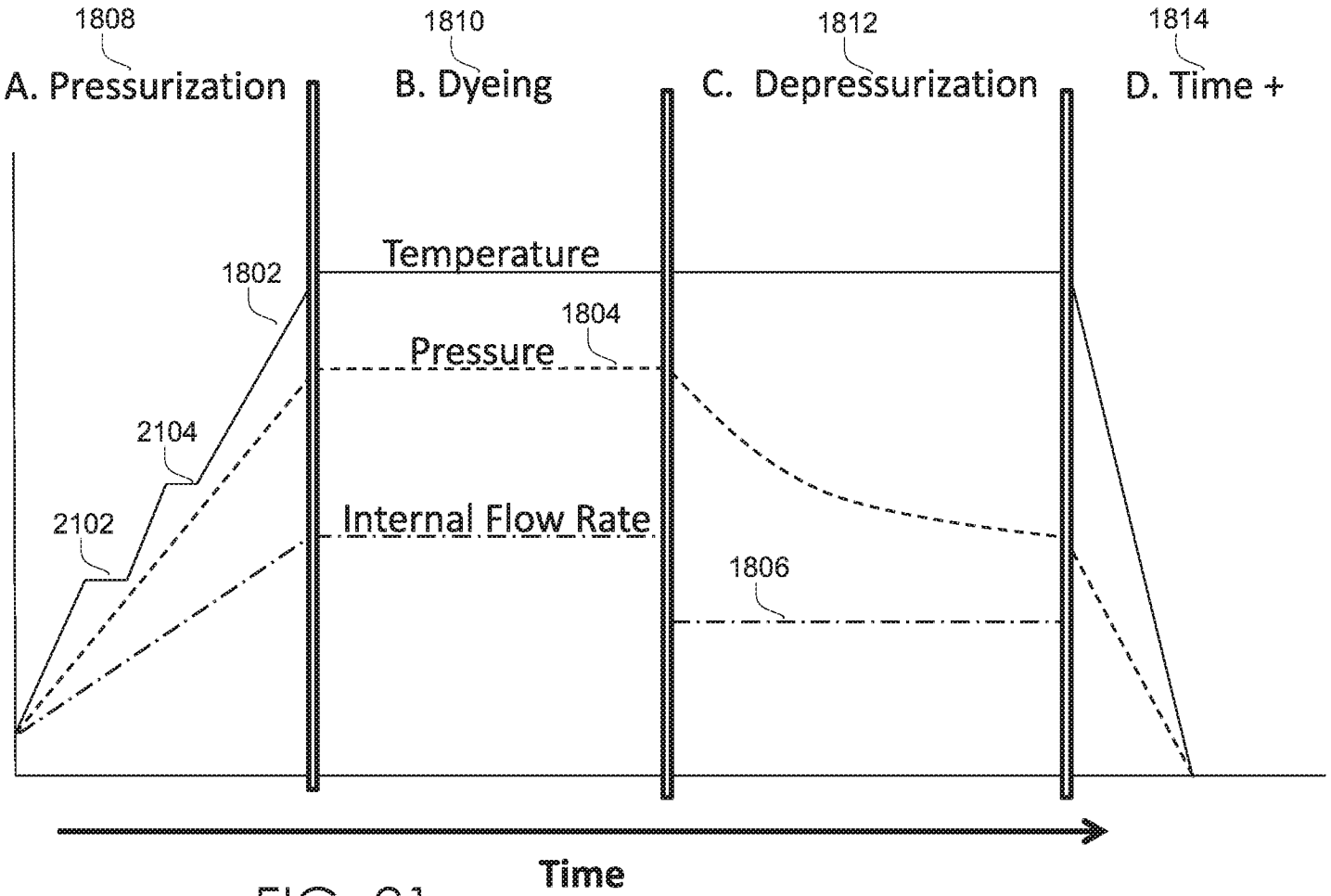

FIG. 21 illustrates a multiple stepped 2102, 2104 temperature during the pressurization cycle 1808, in accordance with aspects hereof. The steps 2102, 2104 may maintain the $CO_2$ at defined temperatures (e.g., 100, 110 Celsius) for defined time (e.g., 5, minutes, 5 minutes). In an exemplary aspect, the step 2102 is 5 minutes, 10 minutes, or 15 minutes. In an exemplary aspect, the step 2104 is 5 minutes, 10 minutes, or 15 minutes. The defined temperature at the step 2102 is 100 Celsius, in an exemplary aspect. The defined temperature at the step 2104 is 110 Celsius, in an exemplary aspect. The time and temperature associated with the steps 2102, 2104 may depend on the dyestuff and the density of $CO_2$ at which the dyestuff is soluble. For example, the steps 2102, 2104 may occur at points relative to pressure increase to enhance the solubility of a first dyestuff and a second dyestuff respectively in the $CO_2$.

Figure 22:
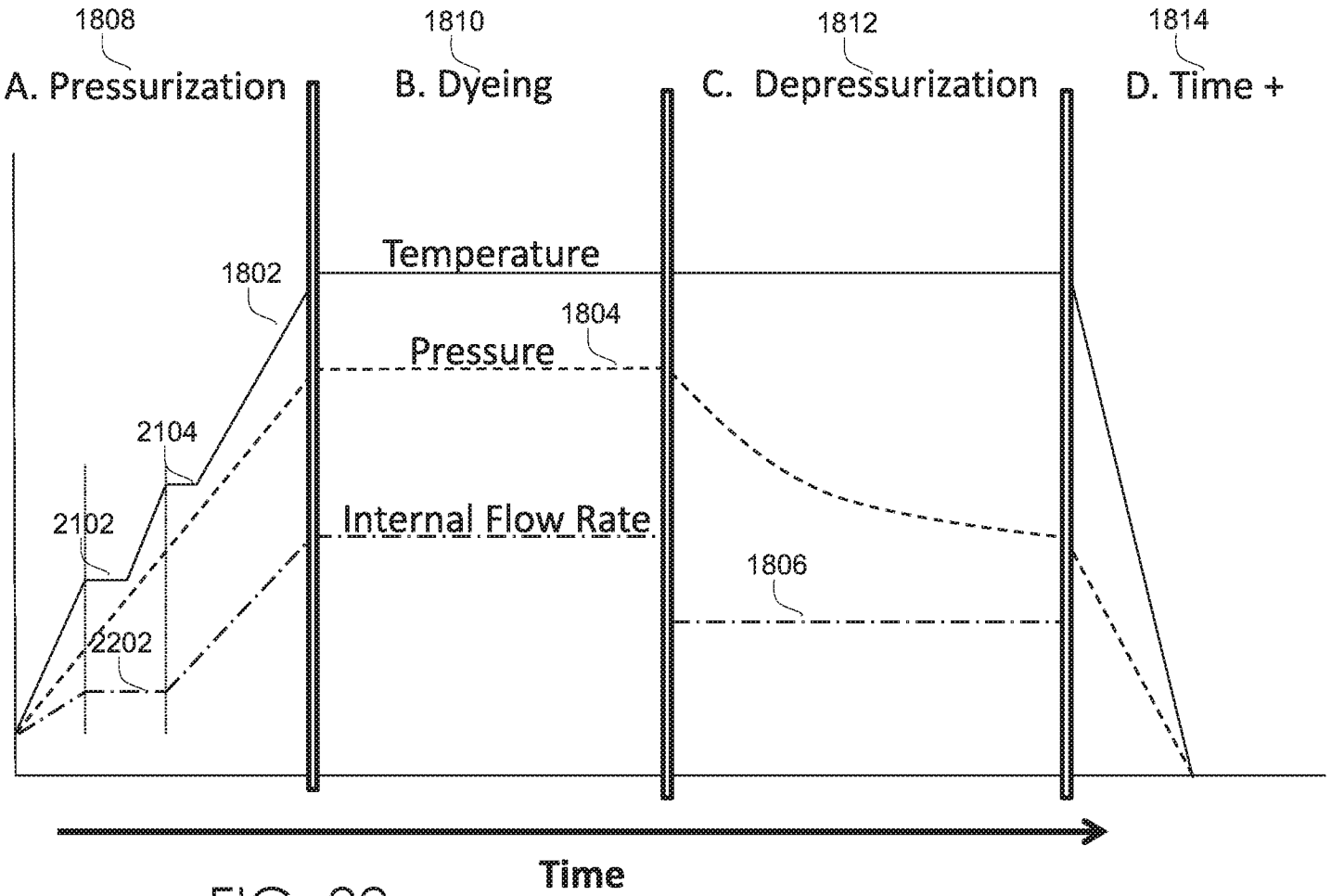

FIG. 22 illustrates a manipulation 2202 of the internal flow rate 706 relative to the steps 2102,2104 of FIG. 21, in accordance with aspects hereof. In an exemplary aspect, the flow rate is reduced, stopped, or maintained in relation to one or more variables, such as the stepping of temperature. This adjustment of the flow rate may enhance the solubility of exemplary dyestuff in the $CO_2$.

FIGS. 18-22 are illustrative in nature and not limiting. Each depiction of a variable (e.g., temperature 1802, pressure 1804, and flow rate 1806) is merely relative and not provided to a scale. Further, it is contemplated that values may be achieved for the variables prior to or after the points depicted, in exemplary aspects.

The following is a listing of exemplary variable settings for the pressurization, dyeing, and depressurization cycles that may be implemented to achieve aspects provided herein. Each row represents a variation in the variables to achieve a $CO_2$ dyeing process for a particular target material and/or dyestuff. However, the values provided are not limiting.

Exemplary Condition 1—See FIG. 18 for Example

Pressurization: Start Temp: 80-90 Celsius, Pressure: 188-250 Bar, Flow rate: 90-130 $m^3$/hr.

Dyeing: Temp: 120 Celsius, Pressure: 250 Bar, Flow rate: 230-240 $m^3$/hr.

Depressurization: Starting Temp: 120 Celsius, Ending Pressure: 150 Bar, Flow rate: 230-240 $m^3$/hr.

Exemplary Condition 2—See FIG. 18 for Example

Pressurization: Starting Temp: 80-90 Celsius, Pressure: 188-250 Bar, Flow rate: 90-130 $m^3$/hr.

Dyeing: Temp: 120 Celsius, Pressure: 250 Bar, Flow rate: 230-240 $m^3$/hr.

Depressurization: Starting Temp: 120 Celsius, Ending Pressure: 100 Bar, Flow rate: 230-240 $m^3$/hr.

Exemplary Condition 3—See FIG. 19 for Example

Pressurization: Starting Temp: 80-90 Celsius, Pressure: 188-250 Bar, Flow rate: 90-130 $m^3$/hr.

Dyeing: Temp: 120 Celsius, Pressure: 250 Bar, Flow rate: 230-240 $m^3$/hr.

Depressurization: Starting Temp: 120 Celsius, Ending Pressure: 150 Bar, Flow rate: 90-130 $m^3$/hr.

Exemplary Condition 4—See FIG. 19 for Example

Pressurization: Starting Temp: 80-90 Celsius, Pressure: 188-250 Bar, Flow rate: 90-130 $m^3$/hr.

Dyeing: Temp: 120 Celsius, Pressure: 250 Bar, Flow rate: 230-240 $m^3$/hr.

Depressurization: Starting Temp: 120 Celsius, Ending Pressure: 100 Bar, Flow rate: 90-130 $m^3$/hr.

Exemplary Condition 5—See FIG. 19 for Example

Pressurization: Starting Temp: 80-90 Celsius, Pressure: 188-250 Bar, Flow rate: 90-130 $m^3$/hr.

Dyeing: Temp: 120 Celsius, Pressure: 250 Bar, Flow rate: 175-200 $m^3$/hr.

Depressurization: Starting Temp: 120 Celsius, Ending Pressure: 150 Bar, Flow rate: 90-130 $m^3$/hr.

Exemplary Condition 6—See FIG. 19 for Example

Pressurization: Starting Temp: 80-90 Celsius, Pressure: 188-250 Bar, Flow rate: 90-130 $m^3$/hr.

Dyeing: Temp: 120 Celsius, Pressure: 250 Bar, Flow rate: 175-200 $m^3$/hr.

Depressurization: Starting Temp: 120 Celsius, Ending Pressure: 100 Bar, Flow rate: 90-130 $m^3$/hr.

Exemplary Condition 7—See FIG. 19 for Example

Pressurization: Starting Temp: 80-90 Celsius, Pressure: 188-250 Bar, Flow rate: 90-130 $m^3$/hr.

Dyeing: Temp: 115 Celsius, Pressure: 250 Bar, Flow rate: 230-240 $m^3$/hr.

Depressurization: Starting Temp: 115 Celsius, Ending Pressure: 150 Bar, Flow rate: 90-130 $m^3$/hr.

Exemplary Condition 8—See FIG. 19 for Example

Pressurization: Starting Temp: 80-90 Celsius, Pressure: 188-250 Bar, Flow rate: 90-130 $m^3$/hr.

Dyeing: Temp: 115 Celsius, Pressure: 250 Bar, Flow rate: 230-240 $m^3$/hr.

Depressurization: Starting Temp: 115 Celsius, Pressure: 100 Bar, Flow rate: 90-130 $m^3$/hr.

Exemplary Condition 9—See FIG. 19 for Example

Pressurization: Starting Temp: 80-90 Celsius, Pressure: 188-250 Bar, Flow rate: 90-130 $m^3$/hr.

Dyeing: Temp: 115 Celsius, Pressure: 250 Bar, Flow rate: 175-200 $m^3$/hr.

Depressurization: Starting Temp: 115 Celsius, Ending Pressure: 150 Bar, Flow rate: 90-130 $m^3$/hr.

Exemplary Condition 10—See FIG. 19 for Example

Pressurization: Starting Temp: 80-90 Celsius, Pressure: 188-250 Bar, Flow rate: 90-130 $m^3$/hr.

Dyeing: Temp: 115 Celsius, Pressure: 250 Bar, Flow rate: 175-200 $m^3$/hr.

Depressurization: Starting Temp: 115 Celsius, Ending Pressure: 100 Bar, Flow rate: 90-130 $m^3$/hr.

Exemplary Condition 11—See FIG. 19 for Example

Pressurization: Starting Temp: 80-90 Celsius, Pressure: 188-250 Bar, Flow rate: 90-130 $m^3$/hr.

Dyeing: Temp: 115 Celsius, Pressure: 250 Bar, Flow rate: 175-240 $m^3$/hr.

Depressurization: Starting Temp: 115 Celsius, Ending Pressure: 100-150 Bar, Flow rate: 90-130 $m^3$/hr.

Exemplary Condition 12—See FIG. 19 for Example

Pressurization: Starting Temp: 80-90 Celsius, Pressure: 188-250 Bar, Flow rate: 90-130 $m^3$/hr.

Dyeing: Temp: 110 Celsius, Pressure: 250 Bar, Flow rate: 175-240 $m^3$/hr.

Depressurization: Starting Temp: 110 Celsius, Ending Pressure: 100-150 Bar, Flow rate: 90-130 $m^3$/hr.

Exemplary Condition 13—See FIG. 19 for Example

Pressurization: Starting Temp: 80-90 Celsius, Pressure: 188-250 Bar, Flow rate: 90-130 $m^3$/hr.

Dyeing: Temp: 110-120 Celsius, Pressure: 250 Bar, Flow rate: 175-240 $m^3$/hr.

Depressurization: Starting Temp: 110-120 Celsius, Ending Pressure: 100-150 Bar, Flow rate: 90-130 $m^3$/hr.

Exemplary Condition 14—See FIG. 20 for Example

Pressurization: Start Temp: 80-90 Celsius, maintain 100 Celsius for 10 minutes, End Temp: 110-120 Celsius, Pressure: 188-250 Bar, Flow rate: 90-130 $m^3$/hr, External Pump: Off during temperature maintain.

Dyeing: Temp: 110-120 Celsius, Pressure: 250 Bar, Flow rate: 175-240 $m^3$/hr.

Depressurization: Starting Temp: 110-120 Celsius, Ending Pressure: 100-150 Bar, Flow rate: 90-130 $m^3$/hr.

Exemplary Condition 15—See FIG. 20 for Example

Pressurization: Start Temp: 80-90 Celsius, maintain 100 Celsius for 5 minutes, maintain 110 Celsius for 5 minutes, End Temp: 110-120 Celsius, Pressure: 188-250 Bar, Flow rate: 90-130 $m^3$/hr, External Pump: Off during temperature maintain.

Dyeing: Temp: 110-120 Celsius, Pressure: 250 Bar, Flow rate: 175-240 $m^3$/hr.

Depressurization: Starting Temp: 110-120 Celsius, Ending Pressure: 100-150 Bar, Flow rate: 90-130 $m^3$/hr.

Exemplary Condition 16—See FIG. 21 for Example

Pressurization: Start Temp: 80-90 Celsius, maintain 100 Celsius for 10 minutes, maintain 110 Celsius for 10 minutes, End Temp: 110-120 Celsius, Pressure: 188-250 Bar, Flow rate: 90-130 $m^3$/hr, External Pump: Off from first temp maintain to second temp maintain.

Dyeing: Temp: 110-120 Celsius, Pressure: 250 Bar, Flow rate: 175-240 $m^3$/hr.

Depressurization: Starting Temp: 110-120 Celsius, Ending Pressure: 100-150 Bar, Flow rate: 90-130 $m^3$/hr.

Exemplary Condition 17—See FIG. 21 for Example

Pressurization: Start Temp: 80-90 Celsius, maintain 100 Celsius for 5-10 minutes, maintain 110 Celsius for 5-10 minutes, End Temp: 110-120 Celsius, Pressure: 188-250 Bar, Flow rate: 90-130 $m^3$/hr, External Pump: Off during temperature maintaining.

Dyeing: Temp: 110-120 Celsius, Pressure: 250 Bar, Flow rate: 175-240 $m^3$/hr, Time: 90 minutes.

Depressurization: Starting Temp: 110-120 Celsius, Ending Pressure: 100-150 Bar, Flow rate: 90-130 $m^3$/hr.

Exemplary Condition 18—See FIG. 22 for Example

Pressurization: Start Temp: 80-90 Celsius, maintain 100 Celsius for 5-10 minutes, maintain 110 Celsius for 5-10 minutes, End Temp: 110-120 Celsius, Pressure: 188-250 Bar, Flow rate: 90-130 $m^3$/hr, External Pump: Off during temperature maintaining.

Dyeing: Temp: 110-120 Celsius, Pressure: 250 Bar, Flow rate: 175-240 $m^3$/hr, Time: 60 minutes.

Depressurization: Starting Temp: 110-120 Celsius, Ending Pressure: 100-150 Bar, Flow rate: 90-130 $m^3$/hr.

Exemplary Condition 19—See FIG. 22 for Example

Pressurization: Start Temp: 80-90 Celsius, maintain 100 Celsius for 5-10 minutes, maintain 110 Celsius for 5-10 minutes, End Temp: 110-120 Celsius, Pressure: 188-250 Bar, Flow rate: 90-130 $m^3$/hr, External Pump: Off during temperature maintaining.

Dyeing: Temp: 110-120 Celsius, Pressure: 250 Bar, Flow rate: 175-240 $m^3$/hr, Time: 60-120 minutes.

Depressurization: Starting Temp: 110-120 Celsius, Ending Pressure: 100-150 Bar, Flow rate: 90-240 $m^3$/hr.

As can be appreciated, variations in the combinations of variables, the timing of the variables, and the thresholds for each variable may be adjusted to achieve a result. For example, as the characteristics of the target material change, as the quantity and type of dyestuff change, the variables may be manipulated. The above-provided exemplary conditions are representative, but not limiting. Instead, combinations of variables may be combined as needed. A table is reproduced in FIG. 27 hereinafter providing exemplary conditions for various cycles of SCF dyeing, in accordance with aspects hereof.

Absorbent Material Finish Carrier Having a Different Polarity

As provided herein, a sacrificial material may be used as a transport vehicle to introduce the material finish (e.g., dyestuff) intended to be perfused through the target material. In an exemplary aspect, the material finish is soluble in $CO_2$ SCF allowing the SCF to dissolve the material finish to perfuse the material. SCF is non-polar; therefore, the chemistry of material finishes that are operable in a $CO_2$ SCF processing system are chemistries that dissolve in a non-polar solution. For example, dyestuff suitable for dyeing a polyester material may dissolve in $CO_2$ SCF, but not dissolve in water. Further, the dyestuff suitable for dyeing polyester may not have the appropriate chemistry to bond with a different material, such as an organic material like cotton. Therefore, it is contemplated that an organic material (e.g., cotton) is soaked in the material finish to be applied to a polyester material. The soaked organic material serves as the carrier material into the pressure vessel. When the $CO_2$ SCF process is performed, the material finish is dissolved by the $CO_2$ SCF and perfused through the polyester material. The organic material, which would require a different chemistry for material finish bonding, does not maintain the material finish and therefore the intended amounts of the material finish are available for the perfusing the target material.

In an example, a cotton material is used as a transport vehicle for dyestuff to dye a polyester material. In this example, 150 kg of polyester is desired to be dyed in a $CO_2$ SCF process. If 1% of total target weight represents the amount of dyestuff needed to achieve a desired coloration. Then 1.5 kg of dyestuff is needed to be perfused into the polyester to achieve the desired coloration. The 1.5 kg of dyestuff may be diluted in an aqueous solution with 8.5 kg of water. Therefore, the dyestuff in solution is 10 kg. Because the dyestuff has a chemistry suitable for dissolving in a non-polar $CO_2$ SCF, the dyestuff is merely suspended in the water as opposed to dissolved in the water, in this exemplary aspect. Cotton is highly absorbent. For example, cotton may be able to absorb up to 25 times its weight. Therefore, in order to absorb the 10 kg of dyestuff solution, a 0.4 kg portion of cotton (10/25=0.4) may serve as the carrier. However, it is contemplated that a larger portion of cotton may be used to achieve the transport of the dyestuff solution. In an exemplary aspect, a 30% absorption by weight of the cotton is contemplated. In the example above using 30% by weight absorption, the cotton is 33.3 kg to carry the 10 kg of dyestuff solution. It should be understood that the solution amount, dyestuff amount, and absorption amount may be adjusted to achieve the desired amount of material to be included in the pressure vessel for the dyeing process.

As applied to specific material finishing examples, it is contemplated that a material having different bonding chemistry needs than the target material (e.g., cotton to polyester) is submerged or otherwise soaked with a material finish solution. The soaked carrier material is then placed in the pressure vessel. The soaked carrier may be placed on a support structure or wrapped around the target material. The process of $CO_2$ SCF finishing may be initiated. The $CO_2$ SCF passes around and through the carrier material and dissolves the material finish for perfusing the target material with the material finish. At the completion of the material finish application, the $CO_2$ is transitioned from the SCF state to a gaseous or liquid state (in an exemplary aspect). The material finish, which does not have a bonding chemistry for the carrier material, is attracted to and maintained by the target material, in an exemplary aspect. Therefore, at the completion of the finish process, the material finish is applied to the target material and the carrier material is void of appreciable quantities of the material finish, in an exemplary aspect.

Carbon Dioxide Density Calculation

As provided herein, density of $CO_2$ affects a dissolution rate of dyestuff in SCF $CO_2$. Changing of temperature and/or pressure affects the density of $CO_2$; therefore, adjustments of the variables in the process affect the ability of the SCF $CO_2$ to have dyestuff dissolve therein. The density of $CO_2$ may be calculated using a number of techniques known to one of ordinary skill in the art. In an exemplary aspect, a method is provided by: R. Stryjek, J. H. Vera, *PRSV: An Improved Peng—Robinson Equation of State for Pure Compounds and Mixtures*; The Canadian Journal of Chemical Engineering, 64, April 1986. Other methods may also be implemented.

In an exemplary aspect, the temperature and pressure may be used to estimate a density of the $CO_2$ in terms of $Kg/m^3$. For example, operating at a temperature of 110 Celsius (e.g., 383 K) and 250 bars results in the $CO_2$ having a density of 525 $Kg/m^3$. As will be discussed, it is contemplated that a dyeing cycle of the process may operate at a relatively constant temperature, such as 100-120 Celsius (373-393 K) and a pressure of about 250 bars. With these temperature and pressure settings, the density of the SCF $CO_2$ may range from 566-488 $Kg/m^3$.

SCF $CO_2$ acts as a solvent. The solubility of the SCF $CO_2$ varies based on the density of the SCF $CO_2$, such that when temperature is maintained relatively constant the solubility of the SCF $CO_2$ increases with the density. Because density increases with pressure when temperature remains constant, the solubility of the $CO_2$ increases with pressure.

In addition to manipulation of pressure to affect solubility of $CO_2$, it is contemplated that temperature may be changed while maintaining the pressure relatively constant in the dyeing cycle of the processes provided herein. However, the relative trend between density and temperature is more complex. At a constant density, solubility of $CO_2$ will increase with temperature. However, close to the critical point of the $CO_2$, the density can drop sharply with a slight increase in temperature; therefore, close to the critical temperature, solubility often drops with increasing temperature, then rises again.

Further, it is contemplated that both the temperature and the pressure may be manipulated within the dyeing cycle of the process to affect the solubility by way of the $CO_2$ density to achieve a desired dissolution of a material finish, such as dyestuff.

In an exemplary aspect, the material placed within a pressure vessel to be treated by SCF $CO_2$ is a polyester-based material that may limit the manipulation of temperature and therefore changes in the density of $CO_2$ may be limited. For example, above 120 Celsius, polyester may approach or exceed a transition temperature that causes a change in the feel, look, and/or structure of the polyester. However, to achieve acceptable solubility characteristics of the $CO_2$, the pressure may be manipulated to achieve a sufficient density of the $CO_2$. Therefore, in exemplary aspects, the temperature is maintained below 120 Celsius to limit unintended effects on the material to be finished.

Because increasing pressure and/or temperature consumes resources, such as energy, that reduces the efficiency of the material finishing/dyeing process, aspects herein limit the pressure and or temperature to a range that is sufficient to achieve solubility of the material finish and also sufficient for interaction with the material being finished. In an exemplary aspect, sufficient temperature and pressure is 100-125 Celsius and a pressure less than 300 bars. In an exemplary aspect, the temperature is 100-115 Celsius and 225-275 bars, which allows for a sufficient $CO_2$ density to dissolve a multi-chemistry dyestuff and open the fibers of a polyester material for dyestuff permeation without negatively affecting the polyester of the to-be-finished material and without utilizing excessive energy resources trying to achieve a higher pressure. For example, a pressure of 310 bars and a temperature of 110 may also be executed to dye a polyester material; however, the 310 bar pressure consumes additional energy to achieve, which increases the cost and potential time of treating the material in a SCF $CO_2$ process.

Previously, a density above 600 $Kg/m^3$ was needed to achieve a sufficient solubility for a dyestuff to treat a material in the system. If the density of the $CO_2$ was below this value, the provided dyestuff would not dissolve in the $CO_2$ and therefore would not perfuse the material to-be-treated. For example, such as system may be disclosed in *Supercritical Fluid Technology In Textile Processing: An Overview*; Ind. Eng. Chem. Res. 2000, 39, 4514-41512. In the above system, a single dye chemistry is explored being dissolved at a $CO_2$ density exceeding 600 $Kg/m^3$ and utilization of the $CO_2$ in the range of 566-488 $Kg/m^3$ would not be sufficient to dissolve the explored dyestuff of that system. Therefore, to save energy, improve efficiency, and limit unintended effects on the material being finished, aspects herein contemplate limiting the density below 600 $Kg/m^3$.

Further, it is contemplated that aspects hereof are configured for flexibility of finish material to be applied. For example, aspects contemplate a multi-chemistry dyestuff being applied to the target material by SCF $CO_2$. Because there are multiple chemistries (e.g., multiple colors, multiple finishes, combinations of coloration and finishes, etc.), the various unique chemistries may have different $CO_2$ densities at which they dissolve. Therefore, the chemistries are selected, in an exemplary aspect, to dissolve at the $CO_2$ in the range of 566-488 $Kg/m^3$, in an exemplary aspect. An exemplary aspect contemplates a multi-chemistry finish, such as a three (or more) color dyestuff combination. While the unique chemistries of the dyestuff dissolve in $CO_2$ at different $CO_2$ densities, each of the chemistries are soluble within the parameters of the system, such as a density of the $CO_2$ in the range of 566-488 $Kg/m^3$. In an exemplary aspect the multiple chemistry finishes are an unrefined dyestuff that is soluble in $CO_2$ at a density in the range of 566-488 $Kg/m^3$.

The resulting feel (also referred to as "hand") of a material after finishing is an important criteria to consider when performing a finishing operation. In an exemplary aspect, it is contemplated that the material resulting from a SCF $CO_2$ finishing process should have a similar feel (or hand) to that of a material finished in a water-based process. Therefore, it is contemplated that the variables achieving different $CO_2$ densities may further be constrained based on their effect on the hand of the finished material. For example, processing at a temperature less than 110 Celsius provides, in an exemplary aspect, a better hand to the material than at temperatures above 110 Celsius. As provided above, a polyester material may have a transitional temperature near 120 Celsius (or any temperature above 110 Celsius) and the encroachment on that transitional temperature for a period of time during the $CO_2$ process cycle changes the processed material's hand/feel. In yet a further aspect, operating at 100 Celsius for a polyester material results in a hand similar to that of a water-based dyeing process. Therefore, in exemplary aspects, $CO_2$ operations at 100 Celsius may be selected to result in a hand feel similar to that of a material finished in a water-based solution.

Cleaning Cycle Reduction/Elimination

Efficiencies at the precipitation of the finishing material realized in the processes described hereinabove allow for, in exemplary aspects, operating the $CO_2$ processes in a repeated manner without interviewing cleaning of the system between target material runs. For example, allowing the finishing material to precipitate as it is being perfused through the target material as opposed to when it is stagnant in proximity to the pressure vessel or other components therein limits the amount of finishing material maintained by the system (e.g., on the vessel walls, on the holding member of the target material) following the depressurization cycle (e.g., depressurization cycle 1812 of FIG. 7). If the finishing material did have a greater maintaining potential to the system components, then a sacrificial cleaning material may be placed in the pressure vessel following a target material run and prior to another target material run. The purpose of the sacrificial cleaning material in exemplary aspects is to capture the residual finishing material that was maintained by the system components at the completion of the target material run. The process of cleaning the system by way of inserting the sacrificial cleaning material may require pressurizing the system and running at least a modified three-cycle $CO_2$ process to dissolve the residual finishing material in the SCF $CO_2$ to be transferred from the system surfaces to the sacrificial cleaning material. Additionally (or alternatively) a cleaning process may rely on one or more chemical solvents (e.g., acetone) to transfer the residual finishing material. Therefore, environmental, time, and energy resources may be saved by reducing the use of a cleaning cycle between target material runs. The elimination or reduction of cleaning cycles between runs may be realized through the maintaining of flow rate at a non-zero value as the finishing material is precipitating from the $CO_2$. Additionally, it is contemplated that the maintaining of a temperature above a threshold value until the finishing material precipitates out of the $CO_2$ also reduces or eliminates the need for a subsequent cleaning process. For example, as described above, if the target material is a polyester material, maintaining the temperature above 100 Celsius keep pores of the polyester open a sufficient amount for maintaining of finishing materials (e.g., dyestuff) within the polyester as the pressure decreases causing the dyestuff the precipitate out of the $CO_2$. Allowing the pores of the polyester to stay sufficiently open during the precipitation phase limits that residual accumulation of finishing material on components of the pressure vessel and system, in an exemplary aspect.

Therefore, it is contemplated that a series of cycles in a pressure vessel may include the insertion of a first target material into the pressure vessel, a first pressurization cycle, a first dyeing/treatment cycle, a first depressurization cycle, removal of the first target material, insertion of a second target material, a second pressurization cycle, a second dyeing/treatment cycle, a second depressurization cycle, and removal of the second target material. Absent from this sequence of event is the insertion of a sacrificial cleaning material and cycles of pressurization-dyeing/treatment/cleaning-depressurization with the sacrificial material. The elimination of these steps in the process saves, time, energy, and the sacrificial cleaning material.

A sacrificial cleaning material may be a material of similar composition to that of the target material. However, a lesser quantity of the sacrificial material may be used than the target material. For example, the target material may be 100-200 Kg of material. The sacrificial cleaning material may be less than 100 Kg of material. Further, while the cycles of treatment for a target material are selected to achieve a desired finish on the target material, the cycles of a cleaning process are instead selected to reduce the residual finishing material on the system surfaces regardless of the sacrificial cleaning material finish outcome. Another distinction between a sacrificial cleaning material and a target material is that additional finishing materials are not generally included in the $CO_2$ process involving the sacrificial cleaning material. Further, inclusion of nominal finishing materials at a concentration disproportionate (e.g., 1-20%) of that used in connection with a target material could still be considered a sacrificial cleaning material, in exemplary aspects. Therefore, a sacrificial cleaning material can be distinguished from a target material as the finish of the material is not the primary purpose of the inclusion of the sacrificial cleaning material in the pressure vessel, in exemplary aspects.

Target Material Scouring

Scouring is a process of preparing a target material for eventual finishing by the SCF process. For example, scouring removes oils and oligomers from the target material. The oils and oligomers, if allowed to remain in association with the target material, can affect a dyeing process. Therefore, the oils and oligomers are traditionally removed in a water-based scouring process prior to dyeing of the target material. Aspects herein use a SCF environment to scour a target material, such as a rolled good or a spooled good. A SCF scouring process reduces water usage and potential environmental impact as a result of the waterless implementation provided by a SCF, such as SCF $CO_2$.

SCF scouring uses an operating environment similar to that provided above with respect to the SCF dyeing implementations. For example, a pressure vessel, such as an autoclave, may be used to pressurize and heat a gas to achieve a SCF state. Unlike dyeing, however, scouring is focused on removing elements (e.g., oligomers, oils) from the target material rather than introducing elements (e.g., dyestuff) to the target material. As such, some of the elements of the system may be utilized differently for scouring rather than dyeing. For example, a pump system that introduces and captures $CO_2$ from within the pressure vessel may be used during the scouring process to extract $CO_2$ and elements removed from the target material. This pump system is referred to herein as an external pump as the external pump is effective to circulate material (e.g., $CO_2$) between the internal pressure vessel and an external location, such as a $CO_2$ reservoir and filter. Aspects contemplate extracting $CO_2$ having scoured elements, such as oligomers and oils, from the pressure vessel to the external location. The extracted $CO_2$ may be filtered or otherwise treated to remove the extracted scoured elements from the $CO_2$. Additionally, it is contemplated that a surfactant may be added to the processes to aid in the bonding between the SCF $CO_2$ and the oligomers and/or oils. Additionally, it is contemplated that a sacrificial material is included with the target material such that the scoured elements, once removed from the target material, have a greater affinity for the sacrificial material allowing the scoured elements to transfer from the target material to the sacrificial material.

Figure 16:
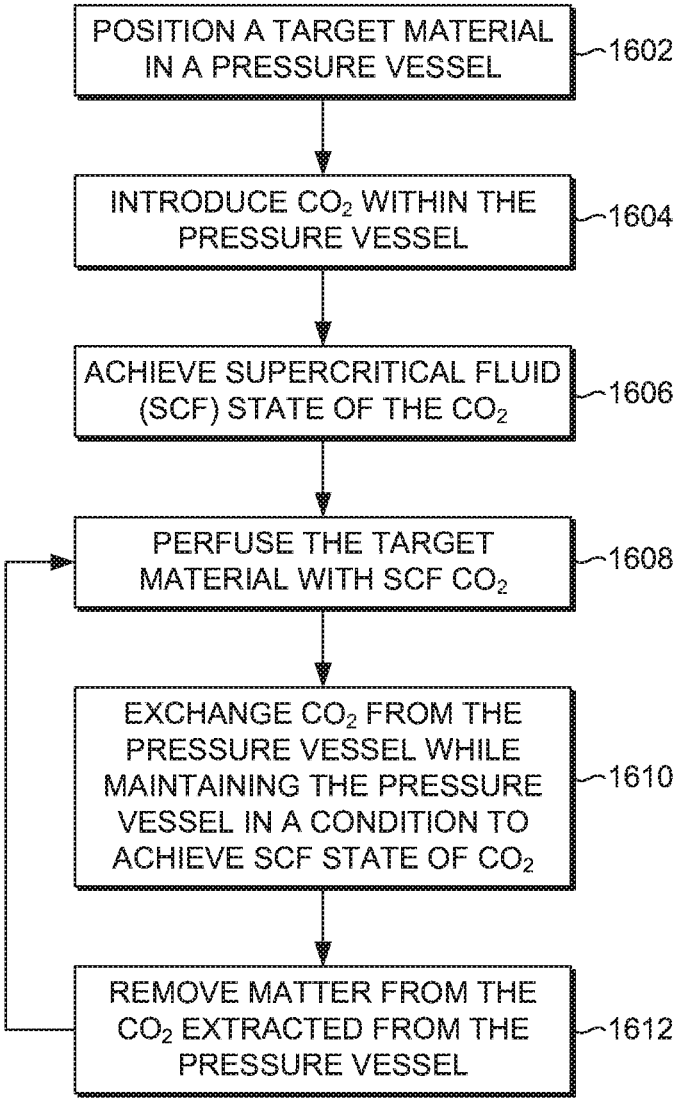
FIG. 16 depicts a flow chart representing an exemplary method of scouring a material with supercritical fluid, in accordance with aspects hereof.

FIG. 16 depicts a flow chart representing an exemplary method of scouring a material with supercritical fluid, in accordance with aspects hereof. At a block 1602 a target material is positioned in a pressure vessel. The target material may be any material. For example, the material may be polyester, polyester blends, cotton, and the like. Further, the material may be a rolled good (e.g., rolled knit or woven fabric) and/or a spooled good (e.g., yarn, thread). The material may be positioned within the pressure vessel in any manner, such as those discussed above with respect to dyeing.

At a block 1604, $CO_2$ is introduced within the pressure vessel. An external pump may transmit the $CO_2$ from an external source, such as a holding tank, to the internal volume of the pressure vessel. The $CO_2$ may be in any state, such as gas or liquid as it is introduced. The $CO_2$ is brought to at least a SCF state at a block 1606. As previously discussed herein, the $CO_2$ may be heated and pressurized to prescribed levels to achieve a sufficient scour operation.

The target material is perfused with the SCF $CO_2$ at a block 1608. Unlike SCF dyeing of the target material, the perfusing of the target material with SCF $CO_2$ in the scouring process has intent to remove unwanted elements from the target material. In some example, the pressure vessel may also include a surfactant or other material that aids in the bonding of the scoured elements with the SCF $CO_2$. The surfactant or other materials are selected from those materials that will have a known or no impact on subsequent dyeing (e.g., finishing) of the target material. An internal pump may be activated to circulate the SCF $CO_2$ in order to perfuse the target material, in a manner similarly described above with respect to the SCF dyeing of a material.

At a block 1610, the SCF $CO_2$ is exchanged from the pressure vessel while maintaining the pressure vessel in a condition to achieve a SCF state of the $CO_2$. An external pump may be activated to cause the exchange. The external pump may remove a quantity $CO_2$ that is passed through one or more traps or filters effective to remove the scoured elements from the $CO_2$. The external pump may reintroduce $CO_2$ (the same or different $CO_2$) within the pressure vessel. As such, the exchange of $CO_2$ allows for a scrubbing of the working $CO_2$ to extract the scoured elements from the pressure vessel. The exchange of the $CO_2$ containing the scoured elements prevents, in some examples, the scoured elements from accumulating on the pressure vessel during the scouring process.

At a block 1612, scoured elements are removed from the extracted $CO_2$. The $CO_2$ may pass through a trap or filter processes to remove the oligomers and/or oils from the $CO_2$. This allows the $CO_2$ to be recycled and eventually introduced back into the pressure vessel. As such, the method of FIG. 16 depicts a return to the block 1608, which may represent a continued perfusing of the target material even as the $CO_2$ is at least partially filtered and returned to the pressure vessel. However, it is contemplated that the pressure vessel is a closed system during the scouring process and the $CO_2$ is only removed from the pressure vessel at the completion of the scouring process, in an exemplary aspect.

Figure 17:
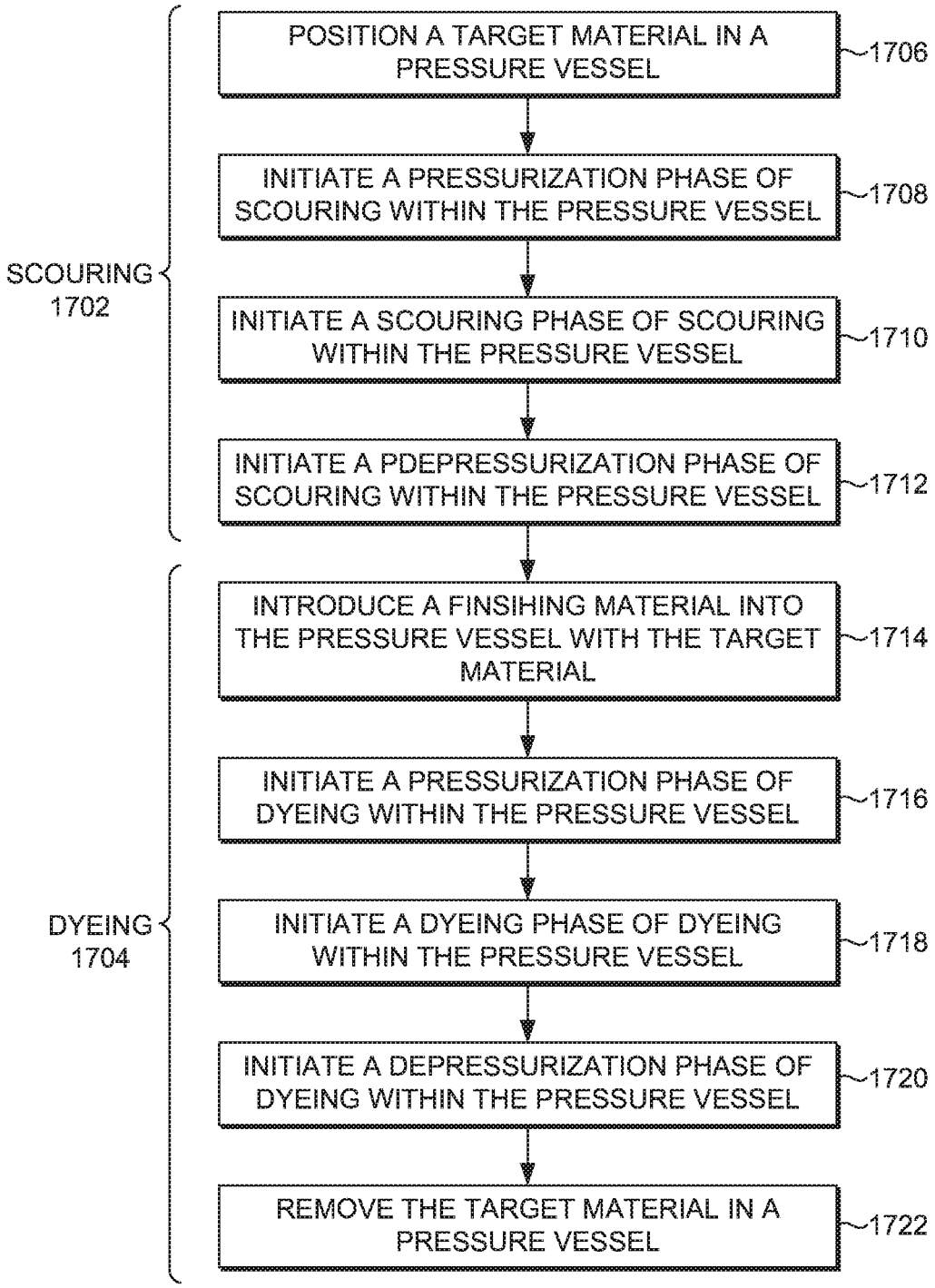
FIG. 17 depicts a flow chart representing an exemplary method of scouring and finishing (e.g., dyeing) a material in a continuous process, in accordance with aspects hereof.

FIG. 17 depicts a flow chart representing an exemplary method of scouring and treating (e.g., dyeing) a material in a continuous process using SCF, in accordance with aspects hereof. In general, the method of FIG. 17 includes two primary portions, a scouring portion 1702 and a dyeing (e.g., finishing) portion 1704. The scouring steps 1702 and the dyeing steps 1704 may be performed in a continuous operation. This is in contrast to traditional scouring that may require unrolling a rolled good through a water bath that scours the material, drying the material, and then rerolling the material for a subsequent dyeing process. A SCF environment allows for a target material (e.g., roll or spool) to be positioned in a pressure vessel, as depicted in a block 1706 of the scouring steps 1702.

A pressurization cycle of the scouring process is initiated, as depicted at a block 1708. A scouring cycle of the scouring process is initiated at a block 1710. A depressurization cycle of the scouring is initiated within the pressure vessel at a block 1712. As provided herein, the various cycles of the scouring process may be adjusted based on the material, conditions, or other factors.

Without removing the target material from the pressure vessel, in an exemplary aspect, the dyeing steps 1704 may be performed following the completion of the scouring steps 1702. In an alternative aspect, the target material may be removed from the pressure vessel to introduce a finishing material (e.g., dyestuff). Once the finishing material is introduced to the target material (e.g., a sacrificial material having the dyestuff placed in contact with the target material), the target material may be repositioned in the pressure vessel for the dyeing steps 1704 to be completed. Therefore, it is contemplated that a transition from a SCF scouring to a SCF dyeing process may be achieved with minimal disruption and substantially continuous in nature.

At a block 1714, finishing material is introduced into the pressure vessel with the target material. The finishing material may be introduced in any manner contemplated herein for dyeing. At a block 1716, a pressurization cycle of the dyeing process is initiated within the pressure vessel. At a block 1718, a dyeing cycle of the dyeing process is initiated within the pressure vessel. At a block 1720, a depressurization cycle of the dyeing process is initiated within the pressure vessel. At a block 1722, the target material is removed from the pressure vessel. FIG. 17 provides for the target material to be scoured by a SCF process in the scouring steps 1702 and then subsequently dyed using SCF in the dyeing steps 1704, in accordance with aspects hereof.

FIGS. 23-26 depict relative variables during cycles of SCF scouring, in accordance with aspects hereof. The cycles may include, but are not limited to, a pressurization cycle 2308, a scouring cycle 2310, a rinsing cycle 2311, a depressurization cycle 2312, and a completion cycle 2314. The scouring cycle 2310 and the rinsing cycle 2311 may be a common cycle in some aspects provided herein. The variables, similar to those discussed with respect to SCF dyeing include temperature 2302, pressure 2304, internal flow rate 2306, and external pump 2307. As with the FIGS. 18-22 discussed previously, the depiction of the variables are for illustration purposes and are not to scale. Further, it is contemplated that values and configurations provided with respect to dyeing processes herein may be applied to scouring processes in aspects. Therefore, FIGS. 23-26 are exemplary in nature and not limiting as to configurations of variables.

Figure 23:
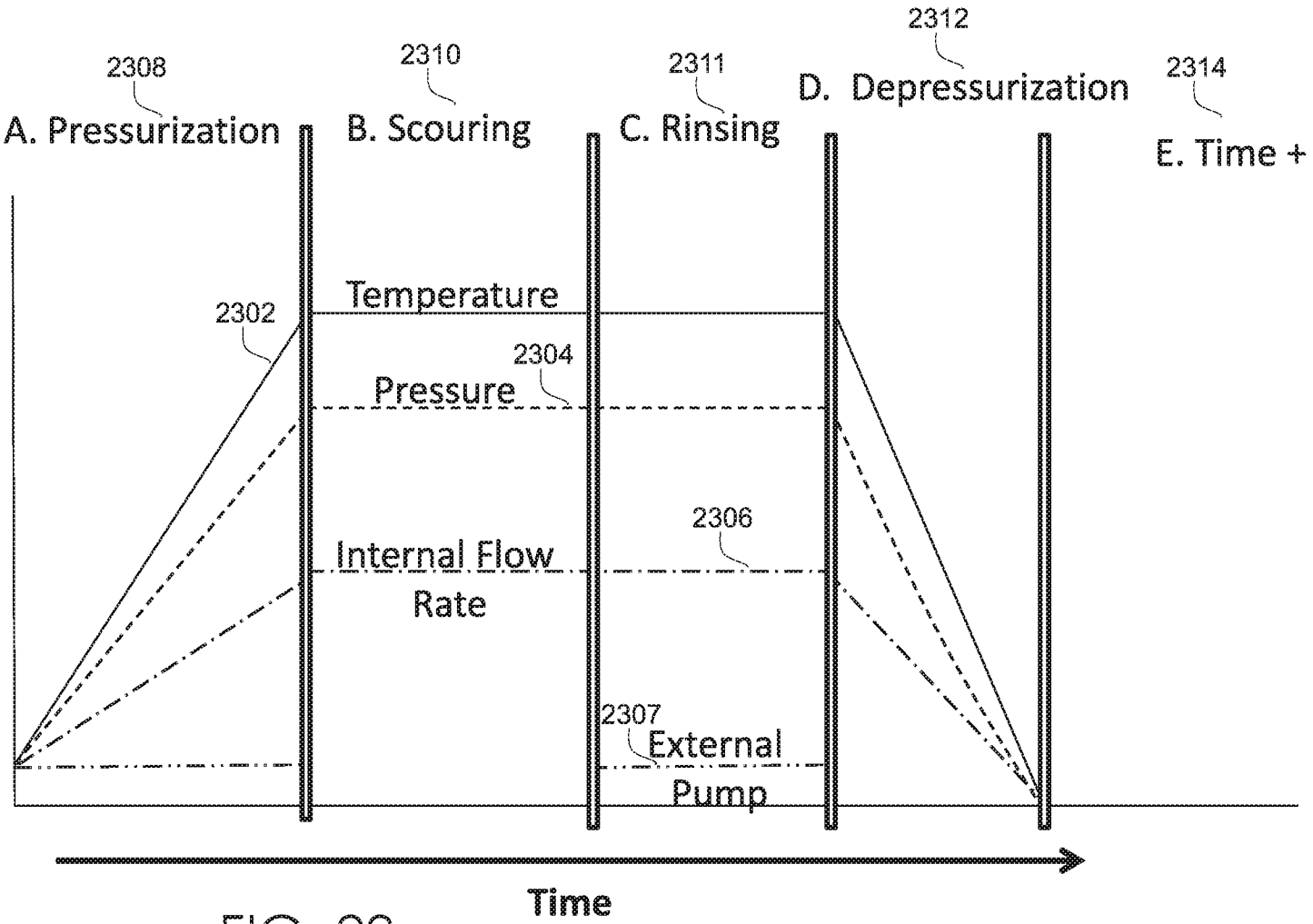
FIGS. 23-26 depict relative variables during cycles of supercritical scouring, in accordance with aspects hereof.

FIG. 23 provides an exemplary depiction of variables for a SCF scouring process, in accordance with aspects hereof. For example, the temperature 2302 may start at about 80-90 Celsius and the external pump 2307 may be on, and the internal flow rate may be increased to about 240 $m^3$/hr in the pressurization cycle 2308. This configuration allows for the $CO_2$ to be circulated relative to the target material as the pressure and temperature increase to appropriate levels for the scouring cycle 2310. During the scouring cycle 2310, the external pump 2307 is turned off while temperature, pressure, and the internal flow rate are maintained. The scouring cycle 2310 may operate for any duration of time (e.g., 15, 30, 45, 60, 75, 90, 105, 120 minutes). In an exemplary aspect the scouring cycle operated for at least 60 minutes. The rinsing cycle 2311 continues to maintain temperature (e.g., 100-125 Celsius), pressure (200-250 bars), and internal rate flow (e.g., 90-240 $m^3$/hr) relatively constant, but the external pump 2307 is initiated again. The use of the external pump 2307 may exchange the $CO_2$ and extract scoured elements (e.g., oligomers, oils) from the pressure vessel to rinse the system of the scoured elements prior to changing the state of the $CO_2$. The rinsing cycle 2311 may operate for any time (e.g., 15, 30, 45, 60, 75, 90 minutes). In an exemplary aspect, the rinsing cycle 2311 is about 30 minutes. The depressurization cycle 2312 drops the temperature, pressure, and internal flow rate, in this example. The total time may be adjusted based on the target material characteristics and/or the amount of scouring to occur.

Figure 24:
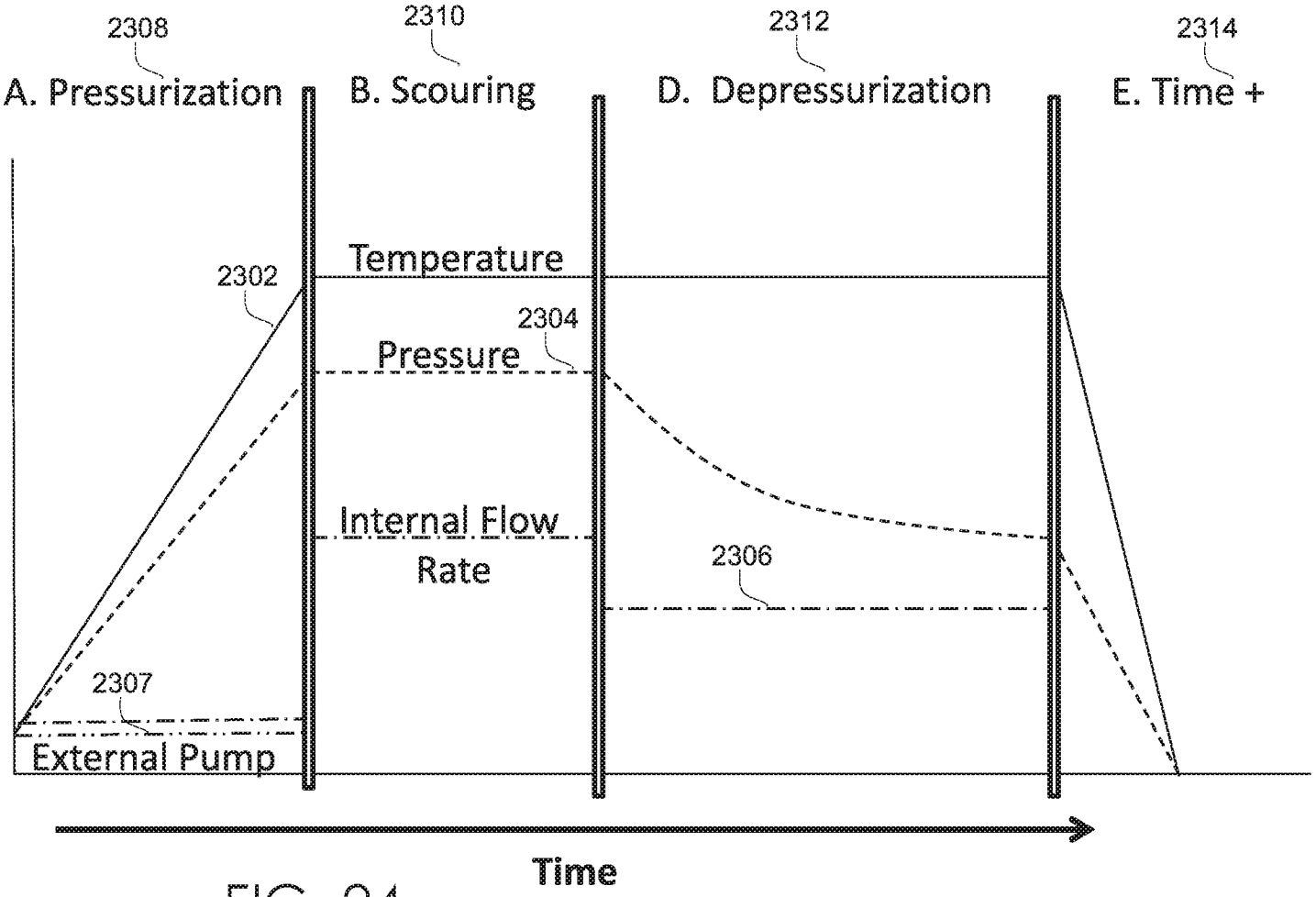

FIG. 24 provides an exemplary depiction of variables for a SCF scouring process, in accordance with aspects hereof. Specifically, a separate rinsing cycle is omitted in this example. Further, the external pump 2307 operates only in the pressurization cycle 2308 and not in the other scouring cycle 2310 or the depressurization cycle 2312, in this example. In an exemplary scenario, the internal flow rate 2306 may operate in a 90-130 $m^3$/hr range during the pressurization cycle 2308, increase to a 175-240 $m^3$/hr range during the scouring cycle 2310, and decrease to a 90-130 $m^3$/hr range during the depressurization cycle 2312, in an exemplary aspect. The pressure 2304 may achieve 250 bar in the scouring cycle 2310 and decrease to 130 bar in the depressurization cycle 2312. As with the dyeing process, any rate of depressurization may be used. In an exemplary aspect 5 bar/min is applied for a depressurization.

Figure 25:
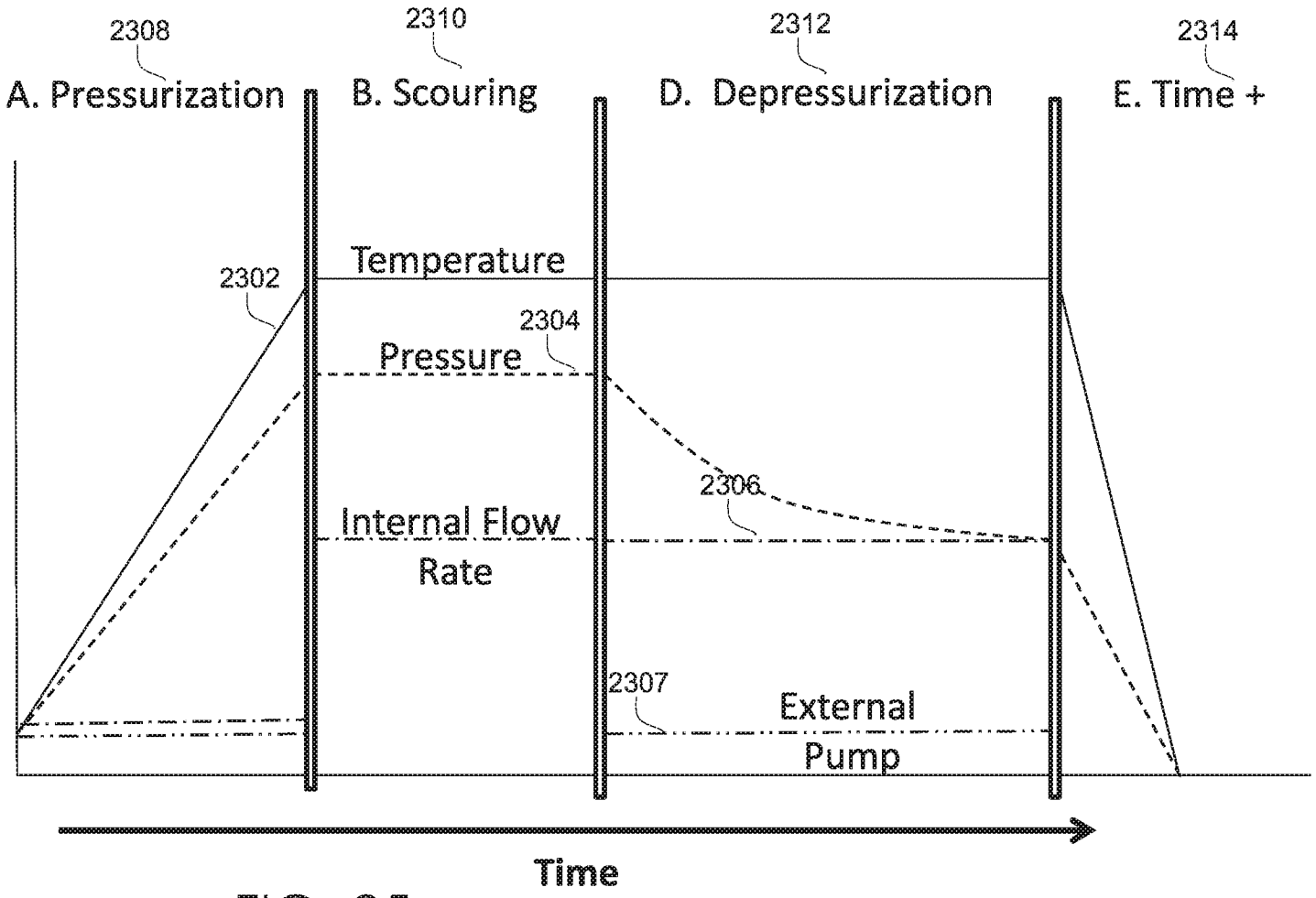

FIG. 25 provides an exemplary depiction of variables for a SCF scouring process, in accordance with aspects hereof. In this example, the internal flow rate 2306 may be maintained during the scouring cycle 2310 and the depressurization cycle 2312. Further, the external pump 2307 may be on during the pressurization cycle 2308 as well as the depressurization cycle 2312 (while being off during the scouring cycle 2310).

Figure 26:
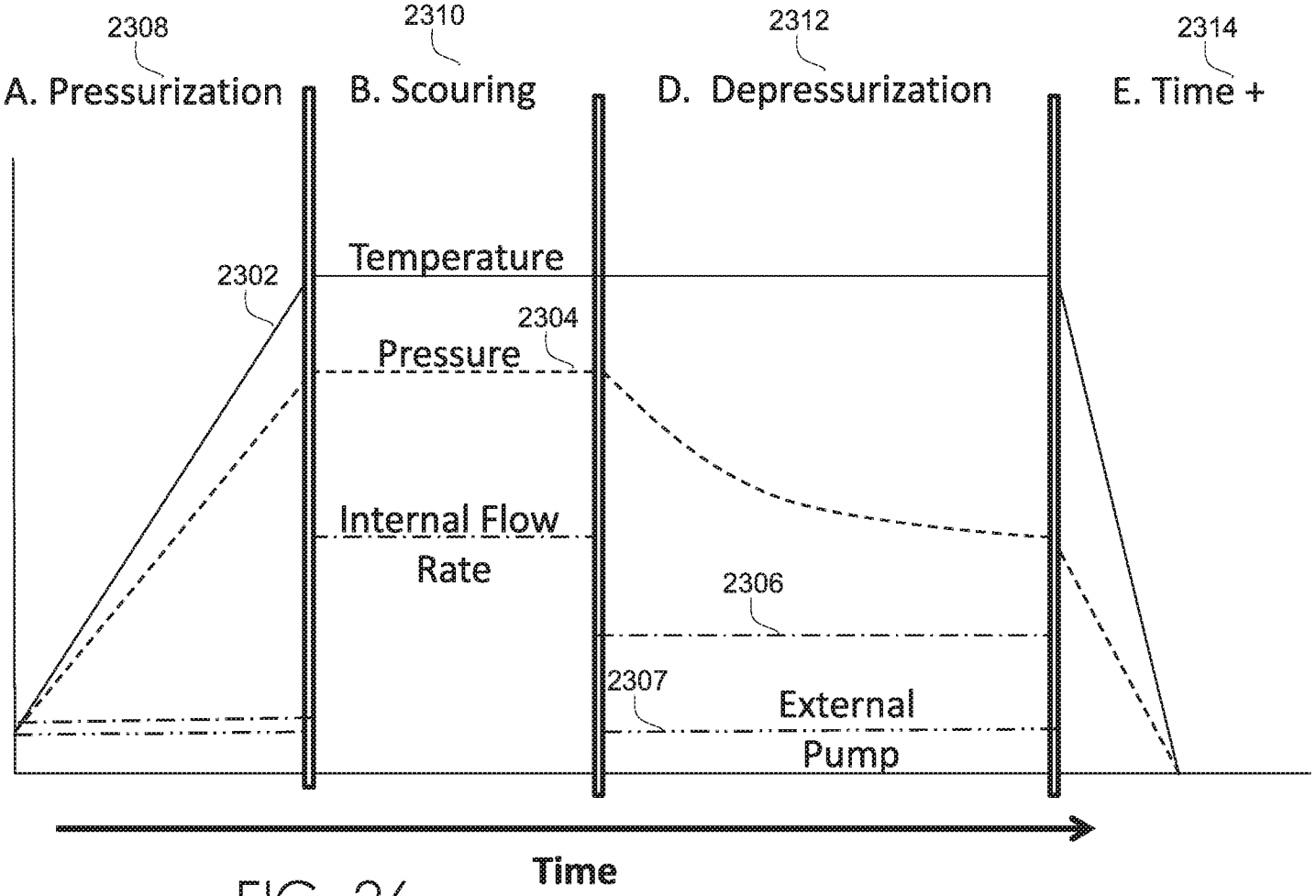

FIG. 26 provides an exemplary depiction of variables for a SCF scouring process, in accordance with aspects hereof. In this example, the internal flow rate may be varied among the different cycles while the external pump 2307 is activated during the pressurization cycle 2308 and the depressurization cycle 2312 while being inactive during the scouring cycle.

Therefore, it is contemplated that any combination and value of variables may be applied during the SCF scouring process. For example, the temperature, pressure, flow rate, time, and external pump may all be adjusted during each of the cycles to achieve a degree of scouring appropriate for a target material and subsequent process, such as dyeing of the target material. Further yet, the variables discussed with respect to SCF dyeing herein may equally apply to SCF scouring. For example, the combinations of variables for pressurization cycle of SCF dyeing may be applied in some aspects of pressurization cycle of the SCF scouring; combinations of variables for dyeing cycle of SCF dyeing may be applied in some aspects of the scouring cycle of the SCF scouring; and combinations of variables for the depressurization cycle of SCF dyeing may be applied in some aspects of the depressurization cycle of SCF scouring.

It will be understood that certain features and subcombinations are of utility and may be employed without reference to other features and subcombinations. This is contemplated by and is within the scope of the claims.

While specific elements and steps are discussed in connection to one another, it is understood that any element and/or steps provided herein is contemplated as being combinable with any other elements and/or steps regardless of explicit provision of the same while still being within the scope provided herein. Since many possible embodiments may be made of the disclosure without departing from the scope thereof, it is to be understood that all matter herein set forth or shown in the accompanying drawings is to be interpreted as illustrative and not in a limiting sense.

The invention claimed is:

1. A method of scouring a target material, the method comprising:

positioning a target material in a pressure vessel;

introducing carbon dioxide ("$CO_2$") within the pressure vessel;

increasing an internal temperature of the pressure vessel to an operating temperature;

increasing a flow rate to a non-zero rate;

increasing a pressure within the pressure vessel to an operating pressure, wherein the $CO_2$ is at supercritical fluid ("SCF") state when at the operating temperature and the operating pressure;

removing, using SCF $CO_2$, scoured elements from the target material with the SCF $CO_2$; and reducing the pressure from the operating pressure to a transition pressure while maintaining the temperature above a threshold temperature, wherein the scoured elements comprise at least one of oligomers and oils, wherein a surfactant is added to aid in the bonding between the SCF $CO_2$ and the oligomers and/or oils.

2. The method of claim 1, wherein the SCF $CO_2$ circulates at a flow rate in a range of 175-240 $m^3$/hr while removing the scoured elements from the target material.

3. The method of claim 2 further comprising reducing the flow rate to a flow rate in a range of 90-130 $m^3$/hr after reducing the pressure from the operating pressure.

4. The method of claim 1, wherein the target material is a rolled material or a spooled material.

5. The method of claim 1, wherein the operating temperature is in a range of 100-125 Celsius.

6. The method of claim 1, wherein the operating pressure is less than 300 bar.

7. The method of claim 1, wherein the operating pressure is in a range of 225 and 275 bar.

8. The method of claim 1 further comprising exchanging at least a portion of the $CO_2$ from the pressure vessel.

9. The method of claim 8, wherein the $CO_2$ is filtered as the $CO_2$ is exchanged to separate the scoured elements from the $CO_2$.

10. The method of claim 8, wherein the exchanging of $CO_2$ does not occur while the pressure is at the operating pressure.

11. The method of claim 1, wherein the operating pressure and operating temperature produce a $CO_2$ density in a range of 566-488 Kg/$m^3$.

12. The method of claim 1, wherein the reduction in pressure is at a range of 1-10 bar per minute.

13. The method of claim 1, wherein the transition pressure is 100-225 bar.

14. The method of claim 1, wherein the threshold temperature is 100 Celsius.

15. The method of claim 1, wherein the threshold temperature is the operating temperature.

16. The method of claim 1 further comprising decreasing the flow rate from the threshold rate after decreasing the pressure to the transition pressure.

17. The method of claim 1 further comprising decreasing the temperature from the threshold temperature after decreasing the pressure to the transition pressure.

* * * * *